US010901366B2

(12) United States Patent
Murakami et al.

(10) Patent No.: US 10,901,366 B2
(45) Date of Patent: Jan. 26, 2021

(54) IMAGE FORMING APPARATUS AND CARTRIDGE

(71) Applicant: CANON KABUSHIKI KAISHA, Tokyo (JP)

(72) Inventors: Ryuta Murakami, Suntou-gun (JP); Naoki Matsumaru, Suntou-gun (JP); Tadashi Horikawa, Numazu (JP); Tetsuji Suzuki, Fujisawa (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 16/863,163

(22) Filed: Apr. 30, 2020

(65) Prior Publication Data

US 2020/0257242 A1 Aug. 13, 2020

Related U.S. Application Data

(62) Division of application No. 16/217,308, filed on Dec. 12, 2018, now Pat. No. 10,678,184.

(30) Foreign Application Priority Data

Dec. 13, 2017 (JP) ..... 2017-238455

(51) Int. Cl.
*G03G 21/18* (2006.01)
*G03G 15/08* (2006.01)
(Continued)

(52) U.S. Cl.
CPC ..... *G03G 21/186* (2013.01); *G03G 15/0818* (2013.01); *G03G 21/1864* (2013.01);
(Continued)

(58) Field of Classification Search
CPC ..... G03G 21/186; G03G 21/1857; G03G 21/1864; G03G 15/757
See application file for complete search history.

(56) References Cited

U.S. PATENT DOCUMENTS 5,903,803 A 5/1999 Kawai et al.
6,385,416 B1 5/2002 Horikawa et al.
(Continued)

FOREIGN PATENT DOCUMENTS

EP 2 362 274 A2 8/2011
EP 3 470 931 A1 4/2019
(Continued)

OTHER PUBLICATIONS

Extended Search Report in European Patent Application No. 19 175 313.6, dated Oct. 14, 2019.
(Continued)

*Primary Examiner* — Thomas S Giampaolo, II
(74) *Attorney, Agent, or Firm* — Venable LLP

(57) ABSTRACT

The image forming apparatus includes a cartridge and an image forming apparatus main assembly. An image forming apparatus main assembly includes a drive output member for transmitting the driving force to the cartridge. The drive output member is movable between an advanced position and a retracted position. An image forming apparatus main assembly includes an inclination imparting portion for inclining the drive output member as the drive output member moves from the advanced position to the retracted position.

7 Claims, 39 Drawing Sheets

(a)

(51) Int. Cl.
*G03G 15/00* (2006.01)
*G03G 21/16* (2006.01)

(52) U.S. Cl.
CPC ..... *G03G 15/757* (2013.01); *G03G 21/1633* (2013.01); *G03G 2221/1869* (2013.01)

(56) References Cited

U.S. PATENT DOCUMENTS 6,505,007 B2 1/2003 Miura et al.
6,553,189 B2 4/2003 Miyamoto et al.
6,681,088 B2 1/2004 Kanno et al.
6,703,094 B2 3/2004 Kakii et al.
6,735,405 B2 5/2004 Yokoi et al.
6,836,639 B2 12/2004 Karakama et al.
6,898,392 B2 5/2005 Karakama et al.
6,963,706 B2 11/2005 Morioka et al.
6,987,938 B2 1/2006 Murakami et al.
7,024,131 B2 4/2006 Komatsu et al.
7,027,756 B2 4/2006 Hoshi et al.
7,062,195 B2 6/2006 Kurihara et al.
7,072,594 B2 7/2006 Hoshi et al.
7,072,603 B2 7/2006 Tsuzuki et al.
7,156,797 B2 1/2007 Komatsu et al.
7,162,174 B2 1/2007 Suzuki et al.
7,162,181 B2 1/2007 Maeshima et al.
7,203,442 B2 4/2007 Matsubara et al.
7,206,534 B2 4/2007 Murakami
7,346,293 B2 3/2008 Suzuki et al.
7,366,440 B2 4/2008 Horikawa
7,386,241 B2 6/2008 Mori et al.
7,933,534 B2 4/2011 Hoshi et al.
8,238,784 B2 8/2012 Kusudo et al.
8,249,485 B2 8/2012 Horikawa et al.
8,311,449 B2 11/2012 Kusudo et al.
8,401,423 B2 3/2013 Suzuki
8,515,306 B2 8/2013 Kawai et al.
8,620,181 B2 12/2013 Murakami
8,626,023 B2 1/2014 Suzuki
8,682,211 B2 3/2014 Hoshi et al.
8,886,085 B2 11/2014 Suzki
9,052,638 B2 6/2015 Matsumaru et al.
9,069,289 B2 6/2015 Batori et al.
9,116,466 B2 8/2015 Makiguchi et al.
9,164,430 B2 10/2015 Murakami et al.
9,182,733 B2 11/2015 Horikawa et al.
9,188,906 B2 11/2015 Batori et al.
9,213,267 B2 12/2015 Hoshi et al.
9,229,371 B2 1/2016 Murakami et al.
9,465,318 B2 10/2016 Takeuchi et al.
9,523,942 B2 12/2016 Takeuchi et al.
9,599,932 B2 3/2017 Takeuchi et al.
9,989,892 B2 6/2018 Takeuchi et al.
10,095,161 B2 10/2018 Takeuchi et al.
2004/0028429 A1 2/2004 Matsumaru
2005/0111882 A1 5/2005 Sudo et al.
2005/0163535 A1 7/2005 Okada et al.
2007/0147883 A1 6/2007 Sato et al.
2007/0147895 A1 6/2007 Hayakawa
2010/0278559 A1 11/2010 Komatsu et al.
2011/0182623 A1* 7/2011 Tomatsu ..... G03G 21/186 399/167
2013/0216265 A1 8/2013 Peng et al.
2014/0227003 A1* 8/2014 Okabe ..... G03G 21/186 399/111

FOREIGN PATENT DOCUMENTS

JP H08-328449 A 12/1996
JP 2005-114159 A 4/2005
JP 2005-214233 A 8/2005
JP 2007-086665 A 4/2007
JP 2007-178606 A 7/2007
JP 2013-545134 A 12/2013

OTHER PUBLICATIONS

Extended Search Report in European Patent Application No. 18 209 121.5, dated Aug. 22, 2019.

* cited by examiner (a)

(b)

(a)

(b)

(c)

(a)

(b)

(a)

(b)

(a)

(b)

(a)

(b)

IMAGE FORMING APPARATUS AND CARTRIDGE

FIELD OF THE INVENTION AND RELATED ART

The present invention relates to a cartridge and an image forming apparatus using the cartridge.

Here, the cartridge is dismountable from a main assembly of the image forming apparatus. One example is a process cartridge. The process cartridge is a cartridge that is integrated with a photosensitive member and process mans actable on the photosensitive member into a cartridge which is dismountably mountable to a main assembly of an electrophotographic image forming apparatus.

For example, the photosensitive member and at least one of a developing means, a charging means, and a cleaning means as the above-mentioned process means are integrally assembled into a cartridge. An image forming apparatus in the present application is an electrophotographic image forming apparatus for forming an image on a recording medium by using an electrophotographic image forming process.

Examples of the electrophotographic image forming apparatus include an electrophotographic copying machine, an electrophotographic printer (LED printer, laser beam printer, etc.), a facsimile machine, a word processor, and the like.

In the electrophotographic image forming apparatus (hereinafter simply referred to as image forming apparatus), an electrophotographic photosensitive member, generally a drum type image bearing member, that is, a photosensitive drum (electrophotographic photosensitive drum) is uniformly charged. Subsequently, the charged photosensitive drum is selectively exposed to form an electrostatic latent image (electrostatic image) on the photosensitive drum. Next, the electrostatic latent image formed on the photosensitive drum is developed into a toner image with toner as developer. And, a toner image formed on the photosensitive drum is transferred onto a recording material such as a recording sheet, a plastic sheet, and further heat and pressure are applied to the toner image transferred onto the recording material, by which the toner image is fixed on the recording material, thus performing image recording operation.

Such an image forming apparatus generally requires toner replenishment and maintenance of various process means. In order to facilitate toner replenishment and maintenance, a process cartridge, which is dismountable to a main assembly of the image forming apparatus by integrating the photosensitive drum, the charging means, the developing means, the cleaning means and the like inside the frame into a cartridge is in practical use.

According to this process cartridge system, a part of the maintenance of the apparatus can be performed by the user himself/herself without relying on a service person in charge of after-sales service. Therefore, an operability of the apparatus can be remarkably improved, and an image forming apparatus excellent in usability can be provided. Therefore, this process cartridge system is widely used in image forming apparatuses.

In addition, as the above-described image forming apparatus, there is one described in Japanese Patent Application Laid-open No. 8-328449 which discloses a drive transmission member for transmitting driving force (drive) from the main assembly of the image forming apparatus to the process cartridge. A coupling is provided at a free end of the drive transmission member, and the drive transmission member is urged toward the process cartridge side by a spring.

When an opening and closing door of the image forming apparatus main assembly is closed, the drive transmission member of this image forming apparatus is pressed by the spring and moves toward the process cartridge. By doing so, the drive transmission member engages (couples) with the coupling of the process cartridge, and the driving force can be transmitted to the process cartridge. In addition, when the opening/closing door of the image forming apparatus main assembly is opened, the drive transmission member moves in a direction away from the process cartridge against the spring by a cam. By doing so, the engagement (coupling) of the drive transmission member with the coupling of the process cartridge is released, and the process cartridge can be dismounted from the image forming apparatus main assembly.

SUMMARY OF THE INVENTION

A representative structure according to the present application is an image forming apparatus comprising (i) a cartridge; and (ii) a main assembly to which said cartridge is mounted; said main assembly including, (ii-i) a drive output member configured to transmit a driving force to said cartridge, said drive output member being movable between an advanced position advanced toward said cartridge and a retracted position retracted from the advanced position, and (ii-ii) an inclination imparting portion for inclining said drive output member with movement of said drive output member from the advanced position to the retracted position.

Further features of the present description will be apparent from the following description of the example with reference to the mounted drawings.

BRIEF DESCRIPTION OF THE DRAWINGS

Parts (a) and (b) of FIG. 1 are illustrations of a drive transmission portion of a process cartridge according to an Embodiment 1.

Figure 6:
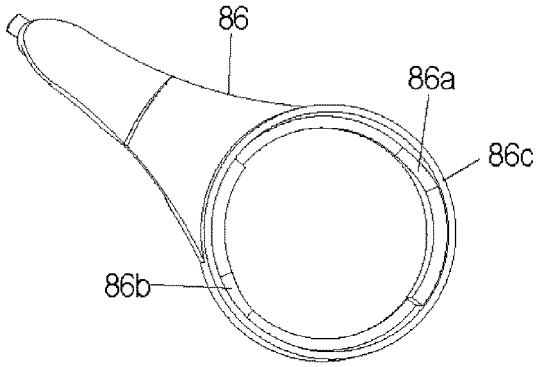
Figure 6:
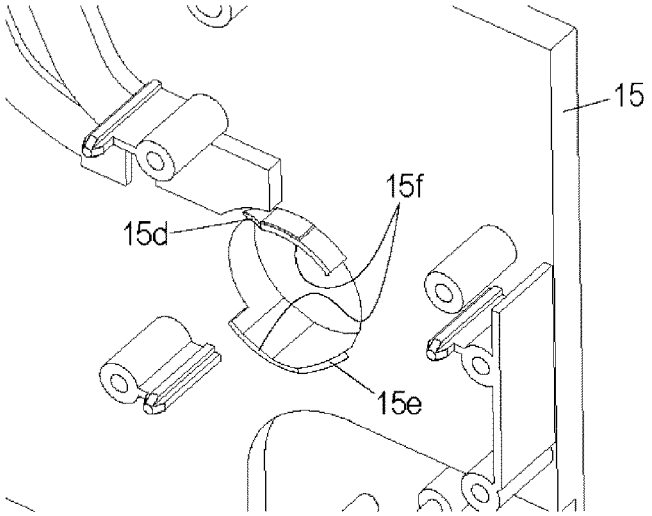
Figure 6:
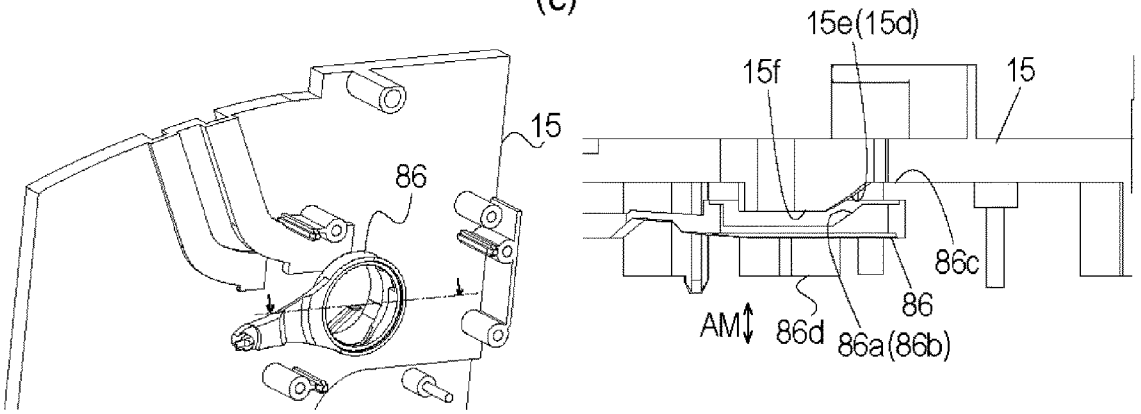

Parts (a), (b) and (c) of FIG. 6 are illustrations of a link portion of the electrophotographic image forming apparatus according to Embodiment 1.

Figure 7:
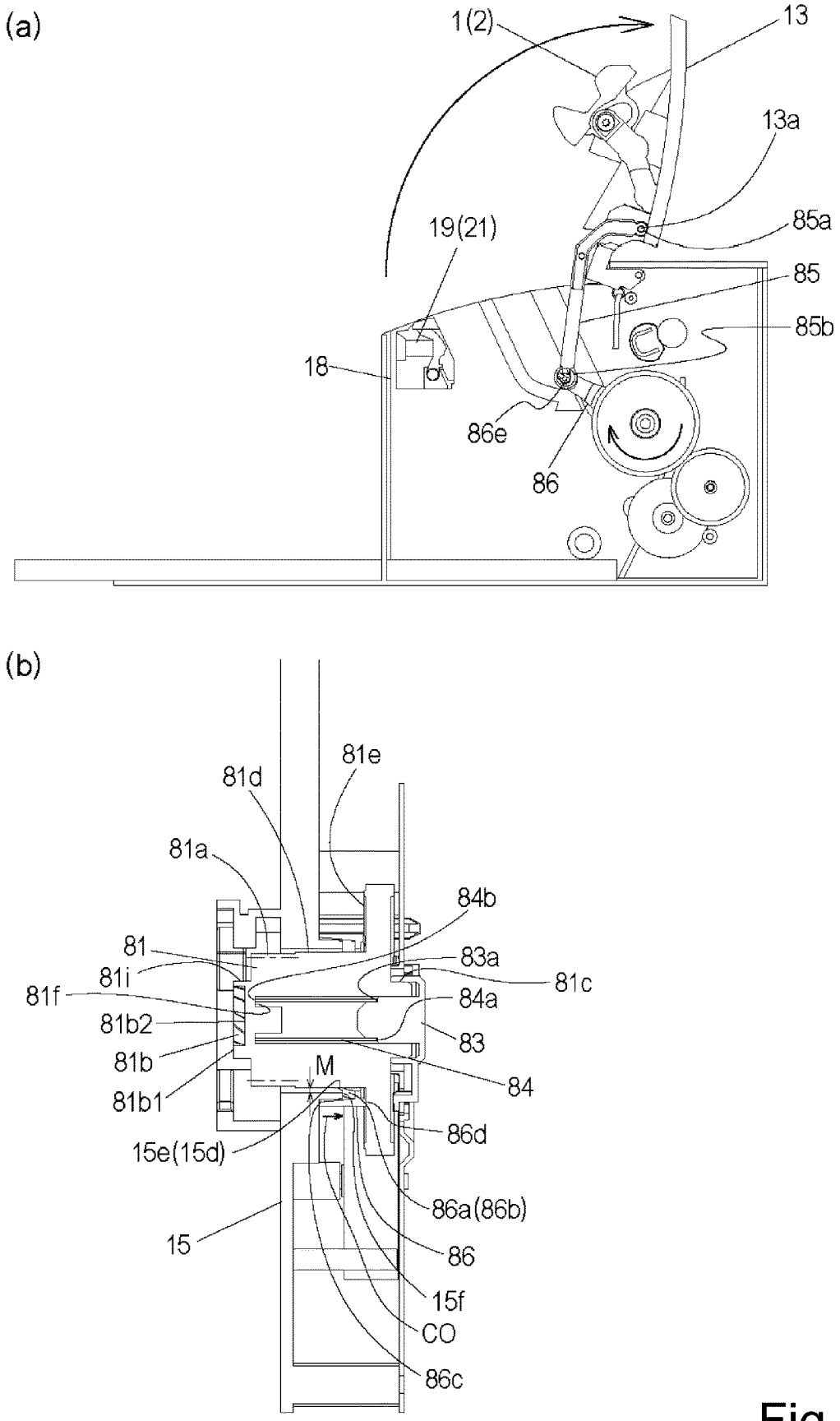

Parts (a) and (b) of FIG. 7 is an illustration of a link portion of the electrophotographic image forming apparatus according to Embodiment 1.

Figure 8:
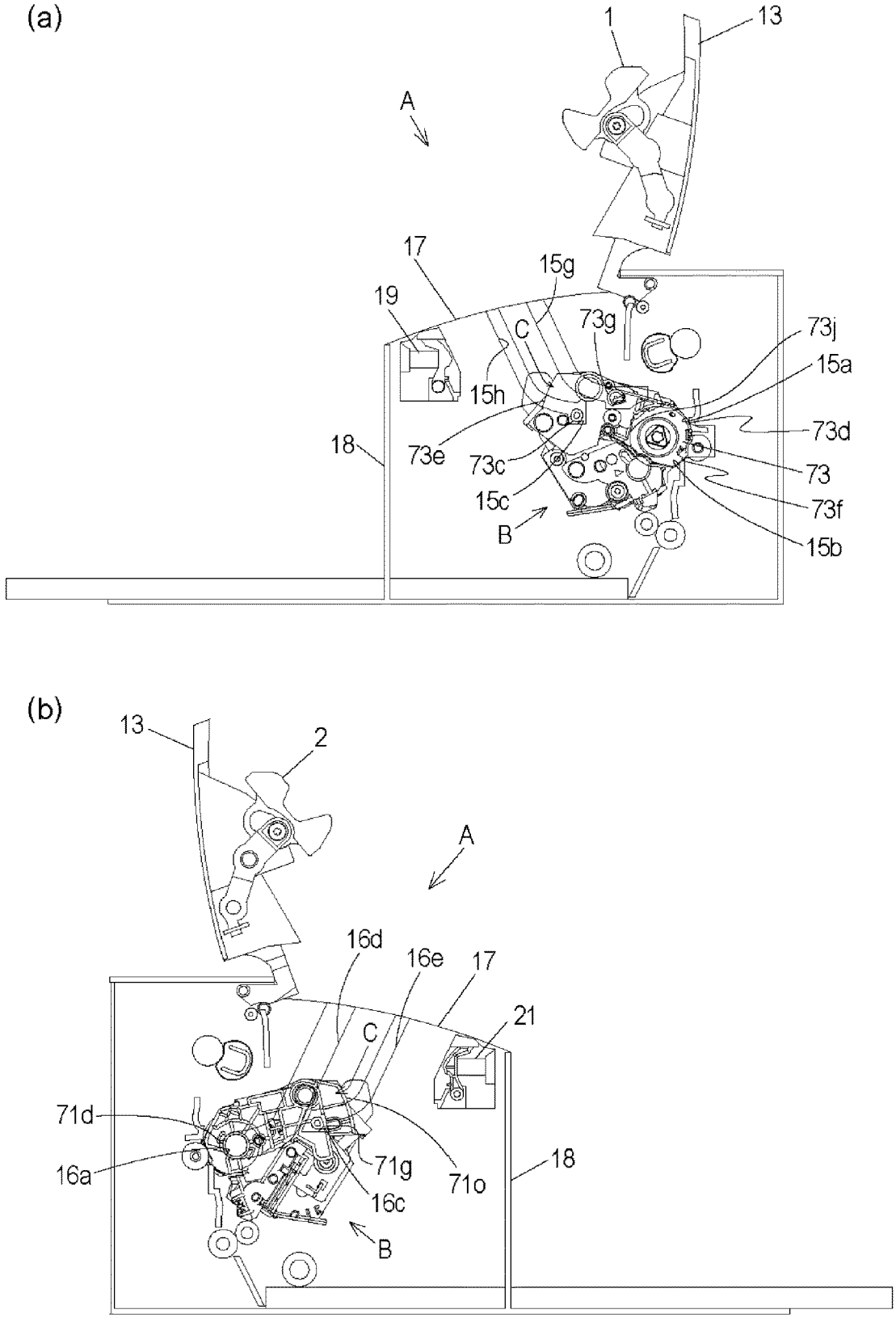

Parts (a) and (b) of FIG. 8 is a cross-sectional view of a guide portion of the electrophotographic image forming apparatus according to Embodiment 1.

Figure 9:
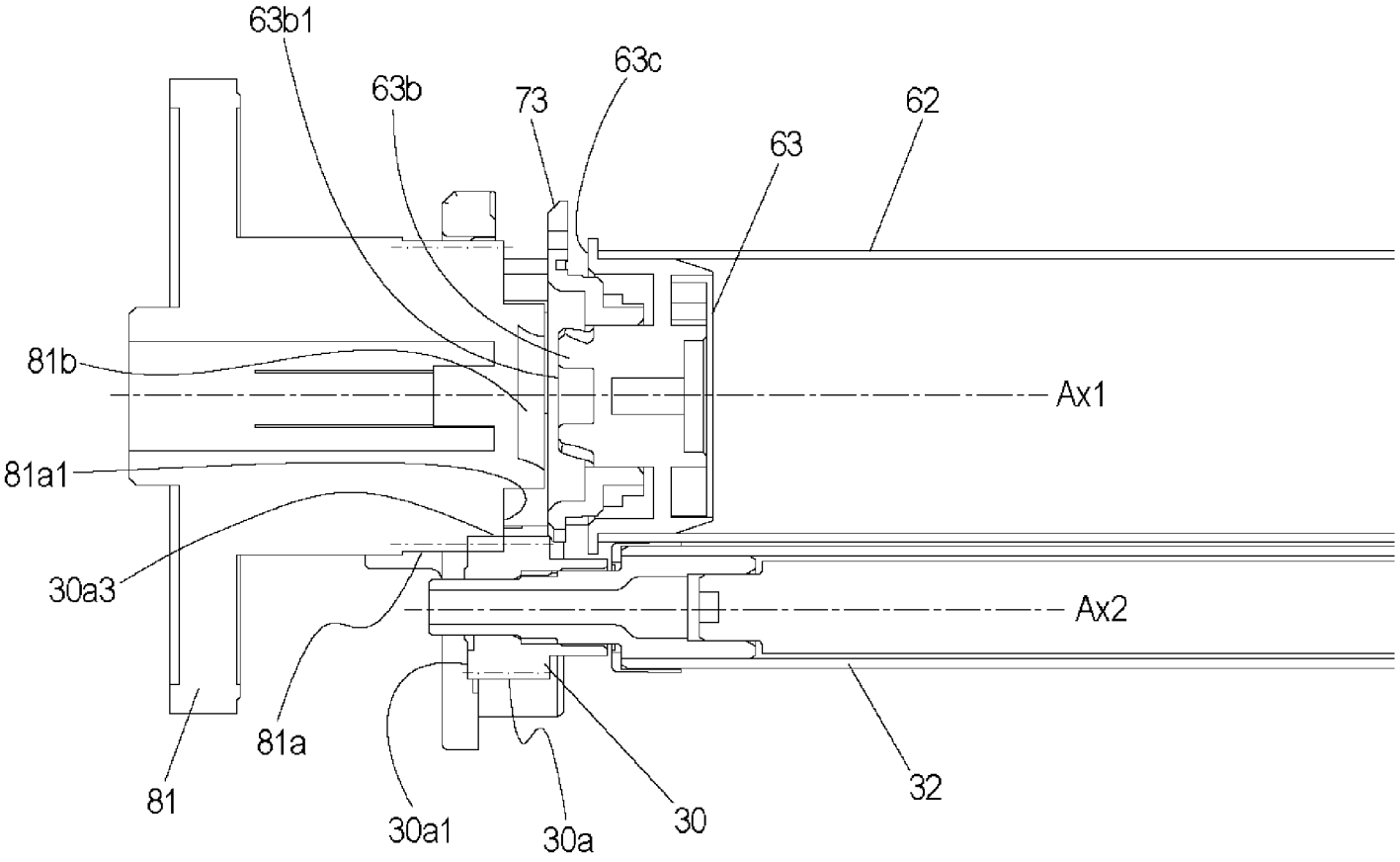

FIG. 9 are illustrations of a driving train portion of the electrophotographic image forming apparatus according to Embodiment 1.

Figure 10:
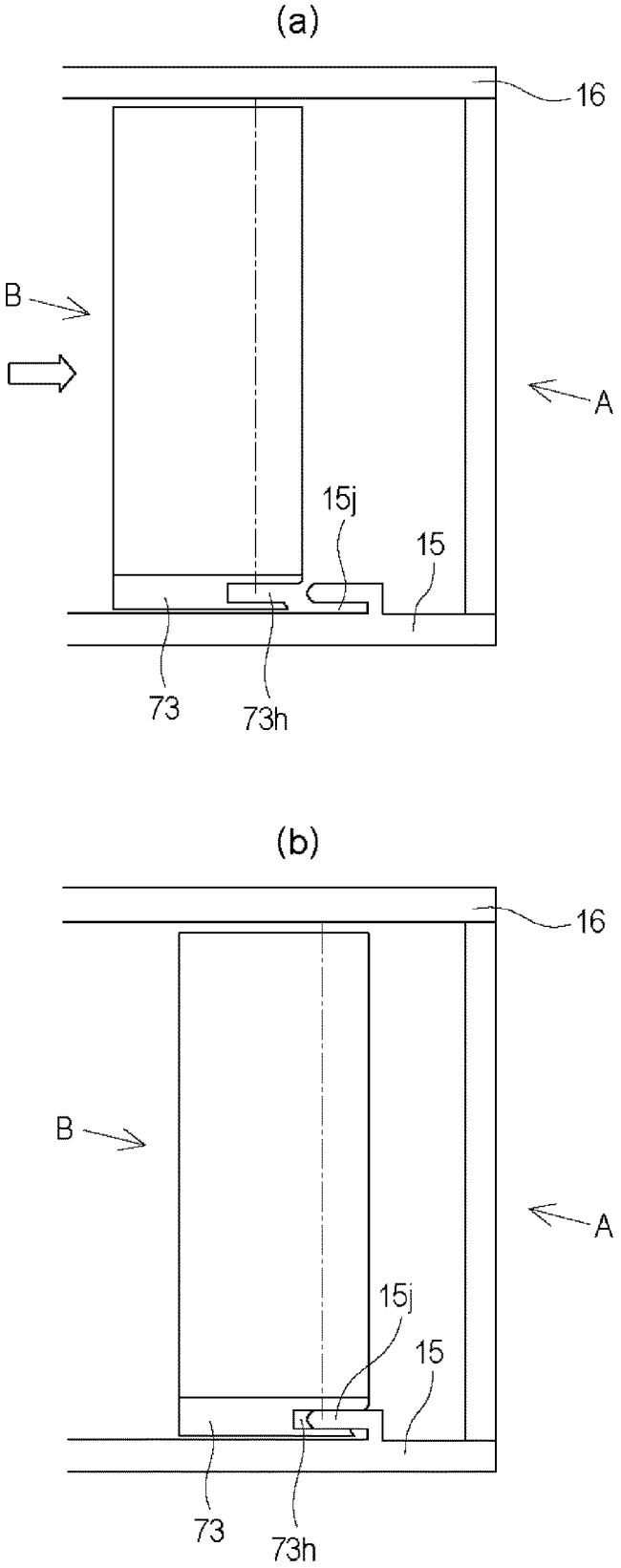

Parts (a) and (b) of FIG. 10 are illustrations of a positioning portion, for the longitudinal direction, of the electrophotographic image forming apparatus according to Embodiment 1.

Figure 11:
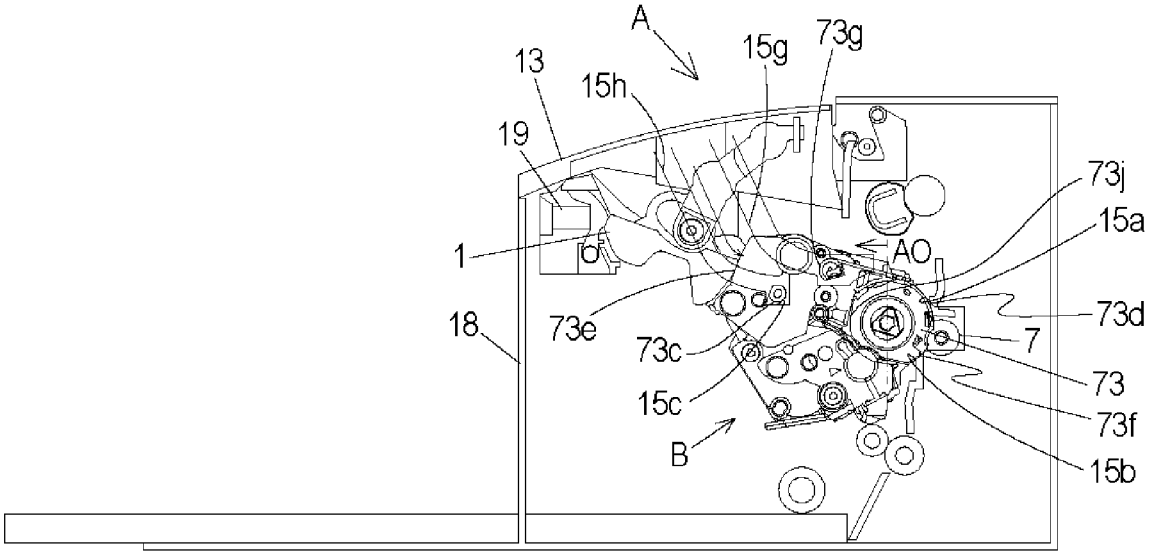
Figure 11:
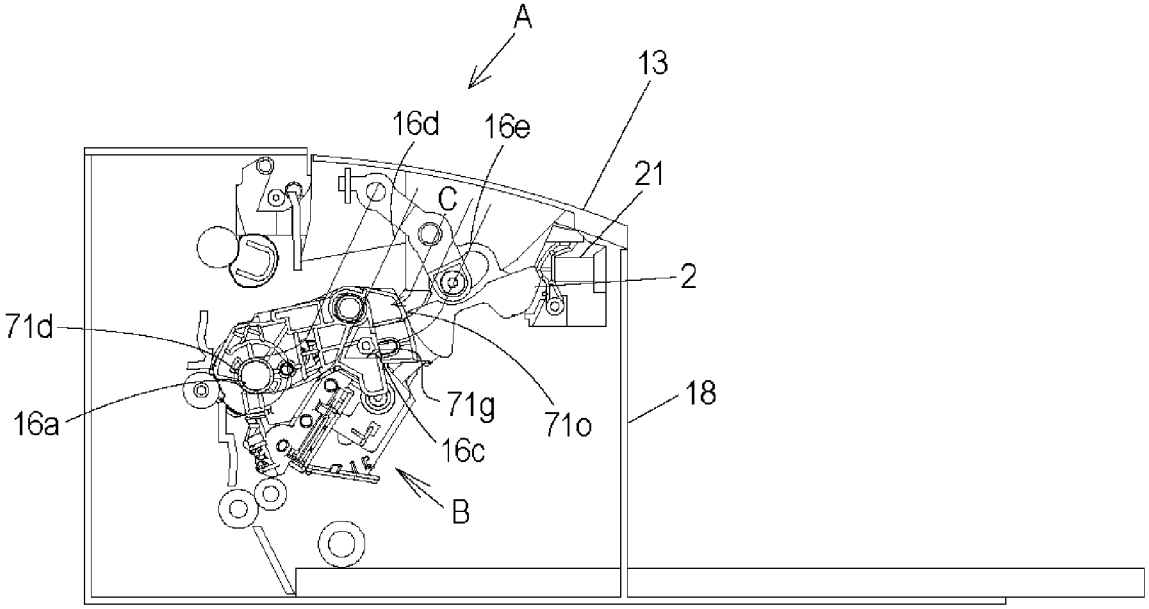

Parts (a) and (b) of FIG. 11 are cross-sectional views of the positioning portion of the electrophotographic image forming apparatus according to Embodiment 1.

Figure 12:
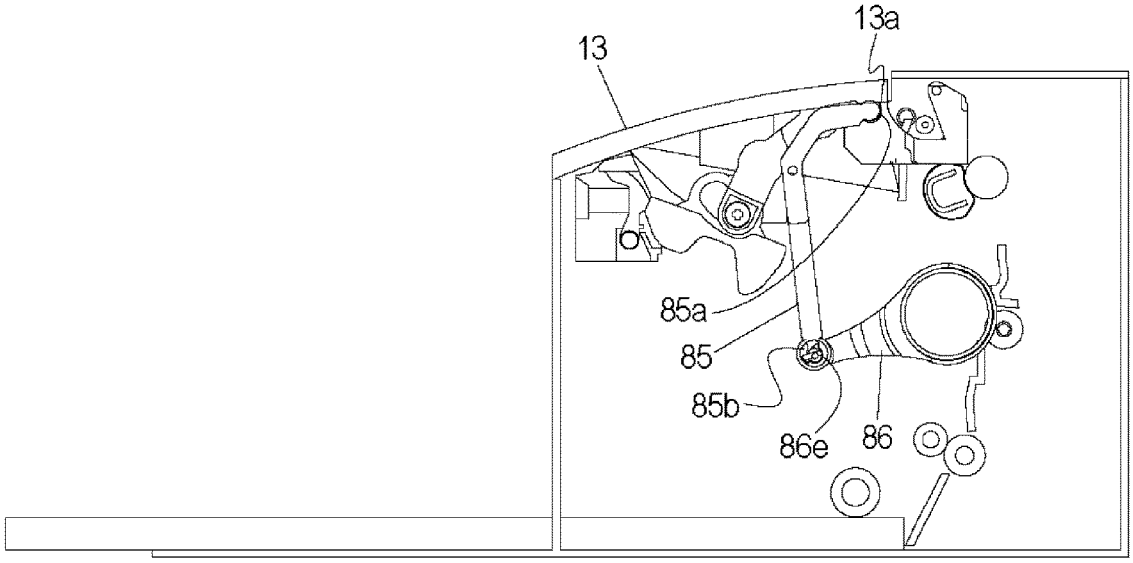
Figure 12:
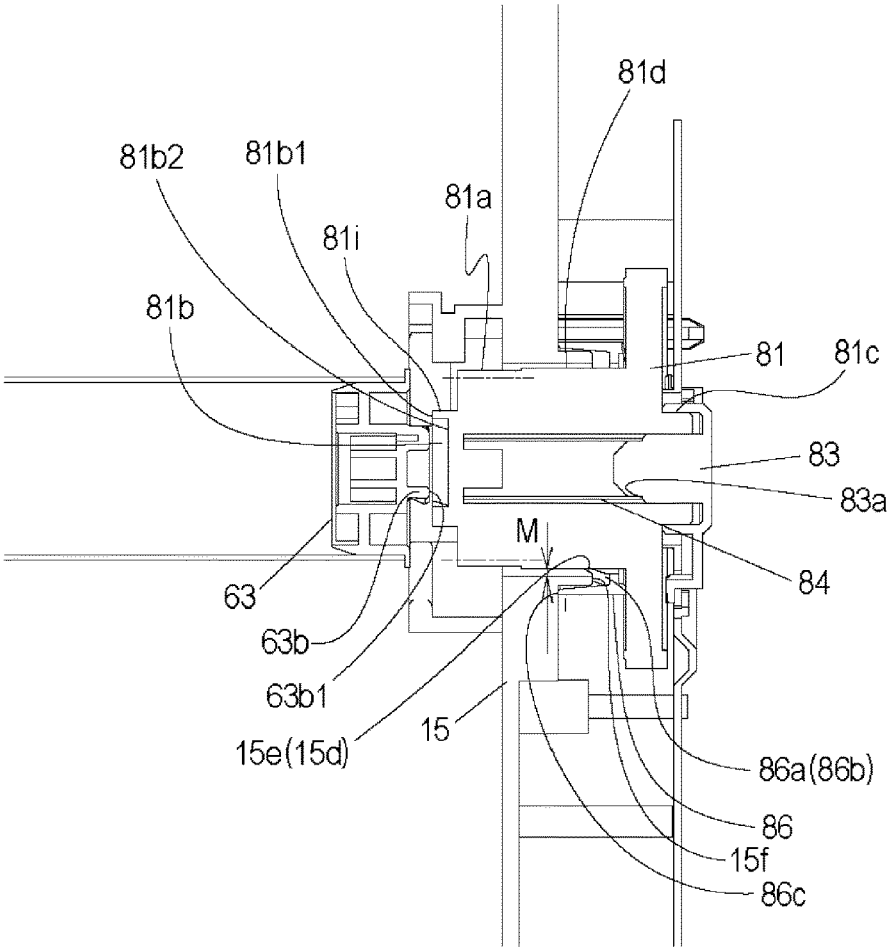

Parts (a) and (b) of FIG. 12 are cross-sectional views of the drive transmission portion of the electrophotographic image forming apparatus according to Embodiment 1.

Figure 13:
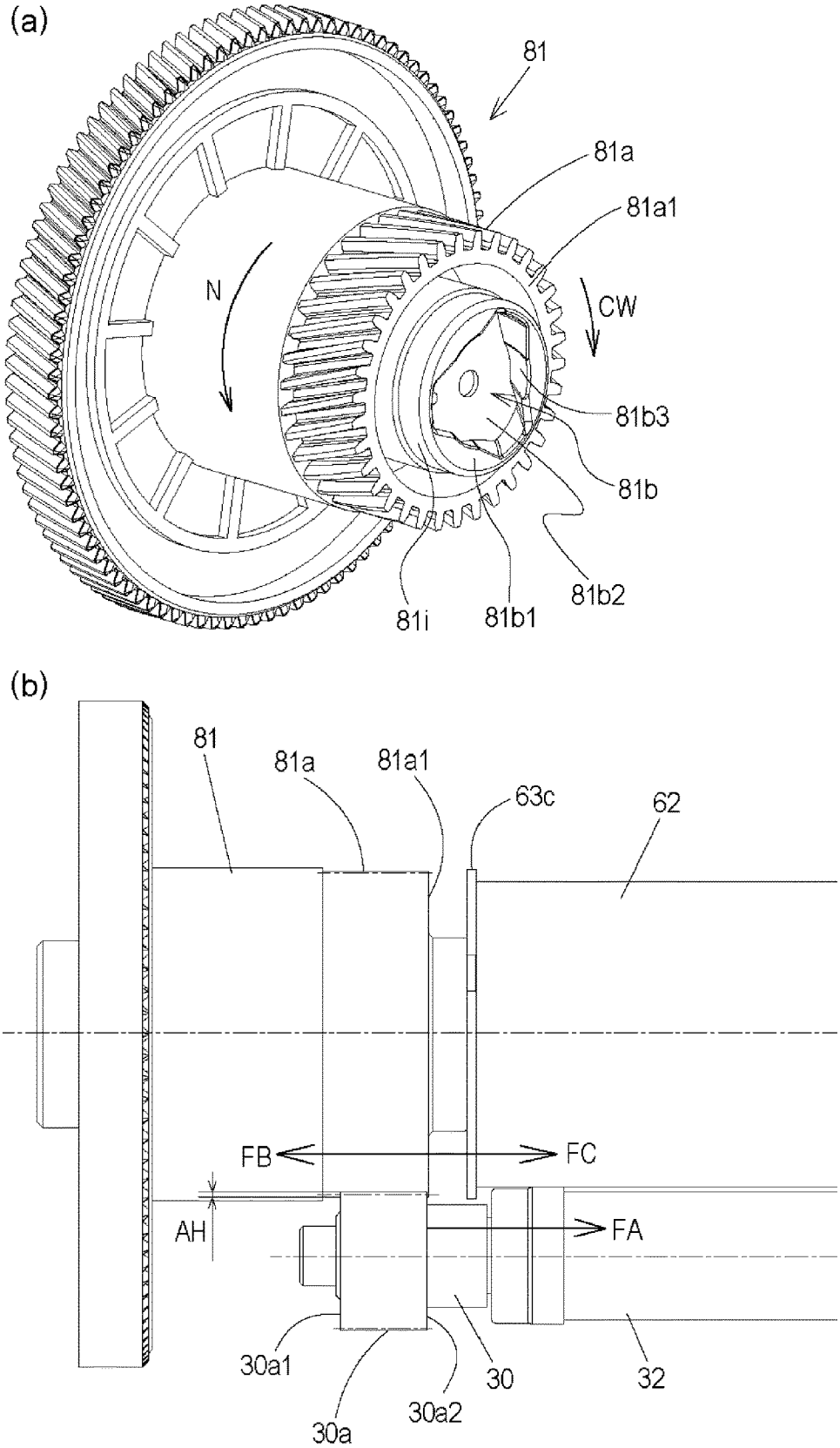

Parts (a) and (b) of FIG. 13 are a perspective view and a side views of the drive transmission portion of the electrophotographic image forming apparatus according to Embodiment 1.

Figure 14:
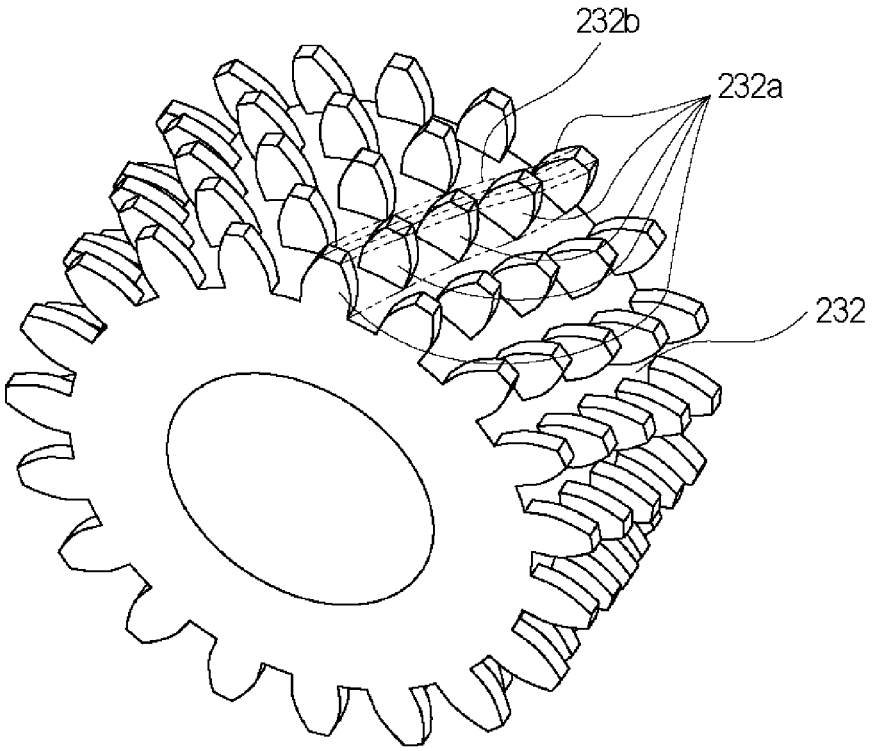

FIG. 14 is a perspective view of a developing roller gear of the electrophotographic image forming apparatus according to Embodiment 1.

Figure 15:
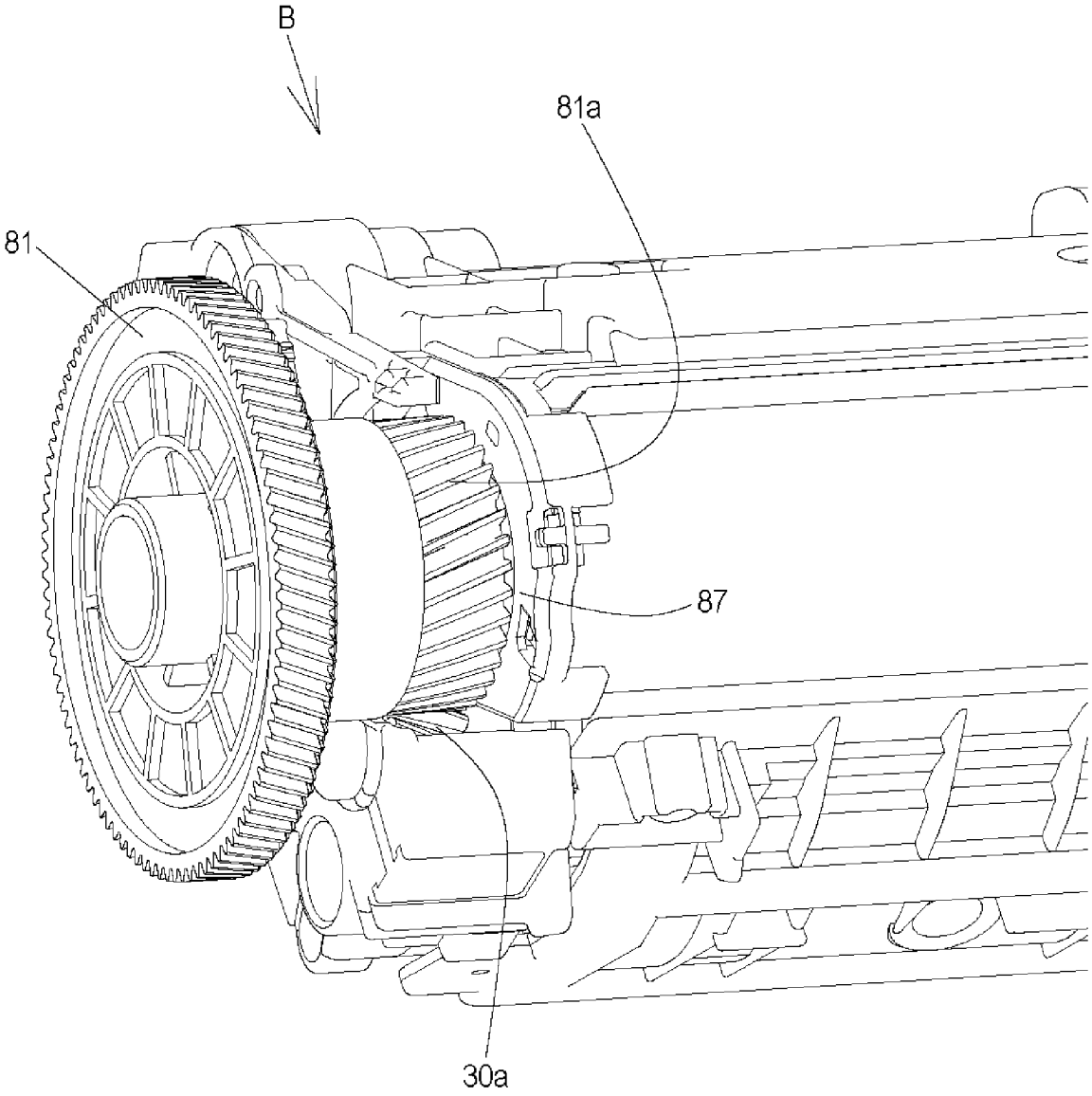

FIG. 15 is a perspective view of the drive transmission portion of the electrophotographic image forming apparatus according to Embodiment 1.

Figure 16:
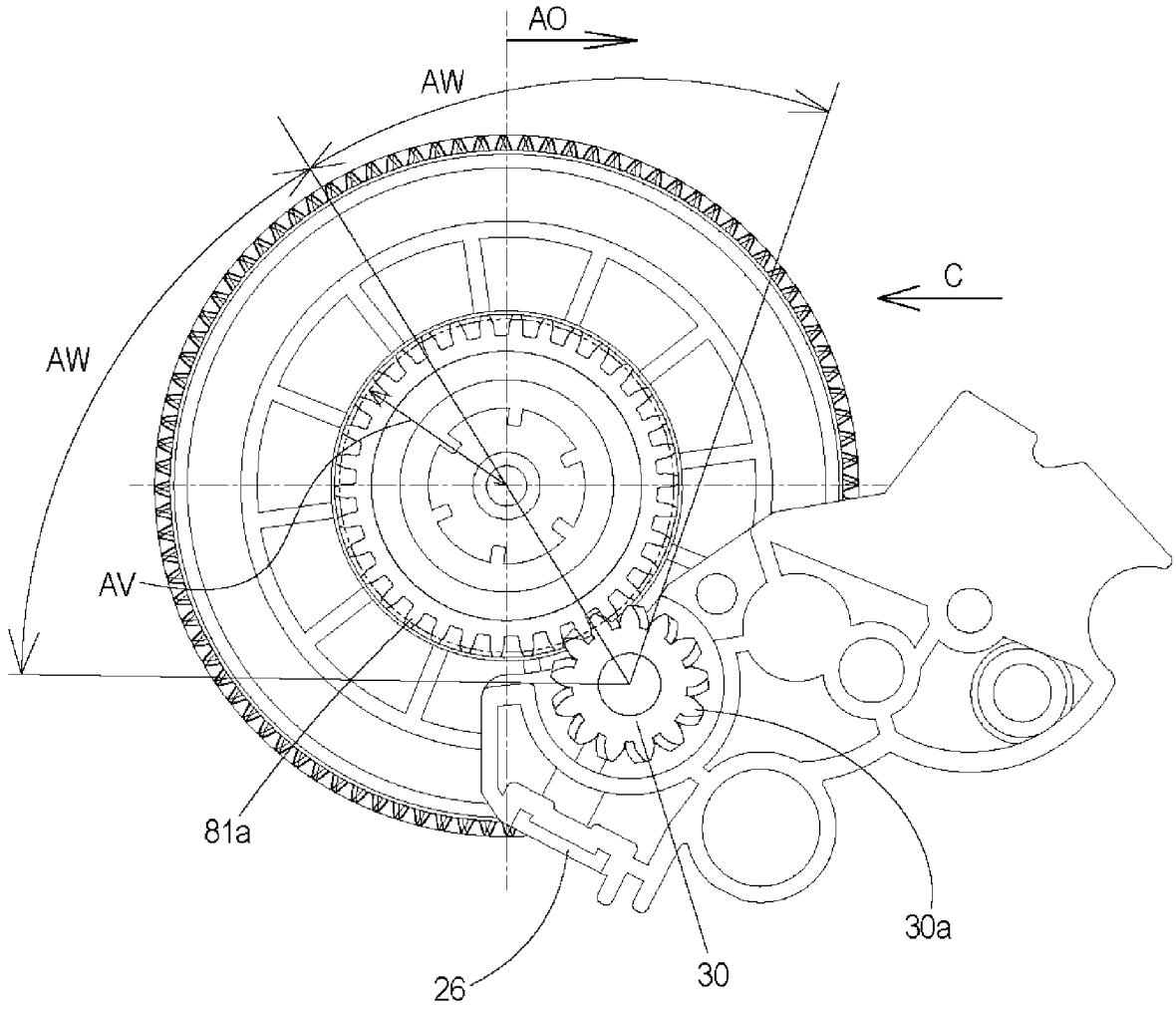

FIG. 16 is a cross-sectional view of the drive transmission portion of the electrophotographic image forming apparatus according to Embodiment 1.

Figure 17:
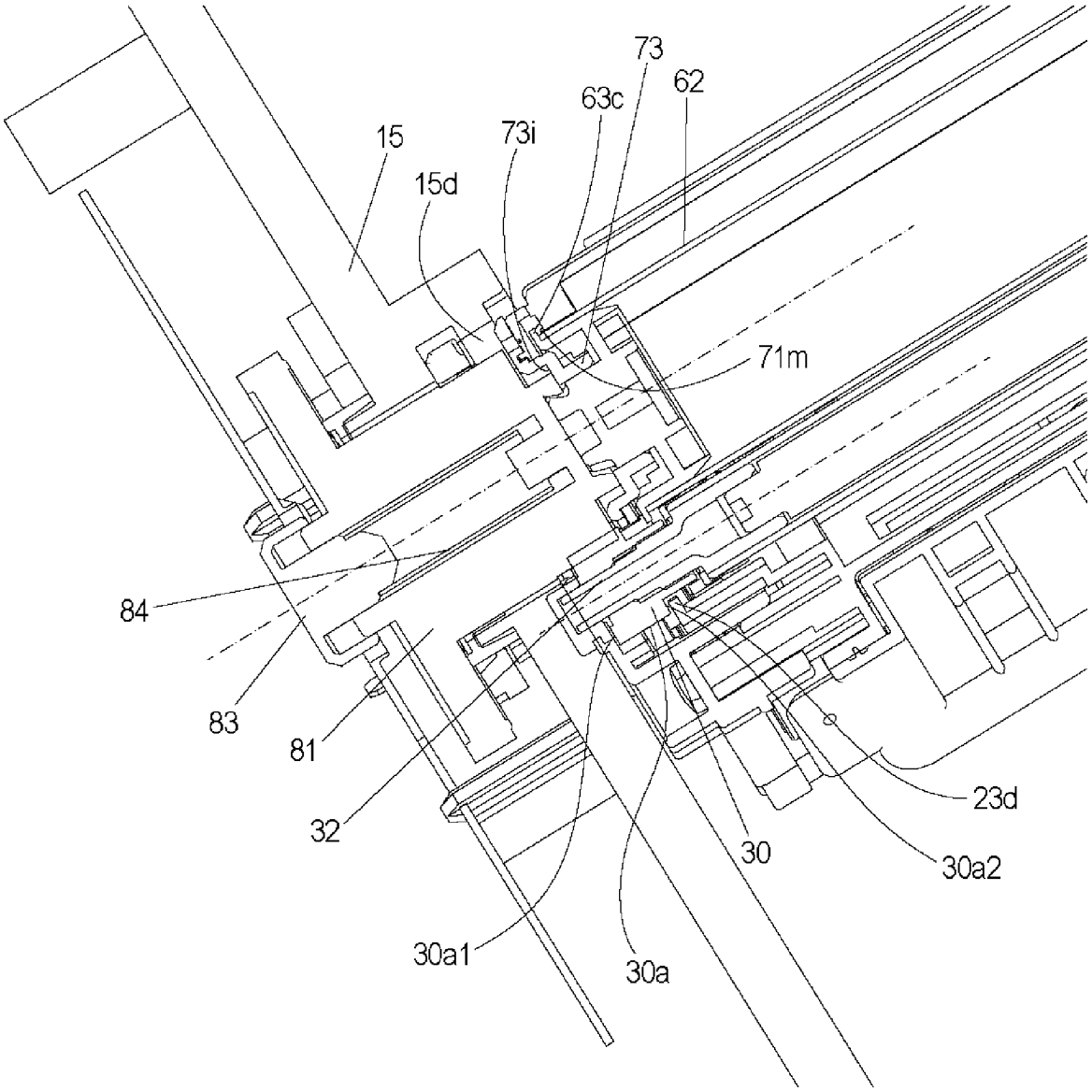

FIG. 17 is a cross-sectional view of the drive transmission portion of the electrophotographic image forming apparatus according to Embodiment 1.

Figure 18:
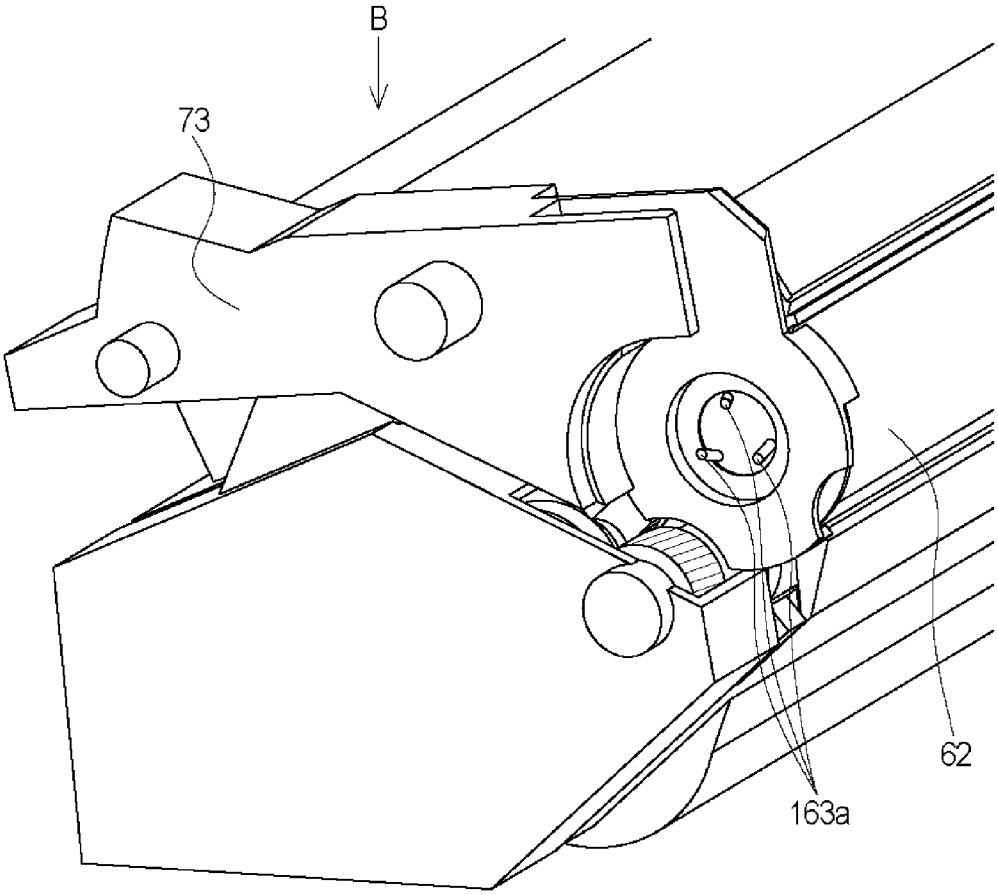

FIG. 18 is a perspective view of the drive transmission portion of the process cartridge according to Embodiment 1.

Figure 19:
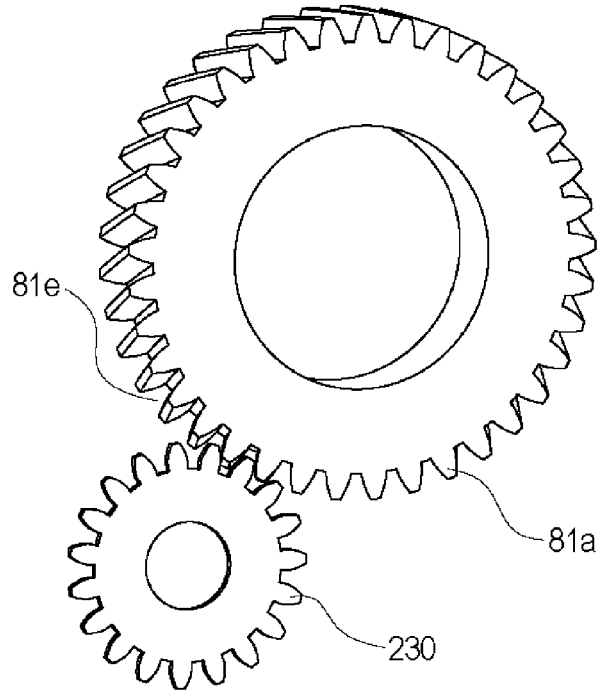
Figure 19:
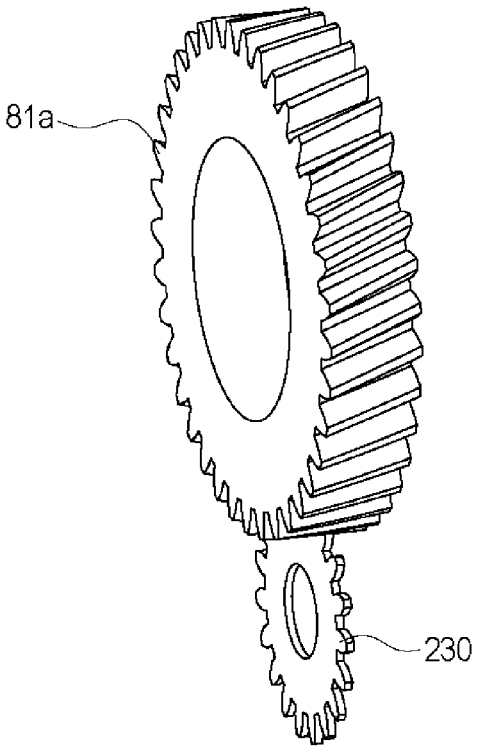

Parts (a) and (b) of FIG. 19 are perspective views of the developing roller gear of the process cartridge according to Embodiment 1.

Figure 20:
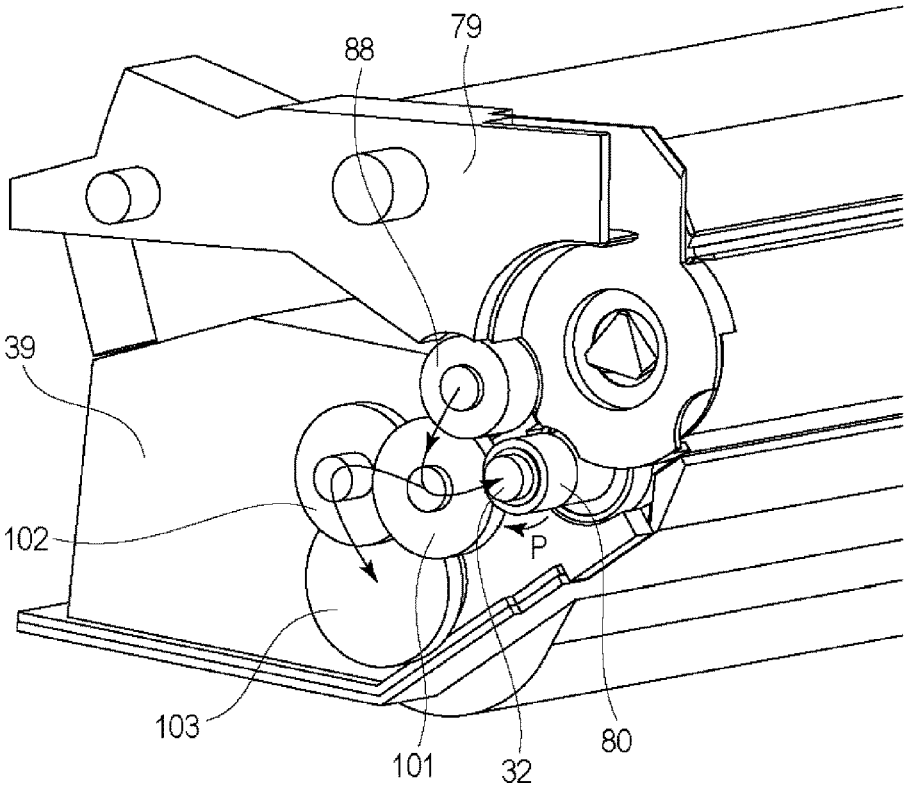

FIG. 20 is an illustration of the drive train of the process cartridge according to Embodiment 1.

Figure 21:
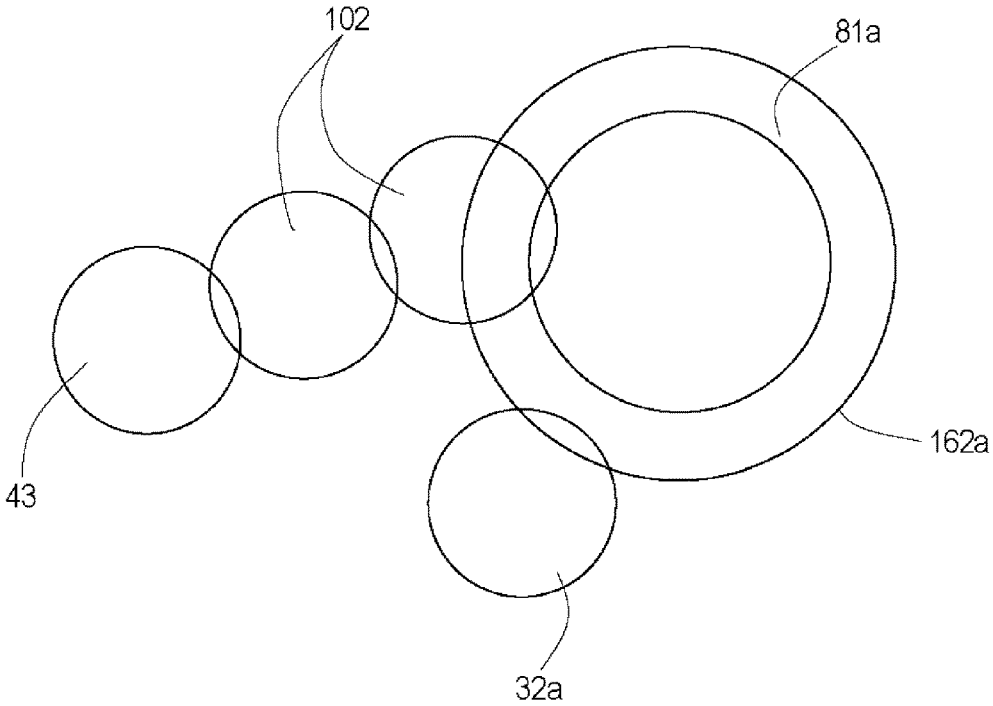

FIG. 21 is an illustration of the drive train of the process cartridge according to Embodiment 1.

Figure 22:
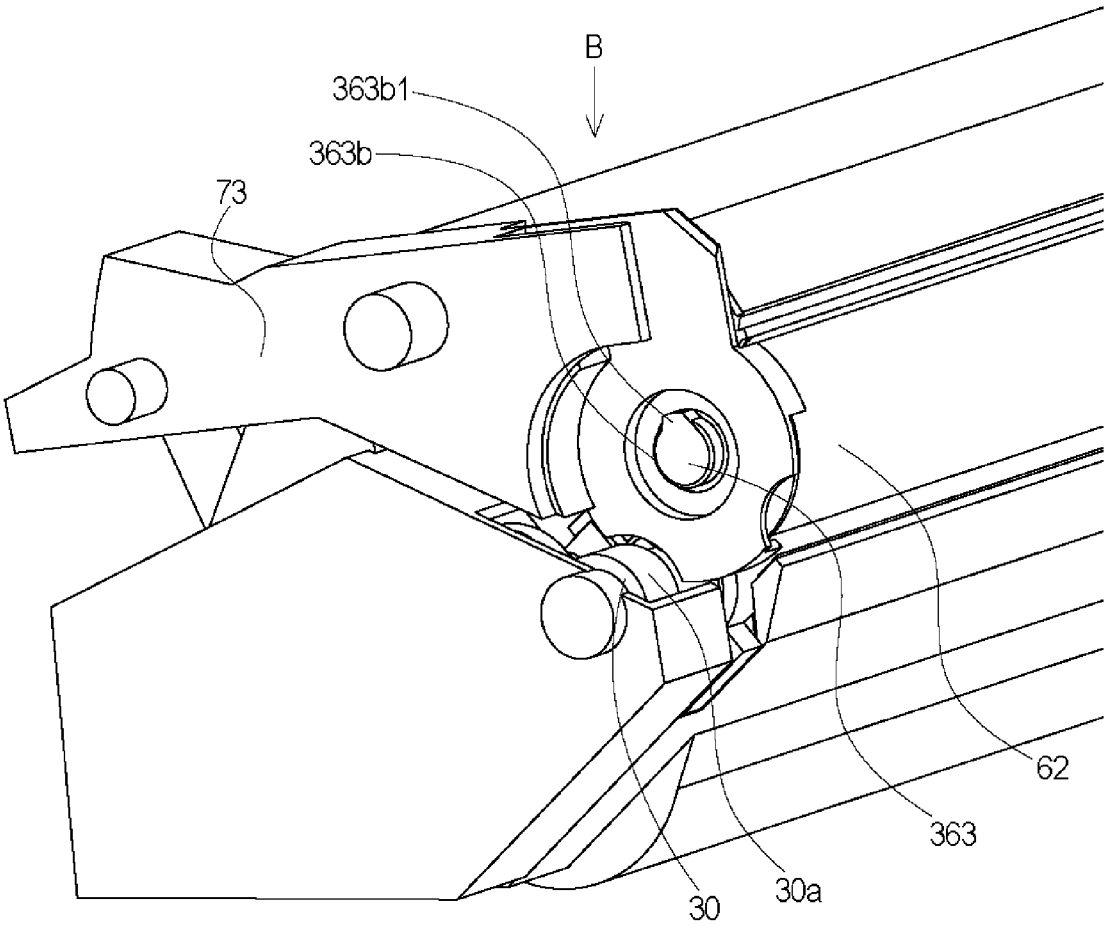
Figure 22:
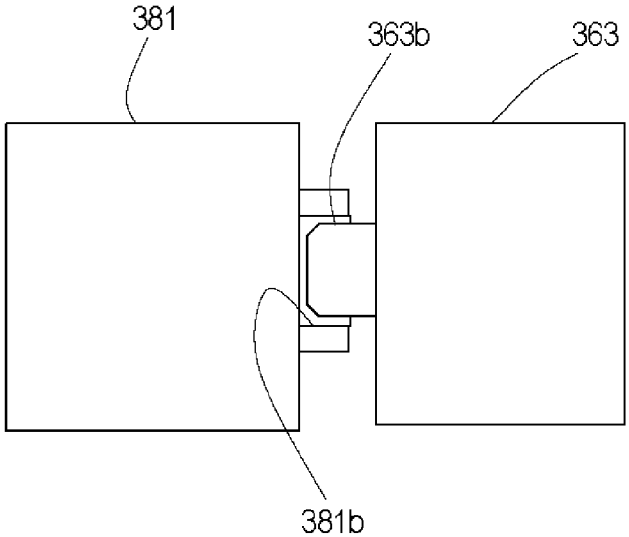

FIG. 22 is an illustration of the drive transmission portion of the electrophotographic image forming apparatus according to Embodiment 1.

Figure 23:
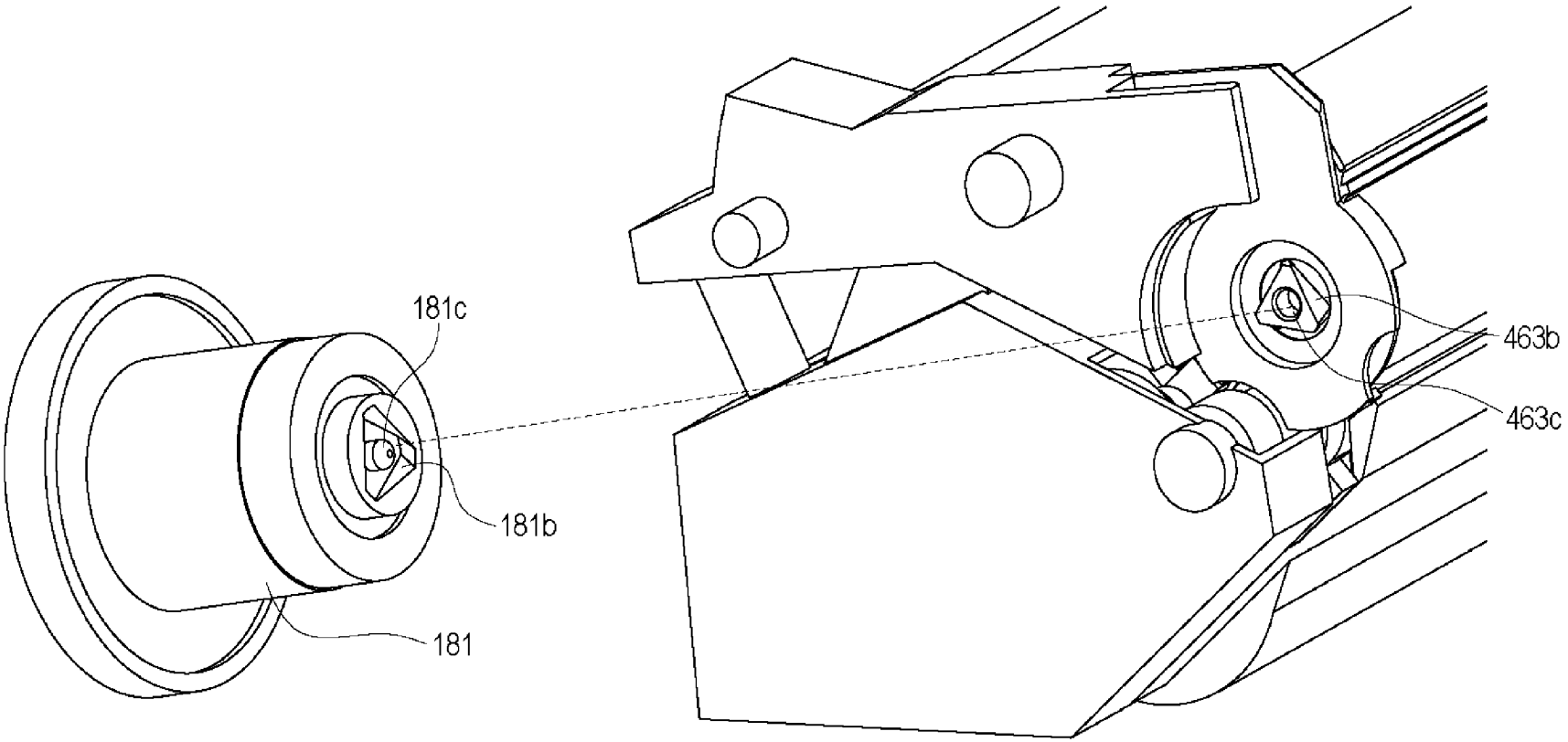

FIG. 23 is an illustration of the drive transmission portion of the electrophotographic image forming apparatus according to Embodiment 1.

Figure 24:
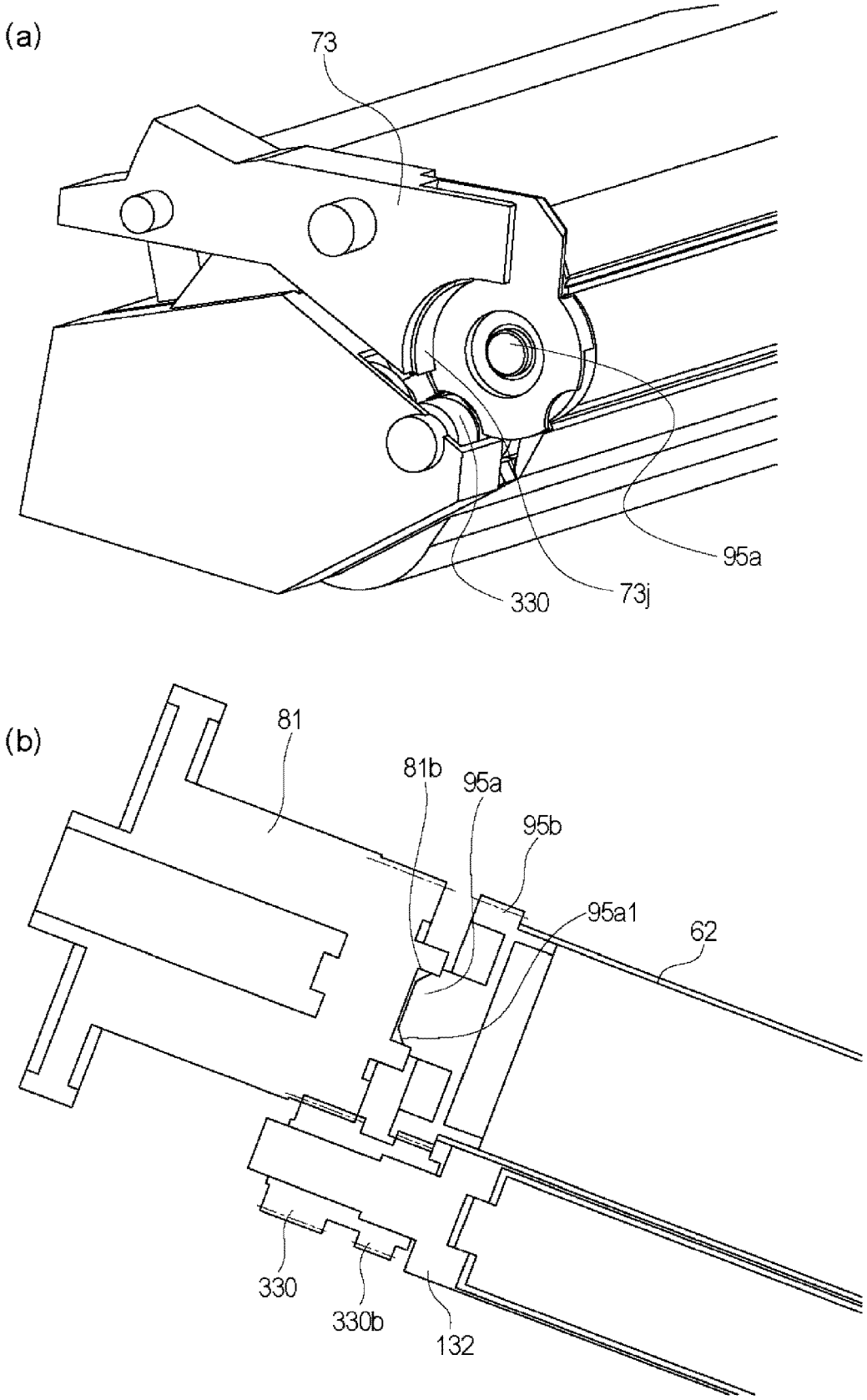

Parts (a) and (b) of FIG. 24 are illustrations of the drive transmission portion of the electrophotographic image forming apparatus according to Embodiment 1.

Figure 25:
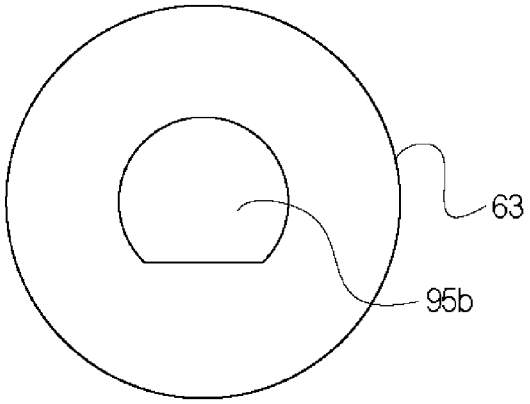

FIG. 25 is an illustration of a drive transmission portion centering portion according to Embodiment 1.

Figure 26:
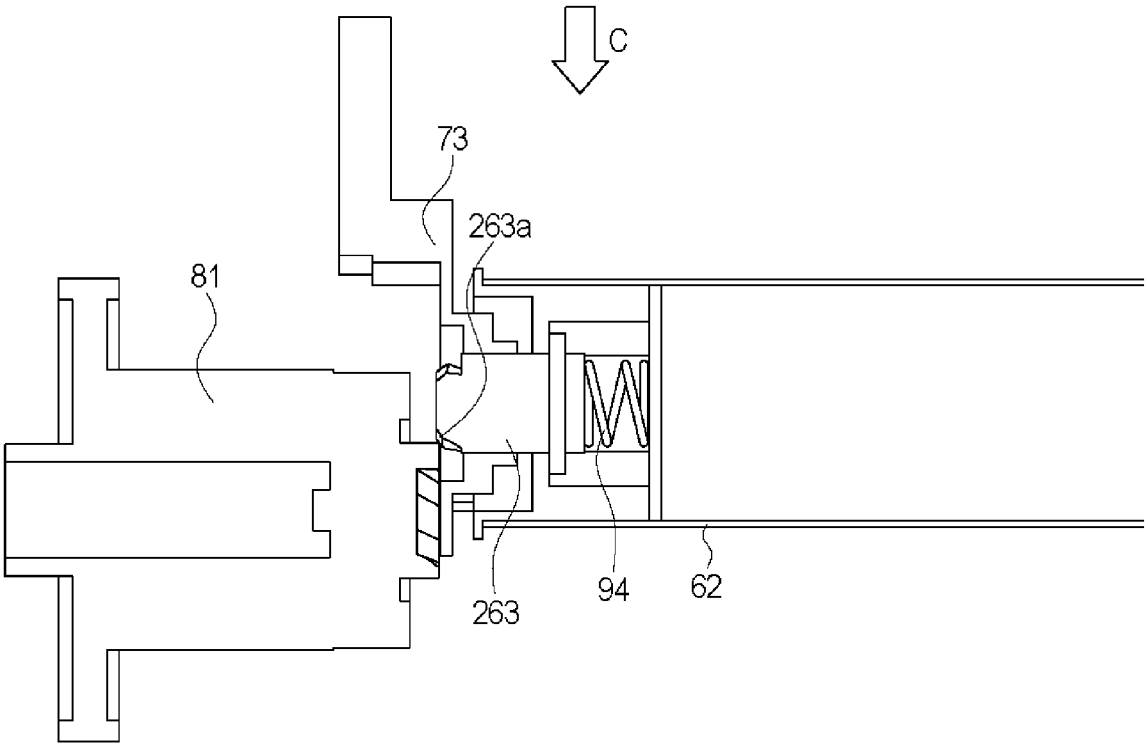

FIG. 26 is a cross-sectional view of the drive transmission portion of the electrophotographic image forming apparatus according to Embodiment 1.

Figure 27:
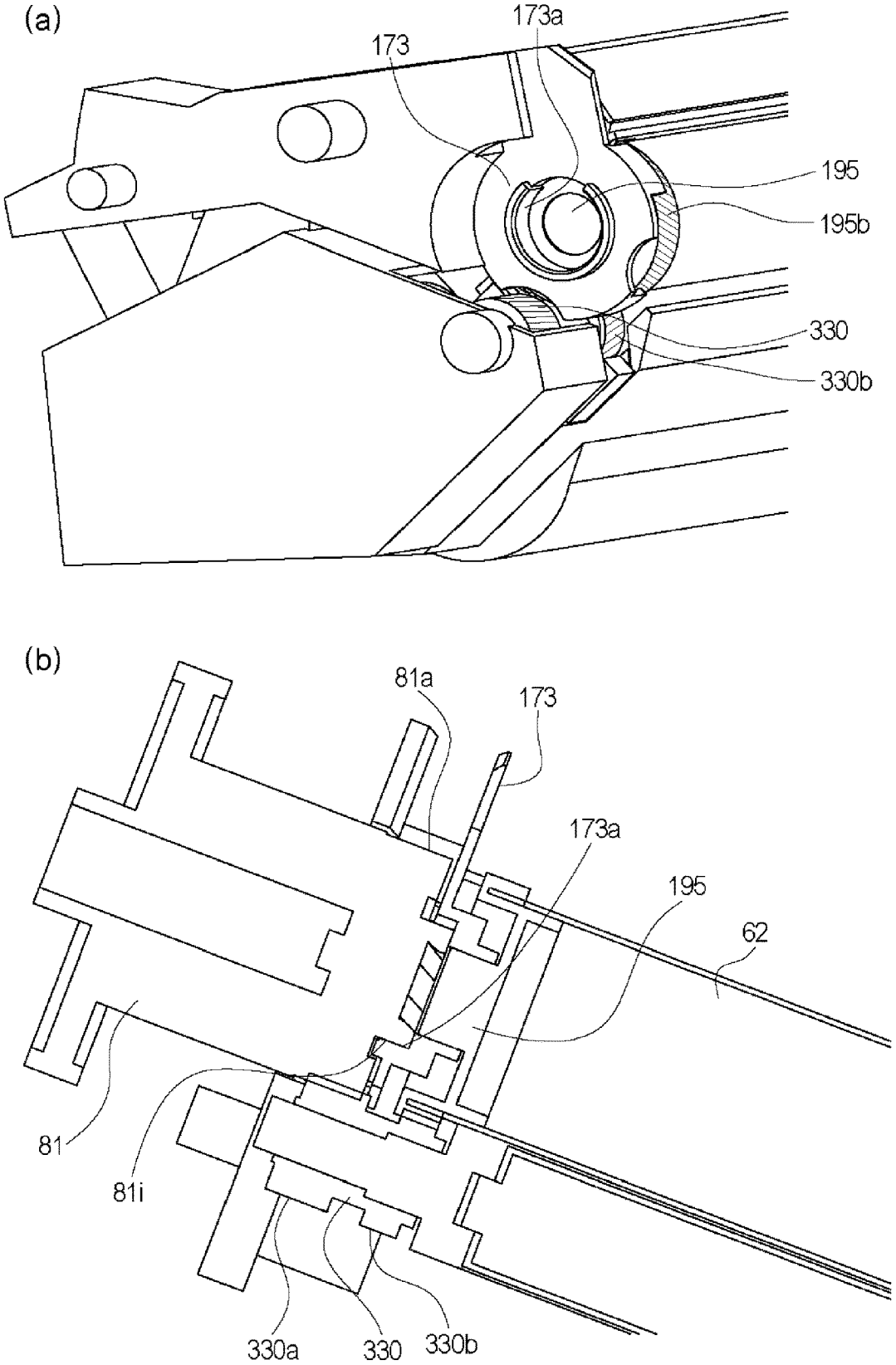

Parts (a) and (b) of FIG. 27 are illustrations of the drive transmission portion of the electrophotographic image forming apparatus according to Embodiment 1.

Figure 28:
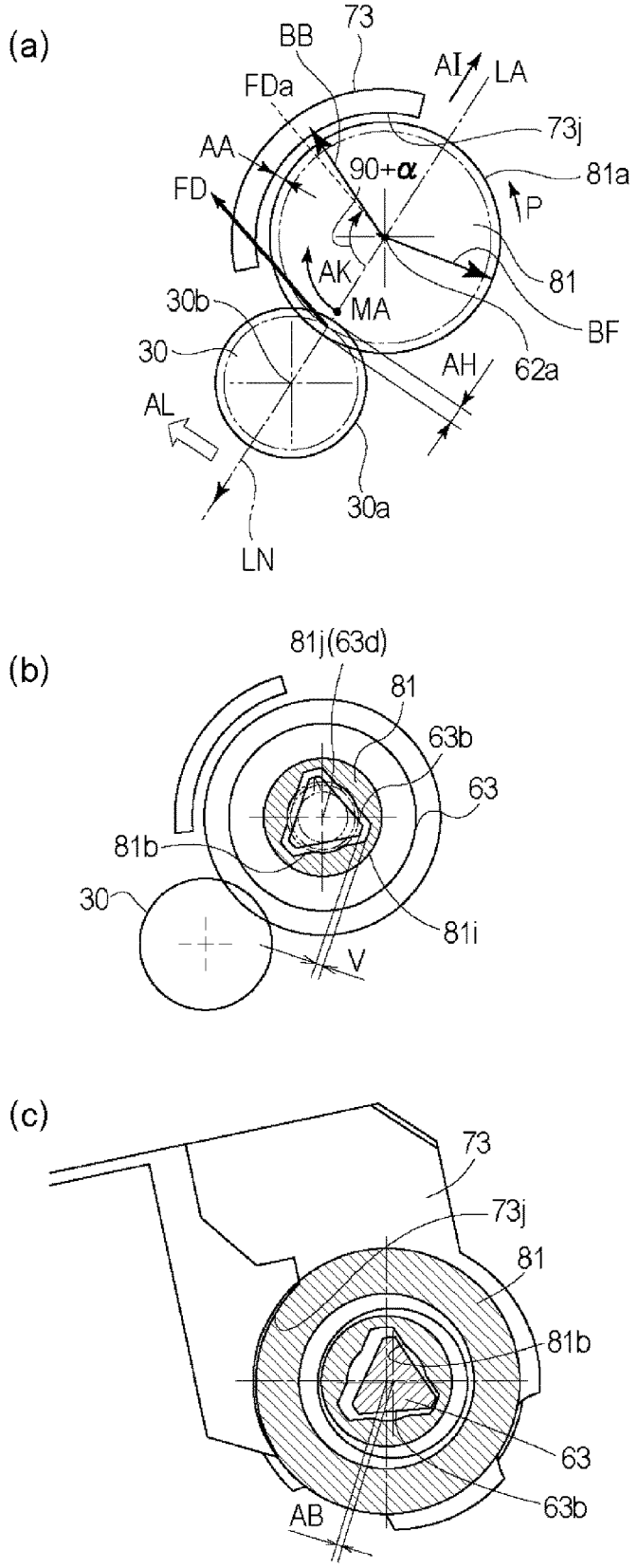

Parts (a), (b) and (c) of FIG. 28 are illustrations of a regulating portion of the electrophotographic image forming apparatus according to Embodiment 1.

Figure 29:
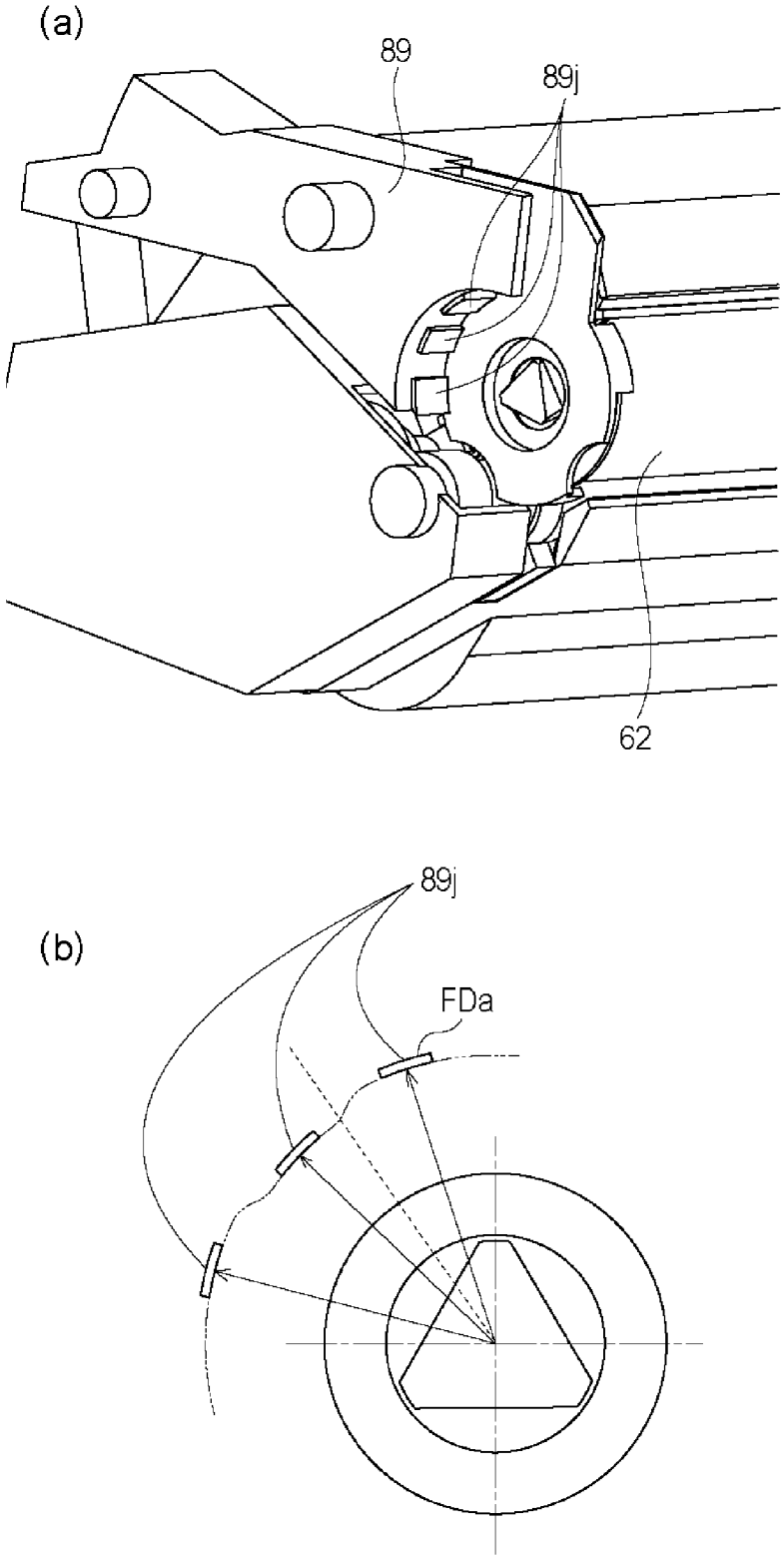

Parts (a) and (b) of FIG. 29 are illustrations of the regulating portion of the electrophotographic image forming apparatus according to Embodiment 1.

Figure 30:
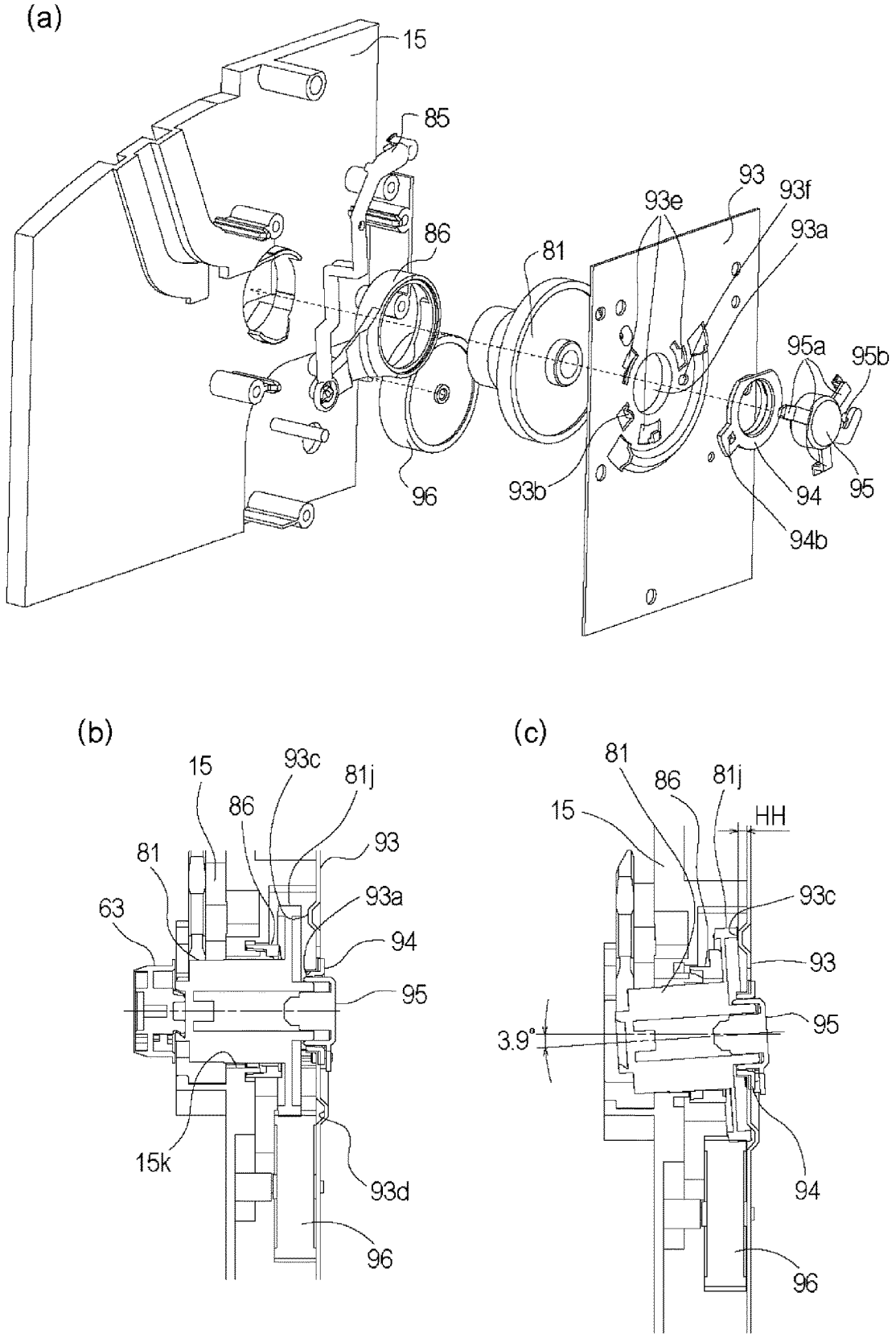

Parts (a), (b) and (c) of FIG. 30 are illustrations of the drive transmission portion of the electrophotographic image forming apparatus according to Embodiment 1.

Figure 31:
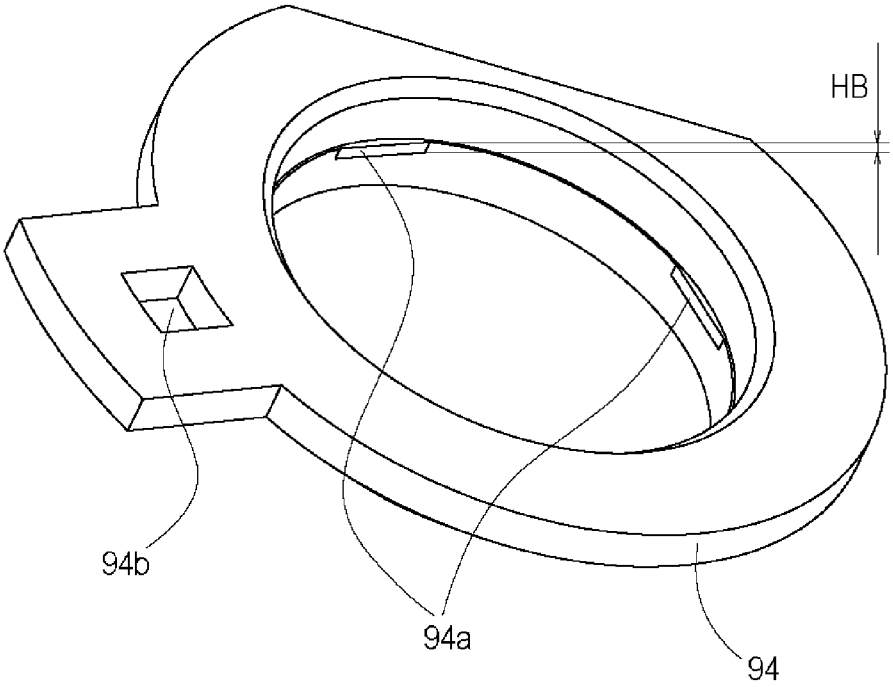

FIG. 31 is a perspective view of a bearing of the electrophotographic image forming apparatus according to Embodiment 1.

Figure 32:
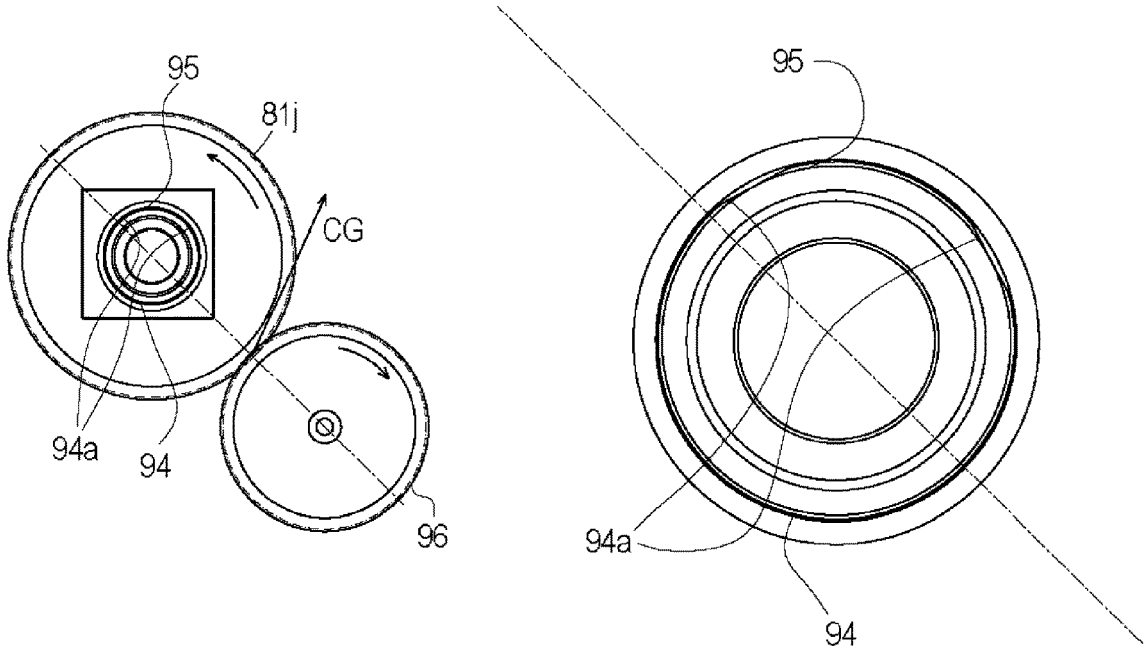
Figure 32:
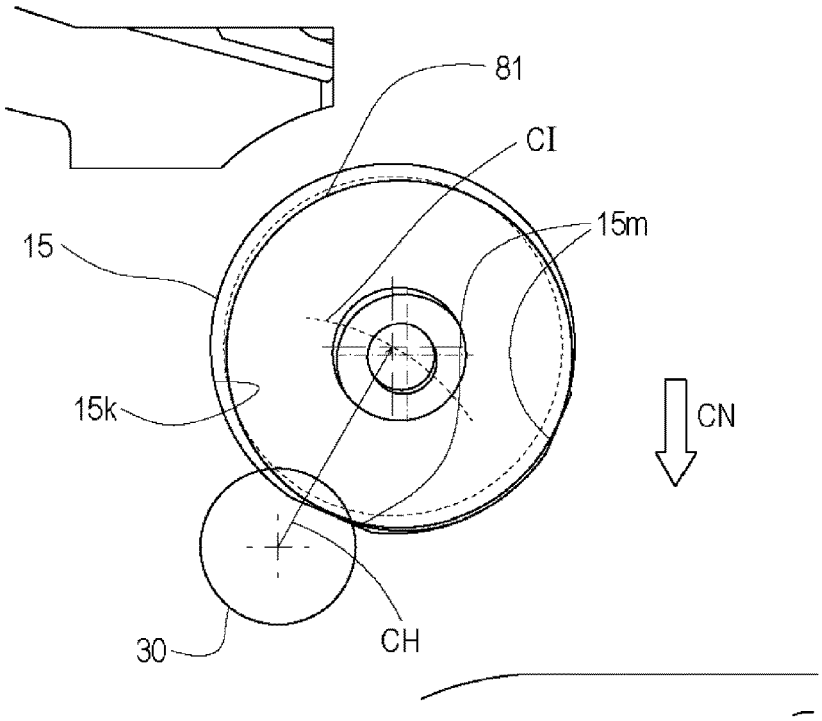

Parts (a) and (b) of FIG. 32 are illustrations of the drive transmission portion of the electrophotographic image forming apparatus according to Embodiment 1.

Figure 33:
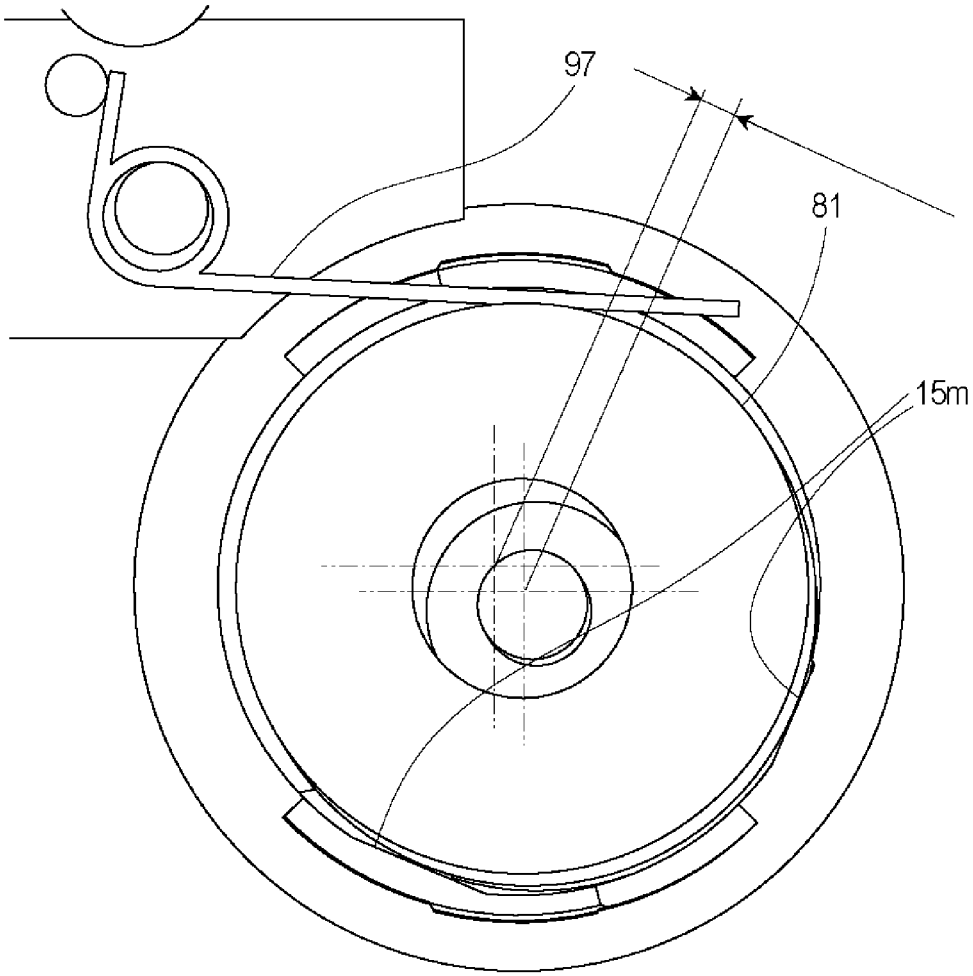

FIG. 33 is an illustration of the drive transmission portion of the electrophotographic image forming apparatus according to Embodiment 1.

Figure 34:
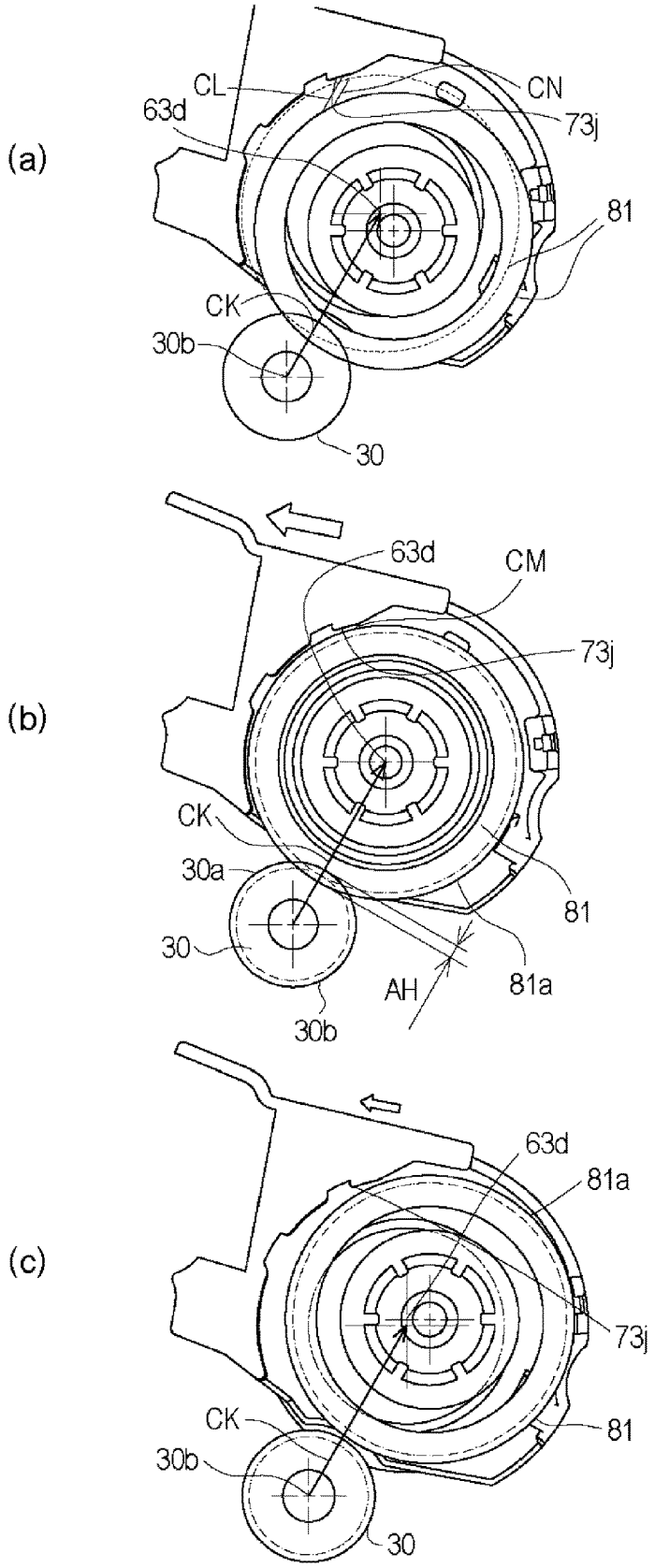

Parts (a), (b) and (c) of FIG. 34 are cross-sectional views of the drive transmission portion of the electrophotographic image forming apparatus according to Embodiment 1.

Figure 35:
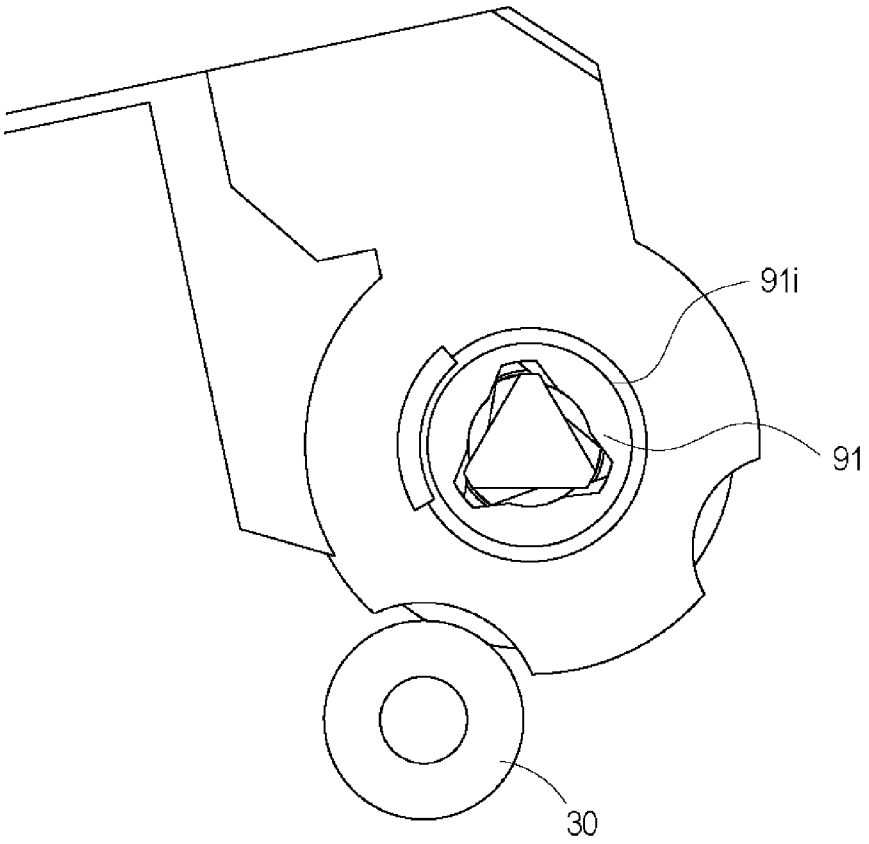

FIG. 35 is an illustration of the regulating portion of the electrophotographic image forming apparatus according to Embodiment 1.

Figure 36:
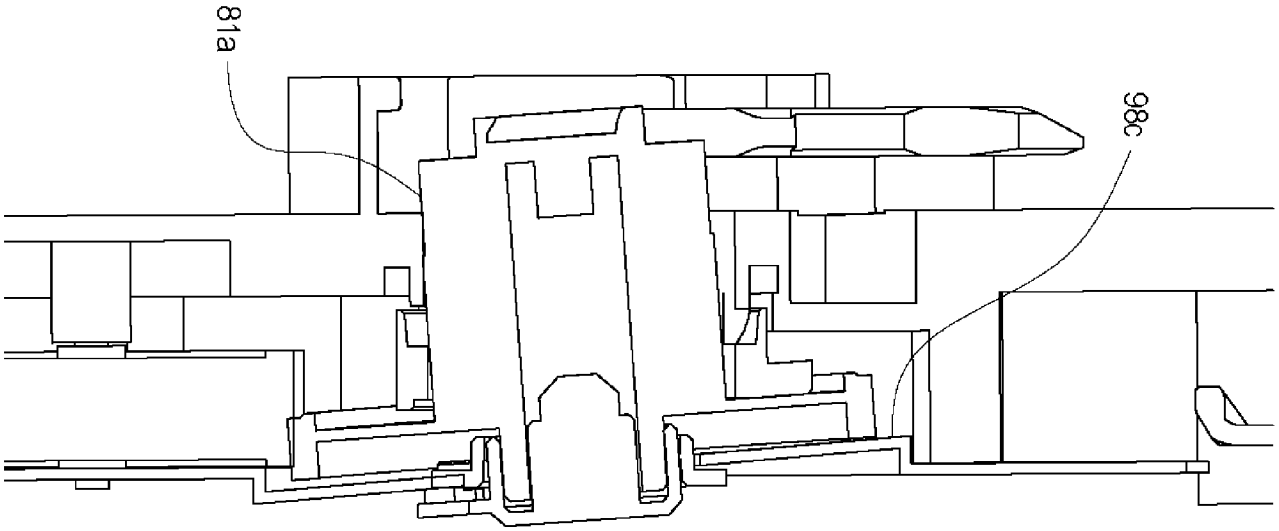

FIG. 36 is a perspective view illustrating a modification of Embodiment 1.

Figure 37:
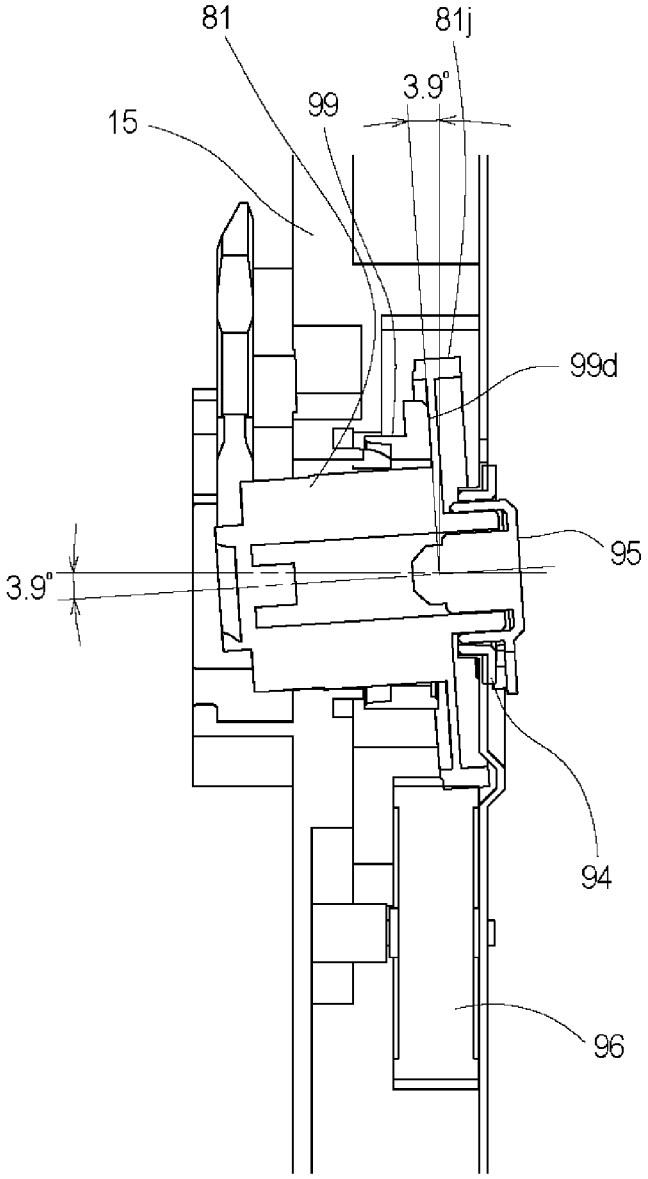

FIG. 37 is a perspective view illustrating the modification of Embodiment 1.

Figure 38:
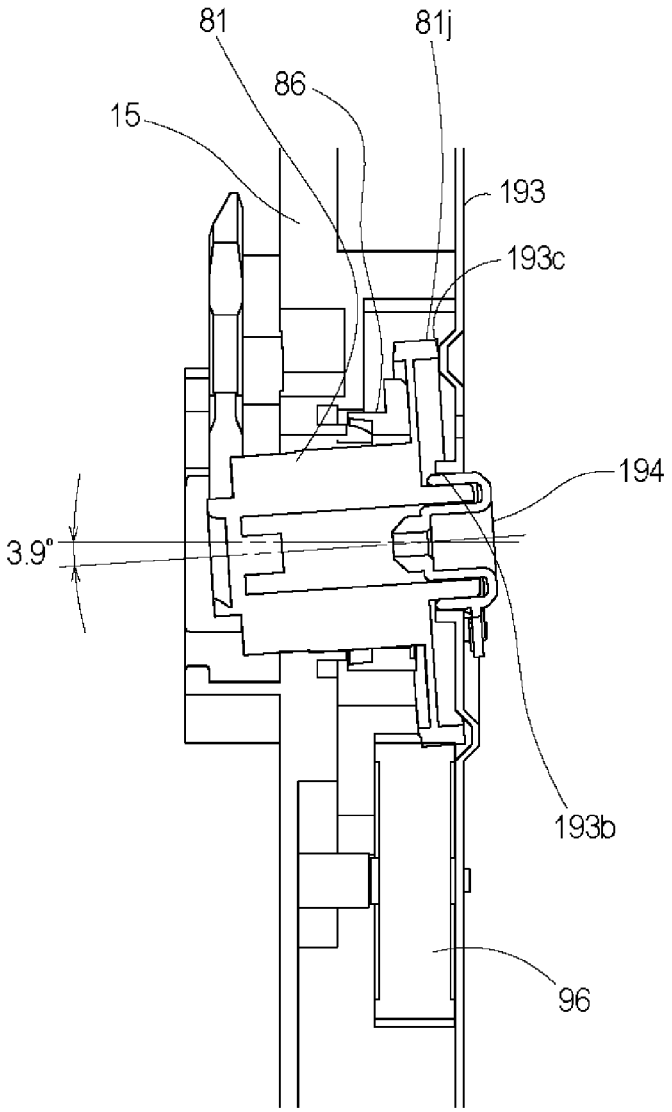

FIG. 38 is a perspective view illustrating the modification of Embodiment 1.

Figure 39:
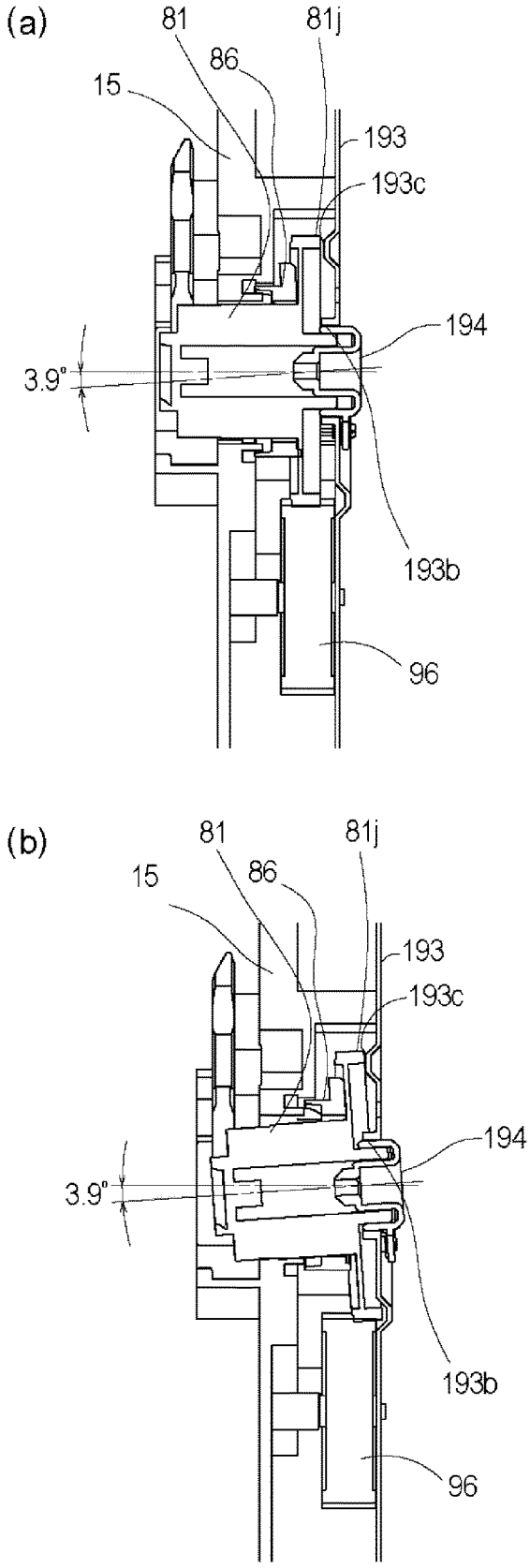

Parts (a) and (b) of FIG. 39 are cross-sectional views of a structure according to Embodiment 2.

Figure 40:
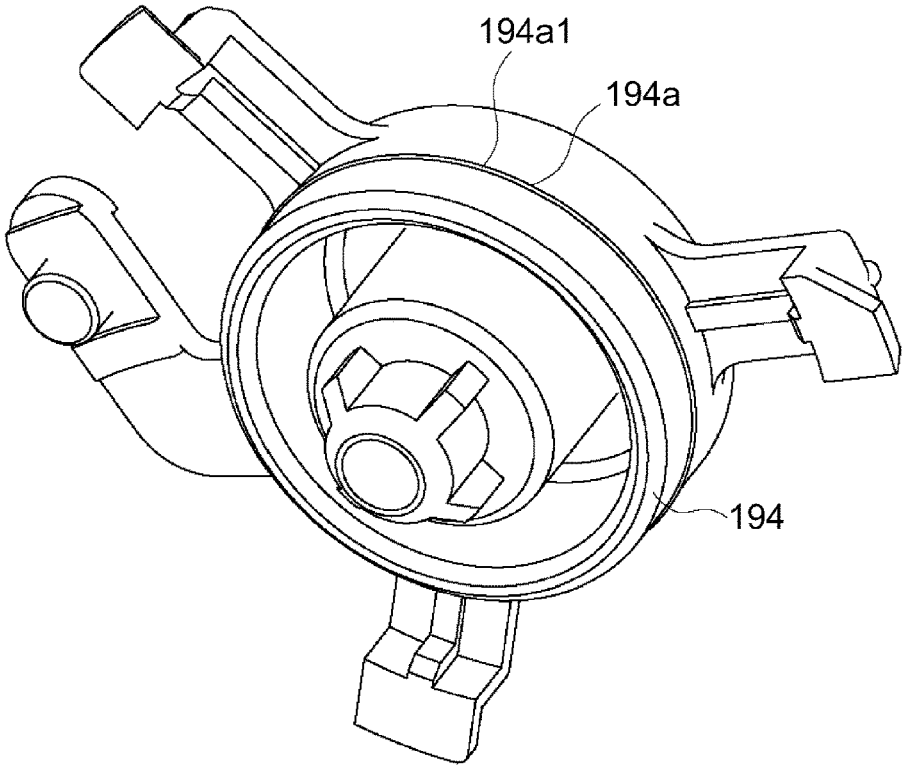

FIG. 40 is an illustration of the structure according to Embodiment 2.

Figure 41:
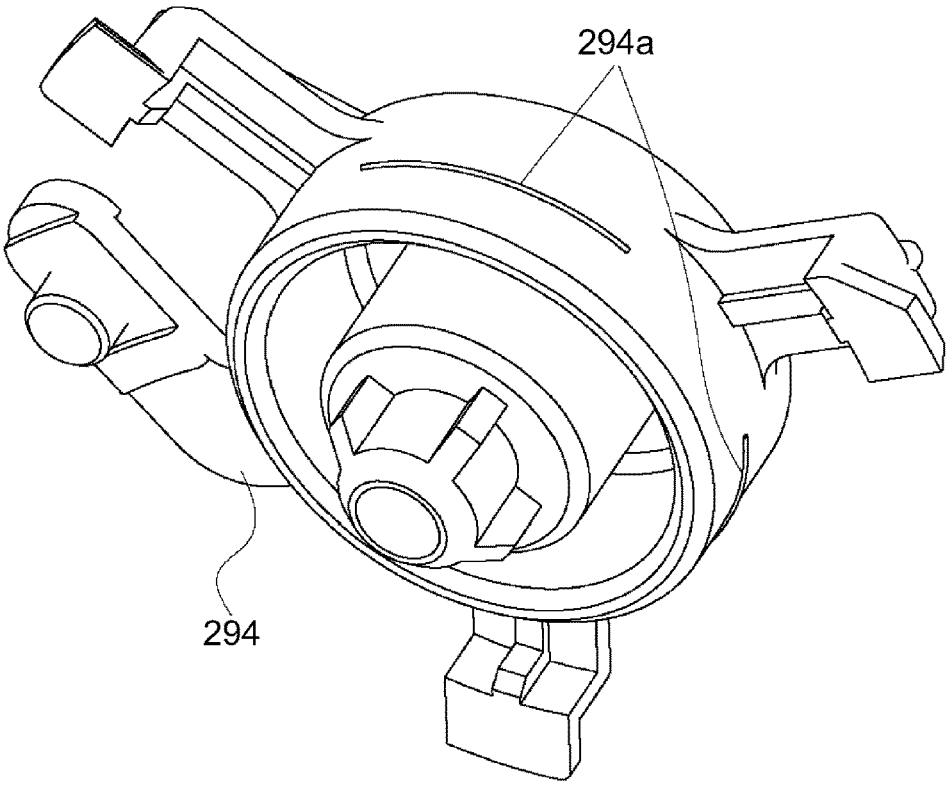

FIG. 41 is a perspective view illustrating a modification of Embodiment 2.

Figure 42:
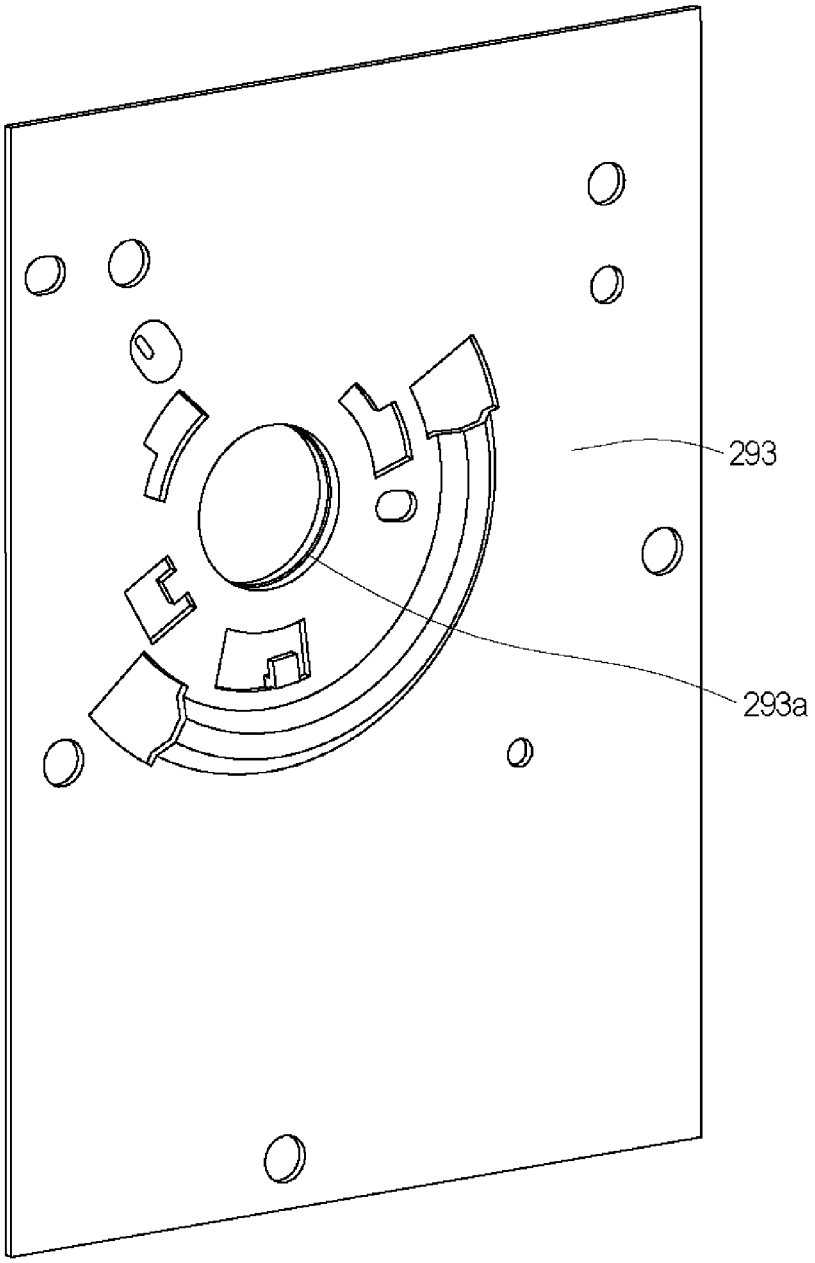

FIG. 42 is a perspective view illustrating the modification of Embodiment 2.

DESCRIPTION OF THE EMBODIMENTS

Embodiment 1

In the following, embodiments of the present invention will be described in detail in conjunction with the accompanying drawings.

Here, a rotational axis direction of an electrophotographic photosensitive drum is referred to as a longitudinal direction.

In the longitudinal direction, a side on which an electrophotographic photosensitive drum receives the driving force from a main assembly of an image forming apparatus is referred as a driving side, and the opposite side thereof is referred to as a non-driving side.

Figure 2:
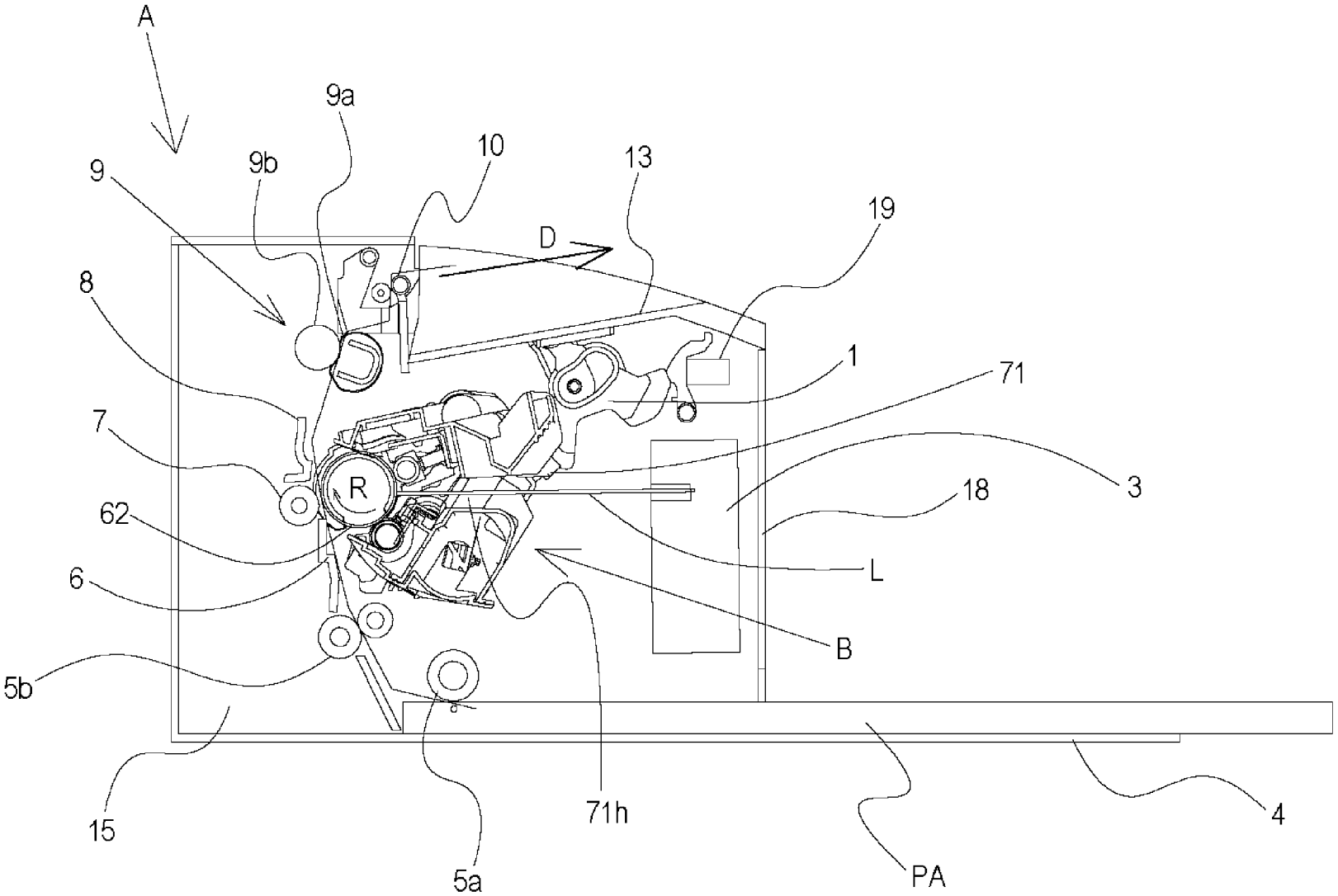
FIG. 2 is a sectional view of an image forming apparatus main assembly and a process cartridge of an electrophotographic image forming apparatus according to Embodiment 1.
Figure 3:
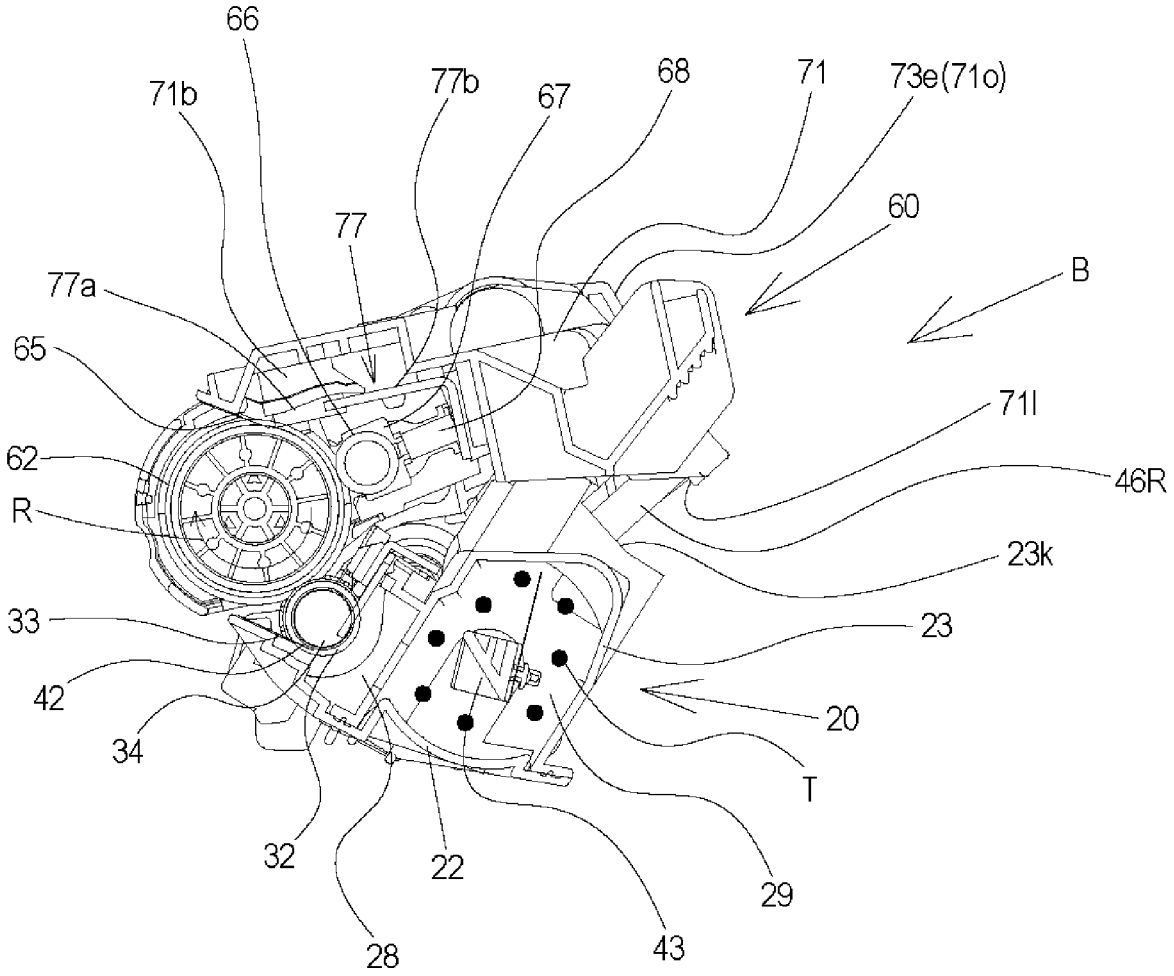
FIG. 3 is a cross-sectional view of the process cartridge according to Embodiment 1.

Referring to FIGS. 2 and 3, an overall structure and an image forming process will be described.

FIG. 2 is a sectional view of the apparatus main assembly (electrophotographic image forming apparatus main assembly, image forming apparatus main assembly) A and the process cartridge (hereinafter referred to as cartridge B) of the electrophotographic image forming apparatus according to Embodiment 1 of the present invention.

FIG. 3 is a sectional view of the cartridge B.

Here, the apparatus main assembly A is a part of the electrophotographic image forming apparatus excluding the cartridge B.

<General Arrangement of Electrophotographic Image Forming Apparatus>

An electrophotographic image forming apparatus (image forming apparatus) shown in FIG. 2 is a laser beam printer using an electrophotographic technique in which the cartridge B is dismountably mounted to the apparatus main assembly A. An exposure device 3 (laser scanner unit) for forming a latent image on an electrophotographic photosensitive drum 62 as an image bearing member of the cartridge B when the cartridge B is mounted in the apparatus main assembly A is provided. In addition, a sheet tray 4 containing recording materials (hereinafter referred to as sheet materials PA) to be subjected to image formation is provided below the cartridge B. The electrophotographic photosensitive drum 62 is a photosensitive member (electrophotographic photosensitive member) for forming an electrophotographic image.

In the main assembly A, there are sequentially provided a pickup roller 5*a*, a feeding roller pair 5*b*, a transfer guide 6, a transfer roller 7, a conveyance guide 8, a fixing device 9, a discharge roller pair 10, a discharge tray 11 and the like. Here, the fixing device 9 comprises a heating roller 9*a* and a pressure roller 9*b*.

<Image Forming Process>

The image forming process will be briefly explained. Based on the print start signal, the electrophotographic photosensitive drum (hereinafter referred to as photosensitive drum 62 or simply drum 62) is rotationally driven in the direction of arrow R at a predetermined circumferential speed (process speed).

The charging roller (charging member) 66 to which the bias voltage is applied contacts with an outer peripheral surface of the drum 62 to uniformly charge the outer peripheral surface of the drum 62.

An exposure device 3 outputs a laser beam L in accordance with image information. The laser beam L passes through a laser opening 71*h* provided in a cleaning frame 71 of the cartridge B and scans and exposes the outer peripheral surface of the drum 62. An electrostatic latent image corresponding to image information is formed on the outer peripheral surface of the drum 62.

As shown in FIG. 3, in a developing unit 20 as a developing device, the toner T in a toner chamber 29 is stirred and fed by rotation of a feeding member (stirring member) 43, and is fed to a toner supply chamber 28.

The toner T is carried on a surface of a developing roller 32 by a magnetic force of the magnet roller 34 (fixed magnet). The developing roller 32 is a developer carrying member that carries a developer (toner T) on the surface thereof in order to develop a latent image formed on the drum 62.

While the toner T is triboelectrically charged by a developing blade 42, a layer thickness of the toner on the peripheral surface of the developing roller 32 as the developer carrying member is regulated.

The toner T is supplied to the drum 62 in accordance with the electrostatic latent image to develop the latent image. By this, the latent image is visualized into a toner image. The drum 62 is an image bearing member that carries a latent image and an image (toner image, developer image) formed with toner on the surface thereof. In addition, as shown in FIG. 2, the sheet material PA stored in the lower portion of the apparatus main assembly A is fed out of the sheet tray 4 by the pickup roller 5*a* and the feeding roller pair 5*b* in timed relation with the output timing of the laser beam L. And, the sheet material PA is fed to the transfer position between the drum 62 and the transfer roller 7 by way of the transfer guide 6. At this transfer position, the toner image is sequentially transferred from the drum 62 onto the sheet material PA.

The sheet material PA onto which the toner image has been transferred is separated from the drum 62 and fed to the fixing device 9 along the conveyance guide 8. And, the sheet material PA passes through the nip portion between a heating roller 9*a* and a pressure roller 9*b* constituting the fixing device 9. Pressure and heat fixing process are performed in this nip portion, and the toner image is fixed on the sheet material PA. The sheet material PA subjected to the fixing process of the toner image is fed to the discharge roller pair 10 and is discharged to the discharge tray 11.

On the other hand, as shown in FIG. 3, residual toner on the outer circumferential surface of the drum 62 after the transfer is removed by a cleaning blade 77 and the drum 62 is used again for the image forming process. The toner removed from the drum 62 is then stored in a waste toner chamber 71*b* of a toner cleaning unit 60. The cleaning unit 60 is a unit including the photosensitive drum 62.

In the above description, the charging roller 66, the developing roller 32, the transfer roller 7, and the cleaning blade 77 functions as a process means acting on the drum 62.

<General Arrangement of Entire Cartridge>

Figure 4:
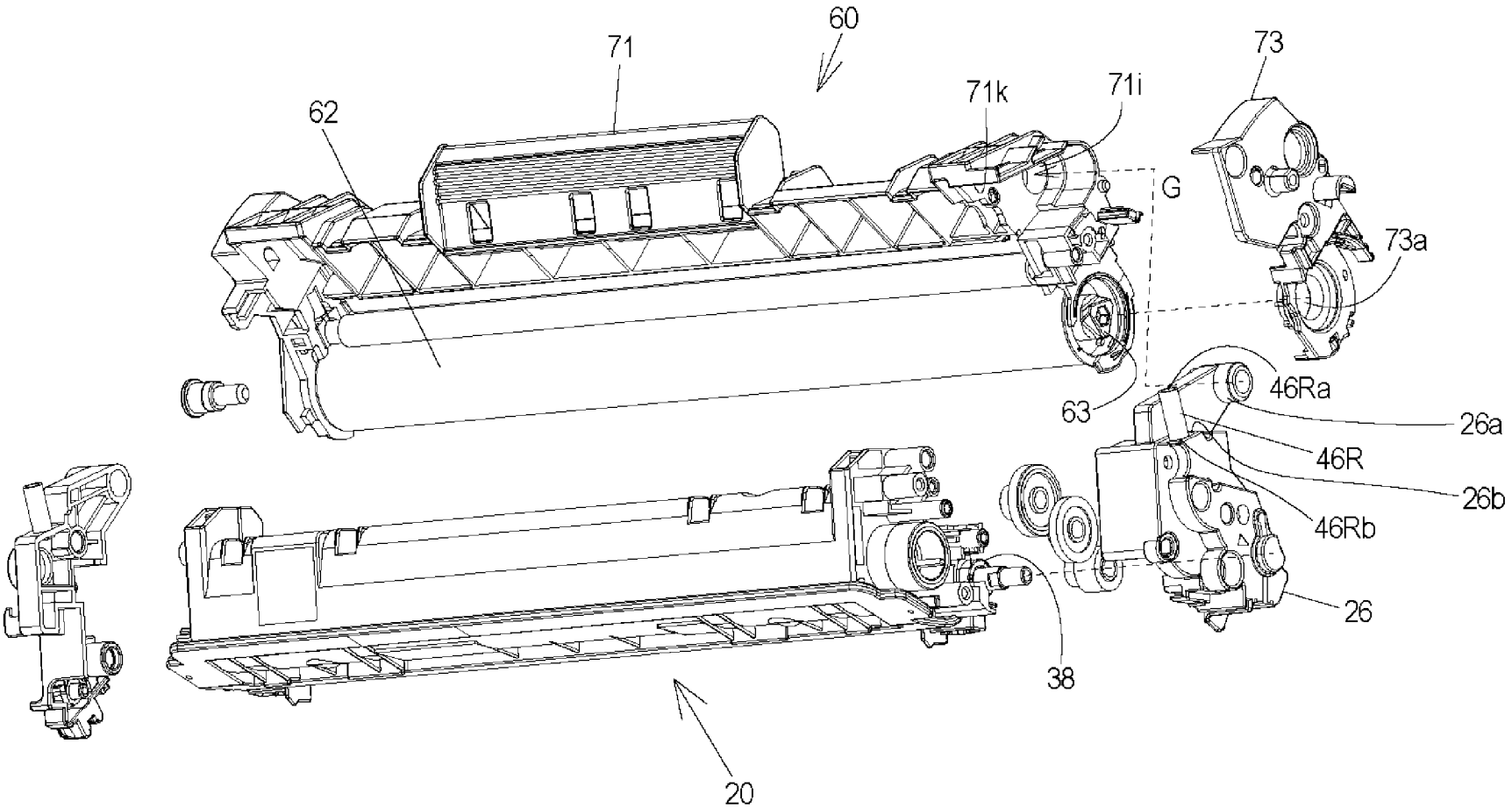
FIG. 4 is a perspective view of the image forming apparatus main assembly in a state in which an opening and closing door of the electrophotographic image forming apparatus according to Embodiment 1 is opened.
Figure 5:
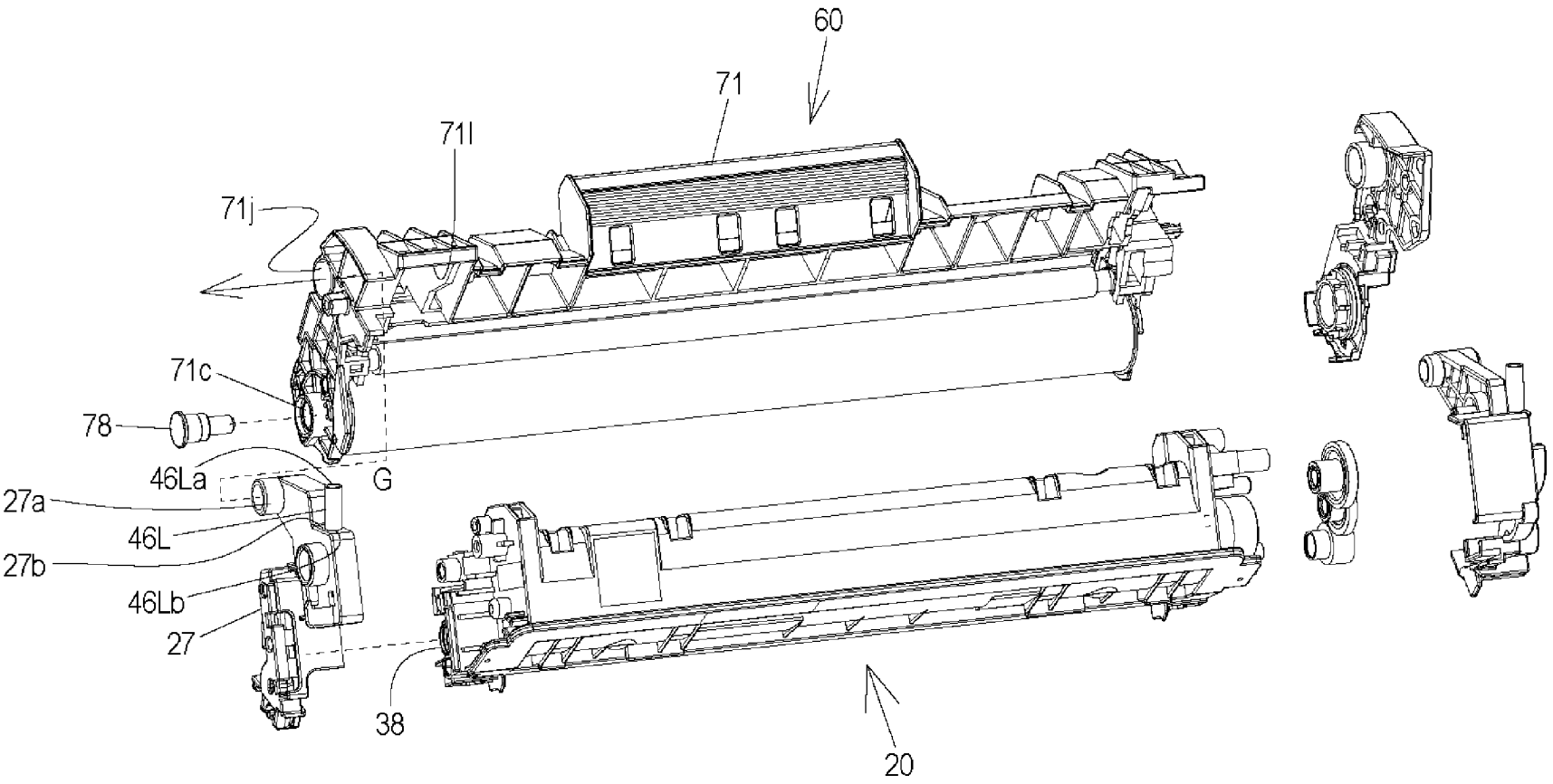
FIG. 5 is a perspective view of a driving side positioning portion of the process cartridge and the image forming apparatus main assembly in a state in which the process cartridge is mounted to the main assembly of the electrophotographic image forming apparatus according to Embodiment 1.

Referring to FIGS. 3, 4 and 5, the overall structure of the cartridge B will be described. FIG. 3 is a sectional view of the cartridge B, and FIGS. 4 and 5 are perspective views illustrating the structure of the cartridge B. Here, in this embodiment, the screws for joining the parts will be omitted for simplicity.

The cartridge B includes a cleaning unit (photosensitive member holding unit, drum holding unit, image bearing member holding unit, first unit) 60 and a developing unit (developer carrying member holding unit, second unit) 20.

Generally, the process cartridge is a process cartridge in which at least one of the electrophotographic photosensitive member and the process means acting thereon is integrated into a cartridge, and the process cartridge is detachably mountable to the main assembly (apparatus main assembly) of the electrophotographic image forming apparatus. Examples of process means include charging means, developing means and cleaning means.

As shown in FIG. 3, the cleaning unit 60 includes the drum 62, the charging roller 66, the cleaning member 77, and the cleaning frame 71 for supporting them. On the drive side of the drum 62, a drive side drum flange 63 provided on the drive side is rotatably supported by a hole 73*a* of a drum bearing 73. In a broad sense, the drum bearing 73 and the cleaning frame 71 can be collectively called a cleaning frame.

As shown in FIG. 5, a hole portion (not shown) of a non-driving side drum flange is rotatably supported by a drum shaft 78 press-fitted in a hole portion 71*c* provided in the cleaning frame 71 on the non-driving side.

Each drum flange is a supported portion rotatably supported by the bearing portion.

In the cleaning unit 60, the charging roller 66 and the cleaning member 77 are disposed in contact with the outer peripheral surface of the drum 62.

The cleaning member 77 includes a rubber blade 77*a* which is a blade-shaped elastic member formed of rubber material as an elastic material, and a support member 77*b* which supports the rubber blade. The rubber blade 77*a* is in contact with the drum 62 in the counter direction with respect to the rotational direction of the drum 62. That is, the rubber blade 77*a* is in contact with the drum 62 so that its free end portion faces the upstream side in the rotational direction of the drum 62.

As shown in FIG. 3, the waste toner removed from the surface of the drum 62 by the cleaning member 77 is stored in the waste toner chamber 71*b* formed by the cleaning frame 71 and the cleaning member 77.

In addition, as shown in FIG. 3, a scooping sheet 65 for preventing the waste toner from leaking from the cleaning frame 71 is provided at the edge of the cleaning frame 71 so as to be in contact with the drum 62.

The charging roller 66 is rotatably mounted to the cleaning unit 60 via charging roller bearings (not shown) at opposite end portions with respect to the longitudinal direction of the cleaning frame 71.

Here, the longitudinal direction of the cleaning frame 71 (the longitudinal direction of the cartridge B) is substantially parallel to the direction (the axial direction) in which the rotation axis of the drum 62 extends. Therefore, the axial direction of the drum 62 is intended in the case of merely longitudinal direction or simply axial direction is referred to without particular notice.

The charging roller 66 is pressed against the drum 62 as the charging roller bearing 67 is pressed toward the drum 62 by the urging member 68. The charging roller 66 is rotationally driven by the rotation of the drum 62.

As shown in FIG. 3, the developing unit 20 includes a developing roller 32, a developing container 23 that supports the developing roller 32, a developing blade 42, and the like. The developing roller 32 is rotatably mounted to the developing container 23 by bearing members 27 (FIG. 5) and 37 (FIG. 4) provided at the opposite end portions.

In addition, a magnet roller 34 is provided inside the developing roller 32. In the developing unit 20, a developing blade 42 for regulating the toner layer on the developing roller 32 is disposed. As shown in FIG. 4 and FIG. 5, a gap maintaining member 38 is mounted to the developing roller 32 at opposite end portions of the developing roller 32, and by the contact of the gap maintaining member 38 with the drum 62, the developing roller 32 is held with a small gap from the drum 62. As shown in FIG. 3, a blowing prevention sheet 33 for preventing toner from leaking from the developing unit 20 is provided at the edge of the bottom member 22 so as to abut against the developing roller 32. Further, in the toner chamber 29 formed by the developing container 23 and the bottom member 22, a feeding member 43 is provided. The feeding member 43 stirs the toner accommodated in the toner chamber 29 and conveys the toner to the toner supply chamber 28.

As shown in FIGS. 4 and 5, the cartridge B is formed by combining the cleaning unit 60 and the developing unit 20 with each other.

When joining the developing unit and cleaning unit with each other, the center of the first developing supporting boss 26*a* of the bearing member 26 with respect to the first suspending hole 71*i* on the driving side of the cleaning frame 71, and the center of the developing second supporting boss 27*a* with respect to the second suspending hole 71*j* on the non-driving side are first aligned with each other. More specifically, by moving the developing unit 20 in the direction of the arrow G, the first developing supporting boss 26*a* and the developing second supporting boss 27*a* are fitted in the first suspending hole 71*i* and the second suspending hole 71*j*. By this, the developing unit 20 is movably connected to the cleaning unit 60. More specifically, the developing unit 20 is connected to the cleaning unit 60 so as to be rotatable relative to each other. Thereafter, the cartridge B is constructed by assembling the drum bearing 73 with the cleaning unit 60.

In addition, the first end 46Rb of the driving side urging member 46R is fixed to the surface 26*b* of the bearing member 26, and the second end 46Ra abuts against the surface 71*k* which is a part of the cleaning unit.

In addition, the first end portion 46Ra of the non-driving side urging member 46R is fixed to the surface 23*k* of the developing container 23, and the second end portion 46Rb abuts against the surface 71*l* which is a part of the cleaning unit.

In this embodiment, the driving side urging member 46L (FIG. 5) and the non-driving side urging member 46R (FIG. 4) are in the form of compression springs. By the urging force of these spring, the driving side urging member 46L and the non-driving side urging member 46R urges the developing unit 20 against the cleaning unit 60, thereby reliably pressing the developing roller 32 toward the drum 62. And, the developing roller 32 is held at a predetermined gap from the drum 62 by the gap maintaining members 38 mounted on the opposite end portions of the developing roller 32.

<Cartridge Mounting>

Figure 1:
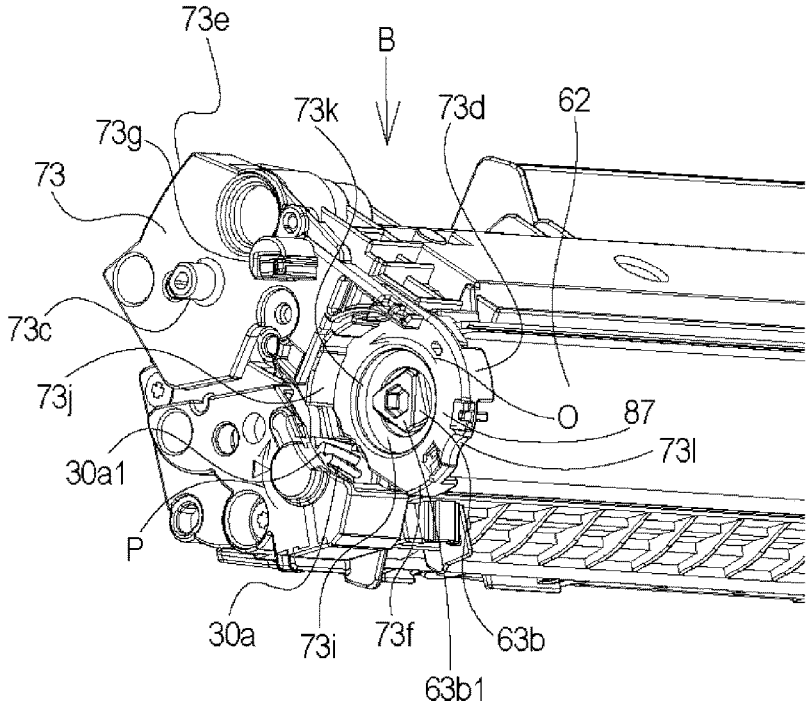
Figure 1:
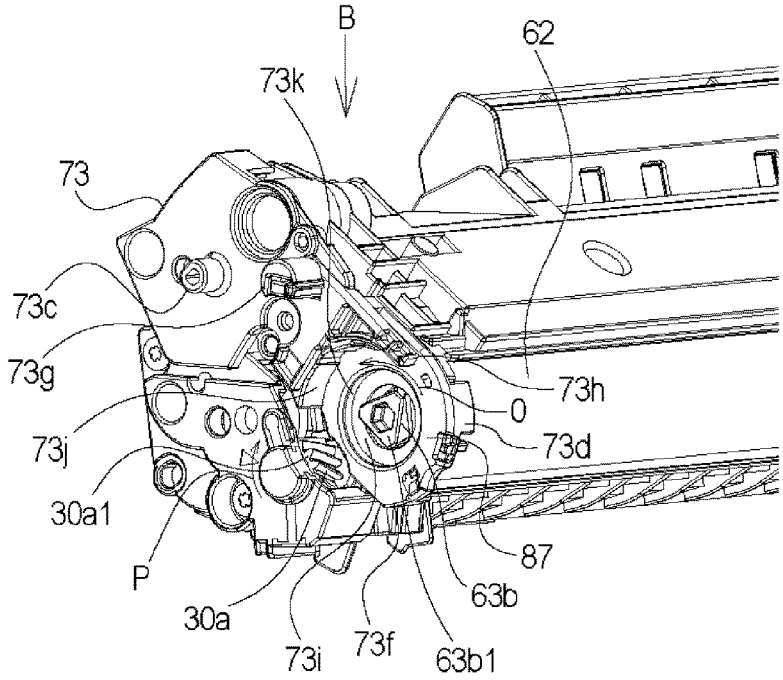

Referring to part (a) of FIG. 1, part (b) of FIG. 1, part (a) of FIG. 6, part (b) of FIG. 6, part (c) of FIG. 6, part (a) of FIG. 7, part (b) of FIG. 7, part (a) of FIG. 8, part (b) of FIG. 8, FIG. 9, part (a) of FIG. 10, part (b) of FIG. 10, part (a) of FIG. 11, part (b) of FIG. 11, part (a) of FIG. 12, part (b) of FIG. 12, part (a) of FIG. 13, part (b) of FIG. 13, FIG. 14, FIG. 15, FIG. 16, and FIG. 17, the mounting of cartridge will be described in detail. Part (a) and part (b) of FIG. 1 are perspective views of cartridges for explaining the shape around the drive transmission portion. Part (a) of FIG. 6 is a perspective view of a cylindrical cam, and part (b) of FIG. 6 is a perspective view of the first side plate as viewed from the outside of the apparatus main assembly A, and, part (c) of FIG. 6 is a sectional view (a direction of an arrow in part (b) of FIG. 6) in which a cylindrical cam is mounted to the first side plate. Part (a) of FIG. 7 is a sectional view of an image forming apparatus link portion for explaining a link structure, part (b) of FIG. 7 is a cross sectional view of the image forming apparatus driving for explaining movement of the drive transmission member. Part (a) of FIG. 8 is a cross-sectional view of the driving side guide portion of the image forming apparatus for explaining the mounting of the cartridge, part (b) of FIG. 8 is a cross-sectional view of the non-driving side guide portion of the image forming apparatus for explaining the mounting of the cartridge. FIG. 9 is an illustration of the image forming apparatus driving train portion for explaining the positional relationship of the drive train before closing the opening/closing door. Part (a) of FIG. 10 is an illustration of the image forming apparatus positioning portion (just before fitting) for explaining the positioning of the process cartridge B in the longitudinal direction. Part (b) of FIG. 10 is an illustration (after fitting) of the image forming apparatus positioning portion for explaining the positioning of the process cartridge B in the longitudinal direction. Part (a) of FIG. 11 is a drive-side cross-sectional view of the image forming apparatus for explaining the positioning of the cartridge. Part (b) of FIG. 11 is a non-driving side sectional view of the image forming apparatus for explaining the positioning of the cartridge. Part (a) of FIG. 12 is a cross-sectional view of the image forming apparatus link portion for explaining the link structure, and part (b) of FIG. 12 is a cross-sectional view of the image forming apparatus drive portion for explaining the movement of the drive transmission member. Part (a) of FIG. 13 is a perspective view of the drive transmission member for explaining the shape of the drive transmission member. Part (b) of FIG. 13 is an illustration of the drive transmission portion of the main assembly A for explaining the drive transmission portion. FIG. 15 is a perspective view of a drive portion of the image forming apparatus for explaining the engagement space of the drive transmission portion. FIG. 16 is a cross-sectional view of the drive transmission member for explaining the engagement space of the drive transmission member. FIG. 17 is a sectional view of the drive transmission member for explaining the engagement of the drive transmission member.

First, the structure and operation from the opened state to the closed state of the opening/closing door 13 of the apparatus main assembly A will be described. As shown in part (a) of FIG. 7, the apparatus main assembly A is provided with the opening/closing door 13, the cylindrical cam link 85, the cylindrical cam 86, the cartridge pressing members 1, 2, the cartridge pressing springs 19, 21, and a front plate 18. In addition, as shown in part (b) of FIG. 7, the main assembly A is provided with a drive transmission member bearing 83, a drive transmission member 81, and a drive transmission member urging spring 84. Furthermore, the apparatus main assembly A is provided with a first side plate 15 provided on the driving side, and a side plate 16 (FIG. 10*a*) provided on the non-driving side.

The opening/closing door 13 is for opening and closing a mounting portion (a space for accommodating the cartridge) for mounting the cartridge B.

The opening/closing door 13 is rotatably mounted to the first side plate 15 and the side plate 16. As shown in part (a) of FIG. 6, part (b) of FIG. 6, part (c) of FIG. 6, the cylindrical cam 86 is mounted to the first side plate 15 so as to be rotatable and movable in the longitudinal direction AM. It has two inclined portions 86*a*, 86*b* and has one end portion 86*c* continuous to the inclined portion on the non-driving side in the longitudinal direction. The first side plate 15 has two inclined surface portions 15*d*, 15*e* opposed to the two inclined surface portions 86*a*, 86*b* and an end surface 15*f* opposed to the one end portion 86*c* of the cylindrical cam 86. As shown in part (a) of FIG. 7, the cylindrical cam link 85 has bosses 85*a*, 85*b* at the opposite end portions. The bosses 85*a*, 85*b* are rotatably mounted in the mounting hole 13*a* provided in the opening/closing door 13 and in the mounting hole 86*e* provided in the cylindrical cam 86, respectively. When the opening/closing door 13 is rotated and opened, the rotating cam link 85 moves in interrelation with the opening/closing door 13. By the movement of the rotating cam link 85, the cylindrical cam 86 is rotated so that the inclined surface portions 86*a* and 86*b* first contact the inclined surface portions 15*d* and 15*e* provided on the first side plate 15, respectively. When the cylindrical cam 86 rotates, the inclined surfaces 86*a* and 86*b* slide along the inclined surface portions 15*d* and 15*e*, whereby the cylindrical cam 86 moves to the driving side in the longitudinal direction. Finally, the cylindrical cam 86 moves until the one end portion 86*c* of the cylindrical cam 86 abuts against the end surface 15*f* of the first side plate 15.

Here, as shown in part (b) of FIG. 7, one end (fixed end 81*c*) of the drive side in the axial direction of the drive transmission member 81 is fitted to the drive transmission member bearing 83 and supported so as to be rotatable and movable in the axial direction. In addition, the center portion 81*d* in the longitudinal direction of the drive transmission member 81 is provided with a gap M with respect to the first side plate 15. In addition, the drive transmission member 81 has an abutment surface 81*e*, and the cylindrical cam 86 has the other end portion 86*d* opposite to the abutment surface 81*e*. The drive transmission member spring 84 is a compression spring, and one end portion 84*a* is in contact with a spring seat 83*a* provided on the drive transmission member bearing 83, and the other end portion 84*b* is in contact with a spring seat 81*f* provided on the drive transmission member 81. By this, the drive transmission member 81 is urged to the non-drive side in the axial direction (the left side in part (b) of FIG. 7). The abutment surface 81*e* of the drive transmission member 81 and the other end portion 86*d* of the cylindrical cam 86 are in contact with each other by this urging.

When the cylindrical cam 86 moves in the longitudinal direction to the drive side (the right side in part (b) of FIG. 7) as described above, the drive transmission member 81 is pushed by the cylindrical cam 86 and moves to the drive side. By this, the drive transmission member 81 takes the retracted position. That is, in interrelation with the movement of the opening/closing door 13 to the open position, the drive transmission member 81 is retracted from the movement path of the cartridge B. By this, a space for mounting the cartridge B is reserved in the image forming apparatus main assembly A.

The cylindrical cam 86 is a retracting member (retracting mechanism) for moving the drive transmitting member 81 to the retracted position in interrelation with the movement of the opening/closing door 13 to the open position.

The installation of cartridge B will be described. As shown in part (a) of FIG. 8 and part (b) of FIG. 8, the first side plate 15 has an upper guide rail 15 *g* and a guide rail 15*h*, the side plate 16 is an upper guide rail 16*d* and a guide rail 16*e*, as a guide. In addition, the drum bearing 73 provided on the driving side of the cartridge B has a guided portion (portion to be guided) 73 *g* and a rotation stopped portion (portion to be stopped) 73*c*. In the mounting direction of the cartridge B (the arrow C), the guided portion 73 *g* and the rotation stopped portion 73*c* are disposed on the upstream side (arrow AO side in FIG. 16) of the axis of the coupling projection 63*b* (part (a) in FIG. 1, the details will be described hereinafter).

Here, the mounting direction of the cartridge B is a direction substantially perpendicular to the axis of the drum 62. In addition, as regards upstream or downstream in the mounting direction, they are defined in the moving direction of the cartridge B just before the mounting thereof to the apparatus main assembly A is completed.

In addition, the cleaning frame 71 is provided with a positioned portion (position to be positioned) 71*d* and a rotation stopping portion 71 *g* on the non-drive side in the longitudinal direction. When the cartridge B is installed from the cartridge insertion opening 17 of the main assembly A of the apparatus, the guided portion 73 *g* and the rotation stopping portion 73*c* of the cartridge B are guided by the upper guide rail 15 *g* and the guide rail 15*h* of the apparatus main assembly A, at the driving side of the cartridge B. On the non-driving side of the cartridge B, the positioned portion 71*d* of the cartridge B and the rotation stopping portion 71 *g* are guided by the guide rail 16*d* and the guide rail 16*e* of the apparatus main assembly A. By this, the cartridge B is mounted in the apparatus main assembly A.

Here, a developing roller gear (developing gear) 30 is provided at the end portion of the developing roller 32 (FIG. 9 and part (b) of FIG. 13). That is, the developing roller gear 30 is mounted to the shaft portion (shaft) of the developing roller 32.

The developing roller 32 and the developing roller gear 30 are coaxial with each other, and rotate about the axis Ax2 shown in FIG. 9. The developing roller 32 is arranged such that the axis Ax2 thereof is substantially parallel to the axis Ax1 of the axis of the drum 62. Therefore, the axial direction of the axial direction (developing roller gear 30) of the developing roller 32 is substantially the same as the axial direction of the drum 62.

The developing roller gear 30 is a drive input gear (a cartridge side gear, a drive input member) to which a driving force (rotational force) is inputted from the outside of the cartridge B (that is, the apparatus main assembly A). The developing roller 32 is rotated by the driving force received by the developing roller gear 30.

As shown in parts (a) and part (b) thereof of FIG. 1, in the side surface on the driving side of the cartridge B, a space 87 opened so as to expose the developing roller gear 30 and the coupling projection 63*b* is provided on the drum 62 side with respect to the developing roller gear 30.

The coupling projection 63*b* is formed on the drive side drum flange 63 mounted to the end of the drum (FIG. 9). The coupling projection 63*b* is a coupling portion (a drum side coupling portion, a cartridge side coupling portion, a photosensitive member side coupling portion, an input coupling portion, or a drive input portion) to which a driving force (rotational force) is inputted from the outside of the cartridge B (that is, the apparatus main assembly A) (FIG. 9). The coupling projection 63*b* is disposed coaxially with the drum 62. That is, the coupling projection 63*b* rotates about the axis Ax1.

The drive side drum flange 63 including the coupling projection 63*b* is also referred to as a coupling member (a drum side coupling member, a cartridge side coupling member, a photosensitive member side coupling member, a drive input coupling member, an input coupling member).

In addition, in the longitudinal direction of the cartridge B, the side on which the coupling projection 63*b* is provided corresponds to the drive side, and the opposite side corresponds to the non-drive side.

In addition, as shown in FIG. 9, the developing roller gear 30 has a gear portion (input gear portion, cartridge side gear portion, developing side gear portion) 30*a* and an end surface 30*a*1 provided on the driving side of the gear portion (parts (a) and part (b) of FIG. 1, and FIG. 9). Teeth (gear teeth) formed on the outer periphery of the gear portion 30*a* are helical teeth inclined with respect to the axis of the developing roller gear 30. That is, the developing roller gear 30 is a helical tooth gear (part (a) of FIG. 1).

Here, the "helical tooth" also includes a shape in which a plurality of projections 232*a* are arranged along a line inclined with respect to the axis of the gear to substantially form the helical tooth portion 232*b* (FIG. 14). In the structure shown in FIG. 14, the gear 232 has a large number of projections 232*b* on its circumferential surface. And, the set of five projections 232*b* can be regarded as forming a row inclined with respect to the axis of the gear. Each of the rows of these five projections 232*b* corresponds to the teeth of the aforementioned gear portion 30*a*.

The drive transmission member (drive output member, main assembly side drive member) 81 has a gear portion (main assembly side gear portion, output gear portion) 81*a* for driving the developing roller gear 30. The gear portion 81*a* has an end surface 81*a*1 at the end on the non-driving side (parts (a) and part (b) of FIG. 13).

The teeth (gear teeth) formed on the gear portion 81*a* are also helical teeth inclined with respect to the axis of the drive transmission member 81. That is, the drive transmission member 81 is also provided with a portion of the helical tooth gear.

In addition, the drive transmission member 81 is provided with a coupling recess 81*b*. The coupling recess 81*b* is a coupling portion (main assembly side coupling portion, output coupling portion) provided in the device main assembly side. The coupling recess 81*b* is a recess which can be coupled with a coupling projection 63*b* provided on the drum side and which is formed in the projection (cylindrical portion) provided at the free end of the drive transmission member 81.

The space (space) 87 (FIG. 1) constituted so that the gear portion 30*a* and the coupling projection 63*b* are exposed is for placing the gear portion 81*a* of the drive transmission member 81 when the cartridge B is mounted in the apparatus main assembly A. Therefore, the space 87 is larger than the gear portion 81*a* of the drive transmission member 81 (FIG. 15).

Since the space 87 exists, the drive transmission member 81 does not interfere with the cartridge B when the cartridge B is mounted to the apparatus main assembly A. As shown in FIG. 15, the space 87 allows the cartridge B to be mounted on the apparatus main assembly A by disposing the drive transmission member 81 therein.

In addition, when sing the cartridge B along the axis of the drum 62 (the axis of the coupling projection 63*b*), the gear teeth formed in the gear portion 30*a* are arranged in a position close to the peripheral surface of the drum 62.

In the axial direction of the developing roller gear 30, the gear teeth of the gear portion 30*a* have exposed portions exposed from the cartridge B (FIG. 1).

If the gear portion 30*a* of the developing roller gear 30 is exposed from the driving side developing side member 26, the gear portion 81*a* meshes with the gear portion 30*a* without interfering with the driving side developing side member 26, and therefore, the driving transmission is enabled.

And, at least a part of the exposed portion of the gear portion 30*a* is disposed more outside (drive side) of the cartridge B than the leading end 63*b*1 of the coupling projection 63*b* and faces the axis of the drum (FIG. 1, FIG. 9). In FIG. 9, the gear teeth disposed on the exposed portion 30*a*3 of the gear portion 30*a* faces the rotational axis Ax1 of the drum 62 (rotational axis of the coupling portion 63*b*) Ax1. In FIG. 9, the axis Ax1 of the drum 62 is above the exposed portion 30*a*3 of the gear portion 30*a*.

In FIG. 9, at least a part of the gear portion 30*a* projects toward the driving side in the axial direction than the coupling projection 63*b*, and therefore, the gear portion 30*a* overlaps the gear portion 81*a* of the drive transmission member 81 in the axial direction. And, a part of the gear portion 30*a* is exposed so as to face the axis Ax1 of the drum 62, and therefore, the gear portion 30*a* and the gear portion 81*a* of the drive transmission member 81 can contact each other in a process of inserting the cartridge B into the main assembly A of the apparatus.

Because of the above arrangement relationship, the gear portion 30*a* of the developing roller gear 30 and the gear portion 81*a* of the drive transmission member 81 can mesh with each other in the process of mounting the above-described cartridge B to the apparatus main assembly A.

In the mounting direction C of the cartridge B, the center (axis) of the gear portion 30*a* is disposed on the upstream side (the side of the arrow AO in FIG. 16) of the center (axis) of the drum 62.

As shown in part (a) of FIG. 10 and part (b) of FIG. 10, the drum bearing 73 has a fitted portion 73*h* as a portion to be positioned (position portion, axial aligned part) in the longitudinal direction (axial direction).

The first side plate 15 of the apparatus main assembly A has a fitting portion 15*j* that can be fitted with the fitted portion 73*h*. The fitted portion 73*h* of the cartridge B is fitted to the fitting portion 15*j* of the apparatus main assembly A in the above-described mounting process, by which the position in the longitudinal direction (axial direction) of the cartridge B is determined (b)). Here, in this embodiment, the fitted portion 73*h* is in the form of a slit (groove) (part (b) of FIG. 1).

Next, the state of closing door 13 will be explained. As shown in part (a) of FIG. 8, part (b) of FIG. 8, part (a) of FIG. 11 and part (b) of FIG. 11, the first side plate 15 has an upper positioning portion 15*a*, a lower positioning portion

15*b* and a rotation stopping portion 15*c*, and the side plate 16 has a positioning portion 16*a* and a rotation stopping portion 16*c*. The drum bearings 73 is provided with an upper positioned portion (first positioned portion, first projection, first projecting portion) 73*d* and the lower positioned portion (second positioned portion, second projection, second overhang portion) 73*f*.

In addition, the cartridge pressing members 1, 2 are rotatably mounted on the opposite both end portions, in the axial direction, of the opening/closing door 13, respectively. The cartridge pressing springs 19, 21 are mounted on the opposite end portions, in the longitudinal direction, of the front plate provided in the image forming apparatus A, respectively. The drum bearing 73 has the pressed portion 73*e* as an urging force receiving portion, and the cleaning frame 71 has a pressed portion 710 on the non-driving side (FIG. 3). By closing the opening/closing door 13, the pressed portions 73*e*, 710 of the cartridge B are urged by the cartridge pressing members 1, 2 urged by the cartridge pressing springs 19, 21 of the apparatus main assembly A (FIG. 11).

By this, on the driving side, the upper positioned portion 73*d*, the lower positioned member 73*f*, and the rotation stopping member 73*c* of the cartridge B are contacted to the upper positioning portion 15*a*, the lower positioning portion 15*b* and the rotation stopping portion 15*c*, respectively. By this, the cartridge B and the drum 62 are positioned on the drive side. In addition, on the non-driving side, the positioned portion 71*d* of the cartridge B and the rotation-stopped portion 71 *g* come into contact with the positioning portion 16*a* and the rotation stopping portion 16*c* of the apparatus main assembly A, respectively. By this, the cartridge B and the drum 62 are positioned on the non-driving side.

As shown in parts (a) and part (b) of FIG. 1, the upper positioned portion 73*d* and the lower positioned member 73*f* are disposed in the neighborhood of the drum 62. In addition, the upper positioned portion 73*d* and the lower positioned member 73*f* are arranged along the rotational direction of the drum 62.

In addition, in the drum bearing 73, it is necessary to assure a space (circular-arc shaped recess) 731 for disposing the transfer roller 7 (FIG. 11) between the upper positioned portion 73*d* and the lower positioned member 73*f*. Therefore, the upper positioned portion 73*d* and the lower positioned member 73*f* are arranged apart from each other.

In addition, the upper positioned portion 73*d* and the lower positioned member 73*f* are in the form of projections projecting inward in the axial direction from the drum bearing 73. As described above, it is necessary to assure the space 87 around the coupling projection 63*b*. Therefore, the upper positioned portion 73*d* and the lower positioned member 73*f* do not project outward in the axial direction, but instead project inward to assure the space 87.

In addition, the upper positioned portion 73*d* and the lower positioned member 73*f* are disposed so as to partially cover the driving side drum flange 63 provided at the end of the photosensitive drum 62. When the upper positioned portion 73*d* and the driving side drum flange 63 are projected on the axis of the drum 62, at least a part of the projected areas of the upper positioned portion 73*d* and the driving side drum flange 63 overlap each other. In this regard, the lower positioned portion 73*f* is also the same as the upper positioned portion 73*d* (FIG. 11).

The pressed portions 73*e* and 710 are projecting portions of the frame of the cleaning unit provided on one end side (drive side) and the other end side (non-drive side) of the cartridge B in the longitudinal direction, respectively. In particular, the pressed portion 73*e* is provided on the drum bearing 73. The pressed portions 73*e* and 710 are projected in a direction crossing with the axial direction of the drum 62 away from the drum 62.

On the other hand, as shown in part (a) of FIG. 12 and part (b) of FIG. 12, the drive side drum flange 63 has a coupling projection 63*b* on the drive side, a free end portion 63*b*1 at the free end of the coupling projection 63*b*. The drive transmission member 81 has a coupling recess 81*b* and a free end portion 81*b*1 of the coupling recess 81*b* on the non-driving side. By closing the opening/closing door 13, the inclined surface portions 86*a*, 86*b* of the cylindrical cam 86 rotate along the inclined surface portions 15*d*, 15*e* of the first side plate 15 via the rotating cam link 85, while moving in the longitudinal direction toward the non-drive side (approaching to the cartridge B). By this, the drive transmission member 81 present at the retracted position moves to the non-drive side (the side approaching the cartridge B) in the longitudinal direction by the drive transmission member spring 84. Since the gear teeth of the gear portion 81*a* and the gear portion 30*a* are inclined with respect to the moving direction of the drive transmission member 81, the gear teeth of the gear portion 81*a* abuts to the gear teeth of the gear portion 30*a* by the movement of the drive transmission member 81. At this point of time, the movement of the drive transmission member 81 to the non-drive side is stopped.

Even after the drive transmission member 81 stops, the cylindrical cam 86 further moves to the non-drive side, and the drive transmission member 81 and the cylindrical cam 86 are separated.

Next, as shown in parts (a) and 17 in FIGS. 1 and 13, the drum bearing 73 has a recess bottom surface 73*i*. The drive transmitting member 81 has a bottom portion 81*b*2 as a positioning portion on the bottom of the coupling recess 81*b*. The coupling recess 81*b* of the drive transmission member 81 is a hole having a substantially triangular cross section. When the coupling recess 81*b* is viewed from the non-drive side (the cartridge side, the opening side of the recess 81*b*), it has a shape twisted in the counterclockwise direction N as it goes to the drive side (the back side of the recess 81*b*). The gear portion 81*a* of the drive transmission member 81 is a helical gear having gear teeth twisted in the counterclockwise direction N as going to the drive side as viewed from the non-drive side (cartridge side).

The gear portion 81*a* and the coupling recess portion 81*b* are arranged so that the axis of the gear portion 81*a* and the axis of the coupling recess portion 81*b* overlap the axis of the drive transmission member 81. That is, the gear portion 81*a* and the coupling recess portion 81*b* are disposed coaxially (concentrically).

The coupling projection 63*b* of the drive side drum flange 63 has a substantially triangular cross section and is a projection shape (projection, projection). The coupling projection 63*b* is twisted in the counterclockwise direction O in the direction from the drive side (the free end side of the coupling projection 63*b*) toward the non-drive side (the bottom side of the coupling projection 63*b*) (FIG. 1). That is, the coupling projection 63*b* is inclined (twisted) in the counterclockwise direction (the direction of rotation of the drum) as going from the outside toward the inside of the cartridge in the axial direction.

Here, in the coupling projection 63*b,a* portion (ridge line) forming a corner of the triangular prism (a apex of the triangle) is a driving force receiving portion that actually receives the driving force (rotational force) from the coupling recess portion 81*b*. The driving force receiving portion is inclined toward the rotational direction of the drum as going inward from the outside of the cartridge in the axial direction. In addition, the inner surface (inner peripheral surface) of the coupling recessed portion 81*b* serves as a driving force applying portion for applying a driving force to the coupling projection 63*b*.

Here, the shape of the cross sections of the coupling projection 63*b* and the coupling recess portion 81*b* is not the exact triangles (polygons) in that corners being collapsed or rounded, but they are called substantial triangles (polygons). That is, the coupling projection 63*b* has a shape of a projection which is substantially a twisted triangular prism (square prism). However, the shape of the coupling projection 63*b* is not limited to such a shape. The shape of the coupling projection 63*b* may be changed as long as it can be coupled with the coupling recess 81*b*, that is, if the engaging and driving can be performed. For example, three bosses 163*a* may be arranged at the apexes of a triangle, and each boss 163*a* may be twisted around the axis of the drum 62 (FIG. 18).

The gear portion 30*a* of the developing roller gear 30 is a helical gear and has a shape twisted (inclined) in the clockwise direction P from the drive side to the non-drive side (FIG. 1). That is, the gear teeth (helical teeth) of the gear portion 30*a* are inclined (twisted) in the clockwise direction P (rotational direction of the developing roller and developing roller gear) in the axial direction of the gear portion 30*a* from the outside toward the inside of the cartridge. That is, the gear 30*a* is inclined (twisted) in the direction opposite to the rotational direction of the drum 62 as going from the outside toward the inside in the axial direction.

As shown in FIG. 13, the drive transmission member 81 rotates clockwise CW (reverse direction of arrow N in FIG. 13) as viewed from the non-drive side (cartridge side) by a motor (not shown). Then, a thrust force (a force generated in the axial direction) is produced by the engagement of the helical teeth of the gear portion 81*a* of the drive transmission member 81 with the gear portion 30*a* of the developing roller gear 30. The force FA in the axial direction (longitudinal direction) is applied to the drive transmission member 81, and the drive transmission member 81 tends to move to the non-drive side (the side closer to the cartridge) in the longitudinal direction. That is, the drive transmission member 81 approaches and contacts to the coupling projection 63*b*.

And, when the triangle-shaped phases of the coupling recess portion 81*b* and the coupling projection 63*b* are matched by the rotation of the drive transmission member 81, the coupling projection 63*b* and the coupling recess portion 81*b* are engaged (coupled) with each other.

And, when the projection 63*b* and the coupling recess portion 81*b* are engaged, a thrust force FC is newly produced, since both the coupling recess 81*b* and the coupling projection 63*b* are twisted (inclined) with respect to the axis.

That is, the force FC directed toward the non-driving side in the longitudinal direction (the side approaching the cartridge) acts on the drive transmission member 81. This force FC and the above-described force FA together make the drive transmission member 81 move further toward the non-drive side (the side approaching the cartridge) in the longitudinal direction. That is, the coupling projection 63 makes the drive transmission member 81 close to the coupling projection 63*b* of the cartridge B.

The drive transmission member 81 drawn by the coupling projection 63*b* is positioned in the longitudinal direction (axial direction) by the free end portion 81*b*1 of the drive transmission member 81 contacting the recess bottom surface 73*i* of the drum bearing 73.

In addition, the reaction force FB of the force FC acts on the drum 62, and by this reaction force (drag) FB, the drum 62 moves in the longitudinal direction toward the drive side (the side approaching the drive transmission member 81, the outside of the cartridge B). That is, the drum 62 and the coupling projection 63*b* are drawn to the side of the drive transmission member 81. By this, the front end portion 63*b*1 of the coupling projection 63*b* of the drum 62 abuts against the bottom portion 81*b*2 of the coupling recess portion 81*b*. By this, the drum 62 is also positioned in the axial direction (longitudinal direction).

That is, the coupling projection 63*b* and the coupling recess portion 81*b* are attracted to each other, so that the positions in the axial direction of the drum 62 and the drive transmission member 81 are determined.

Therefore, the drive transmitting member 81 is in the driving position (advanced position). In other words, the drive transmitting member 81 is in the position for transmitting the driving forces to the coupling projection 63*b* and the gear portion 30*b*, respectively, and is in the position advanced to the cartridge.

In addition, the center of the free end of the drive transmission member 81 is determined with respect to the drive side drum flange 63 by the alignment action of triangular shape of the coupling recess 81*b*. That is, the drive transmission member 81 is centered or aligned with respect to the drum flange 63, and the drive transmission member 81 and the photosensitive member become coaxial. By this, the drive can be transmitted from the drive transmission member 81 to the developing roller gear 30 and the driving side drum flange 63 with high accuracy.

The coupling recess 81*b* and the coupling projection 63*b* engaging with the coupling recess 81*b* can also be deemed as an alignment portion. That is, by engaging the coupling recess portion 81*b* and the coupling projection 63*b* with each other, the drive transmission member 81 and the drum become coaxial with each other. The coupling recessed portion 81*b* is referred to as a main assembly side alignment portion (image forming device side alignment portion), and the coupling projection 63*b* is referred to as a cartridge side alignment portion.

As has been descried in the foregoing, the engagement of the couplings is assisted by the force FA and the force FC toward the non-driving side acting on the drive transmission member 81.

By positioning the drive transmission member 81 by the drum bearing (bearing member) 73 provided in the cartridge B, the positional accuracy of the drive transmission member 81 with respect to the cartridge B can be enhanced.

The positional accuracy in the longitudinal direction between the gear portion 30*a* of the developing roller gear 30 and the gear portion 81*a* of the drive transmission member 81 is improved, and therefore, the width of the gear portion 30*a* of the developing roller gear 30 can be made small. It is possible to downsize the cartridge B and the apparatus main assembly A to which the cartridge B is mounted can be downsized.

In summary of this embodiment, the gear portion 81*a* of the drive transmission member 81 and the gear portion 30*a* of the developing roller gear 30 have helical teeth. The helix teeth have higher contact ratios of the gears than a spur gear. By this, the rotation accuracy of the developing roller 30 is improved, and the developing roller 30 rotates smoothly.

In addition, the direction in which the helical teeth of the gear portion 30*a* and the gear portion 81*a* are twisted is determined so that the force (force FA and force FB) that the gear portion 30*a* and the gear portion 81*a* are attracted to each other is produced. That is, when the gear portion 30*a* and the gear portion 81*a* rotate in a state of meshing engagement, the force of attracting the coupling recess 81*b* provided on the drive transmission member 81 and the coupling projection 63*b* provided on the end portion of the photosensitive drum 62 to each other is produced. By this, the drive transmission member 81 moves toward the cartridge B side, and the coupling recess portion 81*b* approaches the coupling projection 63*b*. By this, the coupling (coupling) between the coupling recess 81*b* and the coupling projection 63*b* is assisted.

The drive transmission member 81 is urged toward the coupling projection 63*b* by the elastic member (drive transmission member spring 84) (part (a) of FIG. 7). According to this embodiment, the force of the drive transmission member spring 84 can be weakened correspondingly to the force FA and the force FC produced (part (b) of FIG. 13). Then, the frictional force between the drive transmission member spring 84 and the drive transmission member 81, which occurs when the drive transmission member 81 rotates, is also reduced, and therefore, the torque required to rotate the drive transmission member 81 decreases. The load applied to the motor for rotating the drive transmission member 81 can also be reduced. In addition, the sliding noise between the drive transmission member 81 and the drive transmission member spring 84 can also be reduced.

Here, in this embodiment, the drive transmission member 81 is urged by the elastic member (spring 84), but the elastic member is not necessarily required. If the gear portion 81*a* and the gear portion 30*a* at least partly overlap each other in the axial direction, and the gear portion 81*a* and the gear portion 30*a* mesh with each other when the cartridge B is mounted to the apparatus main assembly A, the elastic member can be eliminated. That is, in such a case, when the gear portion 81*a* rotates, a force for attracting the coupling projection 63*b* and the coupling recess portion 81*b* to each other is produced due to the engagement between the gear portion 81*a* and the gear portion 30*a*. That is, even if there is no elastic member (spring 84), the drive transmission member 81 approaches to the cartridge B due to the force generated by the meshing of the gears. By this, the coupling recess portion 81*b* can be engaged with the coupling projection 63*b*.

As described above, when no elastic member is provided, there is no frictional force between the elastic member and the drive transmission member 81, and therefore, the required rotational torque of the drive transmission member 81 is further reduced. In addition, it is possible to eliminate noise generated by sliding between the drive transmission member 81 and the elastic member. In addition, the number of portions of the image forming apparatus can be reduced, and therefore, it is possible to simplify the structure of the image forming apparatus and to reduce the cost.

Here, in this embodiment, the helical gear is used for the developing roller gear 30 engaged with the drive transmission member 81, but another gear may be used as long as drive transmission is possible. For example, a spur gear 230 which can enter a gap 81*e* between the teeth of the drive transmission member 81 is usable. The thickness of the spur tooth is 1 mm or less. In this case also, the gear portion 81*a* of the drive transmission member 81 has helical teeth, and therefore, a force for directing the drive transmitting member 81 toward the non-driving side is produced by engagement between the gear portion 81*a* and the spur gear 230 (FIG. 19).

In addition, the member which applies the load of the developing roller to the gear portion 81*a* of the drive transmission member 81 may not be the developing roller gear.

FIG. 20 discloses a drive input gear 88 that meshes with the drive transmission member 81, a developing roller gear 80 provided on the developing roller, idler gears 101 and 102, and a feeding gear (stirring gear, developer feeding gear) 103.

In FIG. 20, the driving force is transmitted from the drive input gear 88 to the developing roller gear 80 by way of one idler gear 101. The idler gear 101 and the developing roller gear 80 constitutes a drive transmission mechanism (a cartridge side drive transmission mechanism, a development side drive transmission mechanism) for transmitting a driving force from the drive input gear 88 to the developing roller 32.

On the other hand, the idler gear 102 is a gear which transmits the driving force from the drive input gear 88 to the stirring gear 103. The feeding gear 103 is mounted on the feeding member 43 (FIG. 3), and the feeding member 43 is rotated by the driving force received by the feeding gear 103.

In addition, the load applied to the gear portion 81*a* of the drive transmission member 81 may not be the load of the developing roller. For example, as shown in FIG. 21, it is also possible to employ such a structure that the driving force received by the drive input gear 88 is transmitted to only the feeding member 43 (FIG. 3) by way of the idler gear 102 without being transmitted to the developing roller 32. However, when such a structure is employed for the cartridge including the developing roller 32, it is necessary to separately transmit the driving force to the developing roller 32. In this case, the cartridge B needs a gear 162*a* and the like for transmitting the driving force from the drum 62 to the developing roller gear 30.

In addition, in this embodiment, as a means for aligning the center of the drive transmission member 81 with the center of the drum 62, the triangle-shaped centering action of the coupling projection 63*b* and the coupling recess portion 81*b* is utilized.

However, as shown in part (a) of FIG. 22 and part (b) of FIG. 22, a cylindrical boss (projection) 363*b* may be provided on one of the drive transmission member 381 and the drive-side drum flange 363 and a hole 381*b* to be fitted with the boss may be provided on the other of them. Even with such a structure, the axis of the drive transmission member 381 and the axis of the drum 62 can be aligned.

In addition, in this embodiment, the alignment of the drive transmission member 81 is effected in a triangular shape of the coupling projection and recess portions 81*b*, 63*b*, but may be effected by other shapes. Referring to FIG. 23, a modified example will be shown. The drive transmission member 181 shown in FIG. 23 has a projection (boss) 181*c* at the center of the coupling recess 181*b*. The projection 181*c* is arranged so as to overlap with the axis of the drive transmission member 181 and is a projection projecting along its axis. On the other hand, the coupling projection shown in FIG. 23 has a recess (recess) for engaging with the projection 181*c* at the center thereof. The recess is arranged so as to overlap with the rotation axis of the drum 62 and is a hollow recessed along this axis. By making the drive transmission member 181 and the photosensitive drum coaxial with each other, the accuracy of the center-to-center distance (distance between the axes) between the gear portion 181*a* and the gear portion 30*a* can be easily maintained, and the driving force is stably transmitted to the developing roller gear 30.

In this embodiment, the drum 62 is driven by the engagement of the drive transmission member 81 and the coupling projection 63*b*. However, as shown in part (b) of FIG. 24, the driving of the drum 62 can be accomplished through the gears 330*b*, 95*b* provided inside the cartridge. In the structure shown in part (a) of FIG. 24 and part (b) of FIG. 24, the developing roller gear 330 is provided with not only the gear portion (input gear portion) 330*a* for receiving drive from the gear portion 81*a* of the drive transmission member 81 but also a gear portion 330*b* (output gear portion) for outputting driving force toward the drum 62. In addition, the drum flange 95 fixed to the end of the drum 62 does not have a coupling projection. Instead, it has a gear portion 95*b* (input gear portion) for receiving a driving force from the gear portion 330*b*. Further, the drum flange 95 has a cylindrical portion 95*a*. In this case, the cylindrical portion 95*a* provided at the end portion of the drum 62 is engaged with the coupling recess portion 81*b* provided at the free end of the drive transmission member 81, thereby functioning as the positioning of the drive transmission member 81. The recessed portion 81*b* and the cylindrical portion 95*a* function as an alignment portion for aligning the axis of the drive transmission member 81 and the axis of the drum 62. When the coupling recess 81*b* and the cylindrical portion 95*a* are engaged with each other, the axes of the drum 62 and the drive transmission member 81 are substantially overlapped and they are coaxially arranged. That is, they are aligned.

FIG. 25 shows a modified example of such a shape of the alignment portion. FIG. 25 shows a state in which a cylindrical portion 95*a* is provided on the drum flange 63.

In the first modification shown in FIG. 25, the shape of the alignment portion 195*b* constitutes only a part of a circle. If the arc portion 195*c* of the alignment portion 195*b* is sufficiently larger than the arc shape of the lightening portion 81*b*3 (FIG. 13), the alignment portion 195*b* has a centering action.

Both structures can be regarded as aligning portions that are substantially coaxial with the drum. That is, each of the alignment portions 95*a*, 195*b*, 295*c* is disposed so as to be centered on the axis of the drum. In addition, in this embodiment, the coupling projection 63*b* is fixed to the drum 62, but it is also possible to provide a movable coupling projection. For example, the coupling 263*b* shown in FIG. 26 is movable in the axial direction with respect to the drum 62, and is biased by a spring 94 toward the driving side in a state in which no external force is applied. When mounting the cartridge B in the main assembly A, the end portion 263*a* of the coupling 263*b* contacts the drive transmission member 81. The coupling projection 263*b* can retract toward the non-drive side (away from the drive transmission member 81) while contracting the spring 94, by the force received from the drive transmission member 81. With such a structure, it is not absolutely necessary to retract the drive transmission member 81 to the extent that it does not contact the coupling projection 263*b*. That is, correspondingly to the amount of retraction of the coupling projection 263*b*, an amount of retraction of the drive transmission member 81 interrelated with the opening of the opening/closing door 13 (FIG. 2) can be reduced. That is, the main assembly A of the device can be downsized. Here, the end portion 263*a* of the coupling projection 263*b* is an inclined portion (inclined surface, chamfered surface). With such a structure, when the end portion 263*a* comes into contact with the drive transmission member 81 at the time of mounting and dismounting the cartridge, the end portion 263*a* tends to receive a force for retracting the coupling projection 263*b*. However, the present invention is not limited to such a structure. For example, the contact portion on the drive transmission member 81 side contacting the coupling projection 263*b* may be inclined.

In addition, in the structure shown in FIG. 24, the cylindrical portion 95*a* is provided on the drum 62. However, as shown in FIG. 27, the alignment portion such as the cylindrical portion 95*a* may be provided on the frame (more particularly, the drum bearing 73) of the cleaning unit 60. More specifically, an arcuate projection 173*a* for contacting with the periphery of the cylindrical portion 81*i* is provided on the drum bearing 173. In this modified example, the projection 173*a* is engaged with the cylindrical portion 81*i* so as to correspond to the alignment portion for aligning the drive transmission member 81. More strictly, the inner circumferential surface of the projection 173*a* facing the axis side of the drum (in other words, facing the radially inward of the drum) is the alignment portion. The center of the aligning portion is arranged so as to overlap the axis of the drum. That is, the projection 173*a* is disposed so as to be substantially coaxial with the drum. In addition, a taper (inclined portion) is provided at the edge of the free end of the projection 173*a* so that when the free end of the projection 173*a* abuts to the cylindrical portion 81*i*, the cylindrical portion 81*i* can be easily guided into an internal space of the projection 173*a*.

<Coupling Engagement Condition>

Referring to parts (a) of FIGS. 1, 9 and 13, parts (a) of FIGS. 17 and 28, part (b) of FIG. 28 and part (c) of FIG. 28, the conditions for the couplings to engage will be described in detail. Part (a) of FIG. 28 is a cross-sectional view of the image forming apparatus drive portion as viewed from the driving side for explaining the gap of the coupling section. Part (b) of FIG. 28 is a cross-sectional view of the image forming apparatus driving portion as viewed from the drive side for explaining the gap of the coupling portion. Part (c) of FIG. 28 is a sectional view illustrating the meshing force.

As shown in parts (a) of FIG. 1 and FIG. 28, and part (b) of Figure, the drum bearing 73 has a restricting portion 73*j*, as an inclination restricting regulating portion (movement regulating portion, position regulating portion, stopper) for regulating (suppressing) the inclination of the drive transmission member 81 by regulating the movement of the drive transmission member 81.

The drive transmitting member 81 has a cylindrical portion 81*i* (part (b) of FIG. 28) on the non-driving side (the side closer to the cartridge B). The cylindrical portion 81*i* is a cylindrical portion (projection) in which the coupling recess 81*b* is formed (part (a) of FIG. 13).

As described above, the gear portion 81*a* of the drive transmission member 81 and the gear portion 30*a* of the developing roller gear 30 mesh with each other as shown in FIG. 9 when the drive transmission member 81 starts to rotate. On the other hand, the coupling recess 81*b* and the coupling projection 63*b* are not coupled, or the coupling therebetween is insufficient. Therefore, when the gear portion 81*a* transmits the driving force to the gear portion 30*a*, the meshing force FD (part (a) of FIG. 28) is generated in the gear portion 81*a* due to the engagement between the gears.

When this meshing force FD is applied to the drive transmission member 81, the drive transmission member 81 is inclined (part (c) of FIG. 28). That is, the drive transmission member 81 is supported only by the fixed end 81*c* (end portion on the side remote from the cartridge B in part (b) of FIG. 7) which is the end portion on the drive side as described above, and therefore, the drive transmission member 81 is inclined with the drive side end portion 81*c* (fixed end) as a fulcrum. Then, the end (free end, free end) of the drive transmission member 81 on the side where the coupling recess 81*b* is provided moves.

If the drive transmission member 81 is greatly inclined, the coupling recess 81*b* cannot be coupled with the coupling projection 63*b*. In order to avoid this, the restricting portion 73*j* is provided in the cartridge B, so that the inclination of the drive transmitting member 81 is restricted (regulated) within a certain range. That is, when the drive transmission member 81 is inclined, the restriction portion 73*j* supports the drive transmission member 81, thereby suppressing increase of the inclination.

The regulating portion 73*j* of the drum bearing 73 is an arcuate curved surface portion arranged so as to face the axis of the drum 62 (the axis of the coupling projection 63*b*). The restricting portion 73*j* can be regarded as a projecting portion projecting so as to cover the drum axis. The structure is such that between the regulating portion 73*j* and the drum axis is a space in which no constituent element of the process cartridge B is provided, and the drive transmission member 81 is disposed in this space. The regulating portion 73*j* faces the space 87 shown in FIG. 1, and the regulating portion 73*j* forms the edge (outer edge) of the space 87.

The restricting portion 73*j* is disposed at a position where it is possible to suppress the movement (inclination) of the drive transmission member 81 by the meshing force FD.

As shown in part (a) of FIG. 28, the direction in which the meshing force FD is generated is determined by the transverse pressure angle $\alpha$ of the gear portion 81*a* (that is, the transverse pressure angle $\alpha$ of the developing roller gear 30). The direction in which the meshing force FD is generated is inclined by $(90+\alpha)$ degrees toward the upstream AK in the rotating direction of the photosensitive drum 62, with respect to an arrow (half line) LN extending from the center 62*a* of the photosensitive drum (that is, the center of the drive transmission member 81) toward the center 30*b* of the developing roller gear 30.

Here, it is not always necessary that the restricting portion 73*j* is disposed on this line FDa, and it will suffice if the restricting portion 73*j* is disposed close to the half line FDa. More specifically, it is desirable that at least a portion of the regulating portion 73*j* is disposed somewhere in the range of plus or minus 15° with respect to the half line FDa. The half line FDa is a line obtained by rotating the half straight line LN to the upstream side in the rotational direction of the $(90+\alpha)$ degree drum 62. Therefore, the regulating portion 73*j* is preferably in the range of $(75+\alpha)$ degrees to $(105+\alpha)$ degrees on the upstream side in the drum rotational direction relative to the half straight line LN with the center of the drum 62 as the origin.

In addition, in another example of the preferable arrangement of the restricting portion 73*j*, a plurality of restricting portions 73*j* may be disposed separately on both sides of the half line FDa so as to sandwich the half straight line FDa therebetween (FIG. 29). In this case, too, the restricting portion 73*j* can be regarded as being arranged across the line FDa.

In addition, it is preferable that //the regulating portion 73*j* is disposed on the upstream side AO (FIG. 16) in the cartridge mounting direction C (part (a) of FIG. 11) with respect to the center (axis) of the coupling projection 63*b*. This is to prevent the restriction portion 73*j* from hindering the mounting of the cartridge B.

In order for the coupling to engage even if the drive transmission member 81 is inclined by the gap AA and the misalignment of amount AB occurs between the couplings, it will suffice if the shortest gap V between the couplings satisfies the following.

$$V>AB$$

That is, if the misalignment amount AB is further smaller than the shortest gap V between the coupling projection 63*b* and the coupling recess portion 81*b*, the coupling projection 63*b* and the coupling recess 81*b* can allow the misalignment amount AB, and therefore, they are engaged with each other.

Here, if the phase of the coupling recess portion 81*b* with respect to the coupling projection 63*b* changes, the shortest gap V between the coupling portions also changes. That is, if the phases of the coupling portions are not matched, the shortest gap V between the coupling projection 63*b* and the coupling recess 81*b* is smaller than the misalignment amount AB.

However, if there is at least one phase relationship that satisfies "V>AB" between the two coupling portions, the coupling projection 63*b* and the coupling recess portion 81*b* are engaged. This is because the coupling recess 81*b* contacts the coupling projection 63*b* while rotating. It can be engaged (coupled) with the coupling projection 63*b* at the timing when the coupling recess 81*b* has rotated to such an angle as to satisfy "V>AB".

Therefore, even if the drive transmission member 81 is inclined by the meshing force, the coupling can be engaged, since the gap V between the couplings is larger than the misalignment AB between the coupling portions.

In addition, it is necessary that the regulating portion 73*j* and the tooth tips of the drive transmission member 81*a* do not come into contact with each other during image formation. That is, the distance BB from the center of the drum 62 to the restricting portion 73*j* (the distance spaced in the direction perpendicular to the axis of the drum) needs to be longer than the radius BF to the tooth free end of the gear portion 81*a* of the drive transmission member 81. From the above analysis, $$BB>BF$$

is to be satisfied.

Here, in this embodiment, the restricting portion 73*j* is formed as a continuous surface. More specifically, the regulating portion 73*j* is a continuous curved surface (arcuate surface) which is opened toward the axis of the drum 62 and is curved in a bow shape. In other words, it has a bay shape (bay portion) opened to the axis side of the drum 62.

However, as shown in the illustrations of the cartridge of part (a) of FIG. 29 and part (b) of FIG. 29, the restricting portion 89*j* may be formed by a plurality of portions (plural surfaces 89*j*) intermittent in the rotational direction of the drum 62. In this case, too, by connecting a plurality of intermittent portions, the regulating portion can be regarded as forming a bay shape (bay portion) which opens to the axis side of the drum 62.

That is, although there is a difference between the restriction portions in whether it is one continuous portion or a plurality of intermittent portions, the regulating portion shown in FIG. 1 and the regulating portion shown in FIG. 29 both have a bow shape (a bay shape, a curved surface portion, a curved portion) which opens to the axis side of the drum 62.

<Modification of Supporting Configuration of Drive Transmission Member>

As described above, the drive transmission member 81 has the gear portion 81*a* and the coupling recess 81*b* on the free end side thereof. And, the drive transmission member 81 is movable forward and backward and can be inclined (inclinable). It is preferable that when the drive transmitting member 81 rotates and advances toward the cartridge side to engage the coupling recess 81*b* with the coupling projection 63*b*, the inclination angle of the drive transmission member 81 with respect to the drum 62 is made small. Therefore, as described above, the regulating portion 73*j* is provided in the cartridge to suppress the inclination angle of the drive transmission member 81 when the drive transmission member 81 is driven.

On the other hand, in order to remove the cartridge from the main assembly of the apparatus, it is necessary to release the meshing engagement of the gear portion 81*a* of the drive transmission member 81 with the gear portion 30*a* of the developing roller gear 30. In order to smoothly release this engagement, it is desirable that the drive transmission member 81 can be inclined so that the gear portion 81*a* can be dismounted from the gear portion 30*a*. Therefore, if the drive transmission member 81 itself is supported so as to be smoothly inclinable, the removal operation of the cartridge becomes further smooth.

In order to incline the drive transmission member 81 to separate the gear portion 81*a* from the gear portion 30*a*, it is preferable that the drive transmission member 81 is inclined so as not to contact with the restriction portion 73*j* at the time of dismounting the cartridge.

In addition, it is necessary to make it easy to incline the drive transmitting member 81 in order to release the meshing engagement between the gears, whereas it is necessary for the gear portion 81*a* of the drive transmission member 81 to reliably establish the meshing engagement with the gear portion 30*a* of the developing roller gear 30 when mounting the cartridge. That is, when mounting the cartridge, it is desirable to hold the drive transmission member 81 at a predetermined inclination angle so that the engagement between the gears is reliably carried out.

Based on these factors, a modified example of this embodiment will be described below. In this modified example, while supporting the drive transmission member 81 so that the drive transmission member 81 is inclined more easily, the drive transmission member 81 is inclined to a suitable attitude and angle respectively when mounting or dismounting the cartridge.

Referring first to part (a) of FIG. 30, part (b) of FIG. 30, part (a) of FIG. 31, parts (a) and (b) of FIG. 32), a supporting structure for the drive transmission member 81 will be described. Part (a) of FIG. 30 is a perspective view illustrating the supporting structure of the drive transmission member. Part (b) of FIG. 30 is a sectional view in the axial direction around the drive transmission member for illustrating the support structure of the drive transmission member when the driving force is applied. Part (c) of FIG. 30 is a sectional view in the axial direction for illustrating the support structure around the drive transmission member when no driving force is applied. FIG. 31 is a perspective view illustrating the shape of the first bearing. Part (a) of FIG. 32 is a perspective view as viewed from the drive side for illustrating the support structure of the drive side around the drive transmission member. Part (b) of FIG. 32 is a sectional view taken along a direction perpendicular to the axis for illustrating the supporting structure of the drive side around the drive transmission member. Part (c) of FIG. 32 is a sectional view taken along the direction perpendicular to the axis for illustrating the supporting structure on the non-drive side around the drive transmission member.

First, the rear end side (fixed end side, drive side) of the drive transmission member 81 will be described.

As shown in part (a) of FIG. 30 and part (b) of FIG. 30, a second side plate 93 supports a first bearing 94. In addition, the first bearing 94 supports the outer diameter portion of a second bearing 95 at its inner diameter portion. A gap is provided between the first bearing 94 and the second bearing 95, and the first bearing 94 supports the second bearing 95 so that the second bearing 95 can incline. Therefore, the second bearing 95 is supported by the second side plate 93 so as to be inclinable. In the following, more detailed explanation will be made.

A second side plate (second driving side plate) 93 is provided on the driving side of the apparatus main assembly A. The second side plate 93 is a sheet metal (plate-like metal), and a hole portion 93*a* is provided by drawing this sheet metal. The second bearing 95 and the first bearing 94 for supporting the second bearing 95 are fitted in the hole portion 93*a* of the second side plate 93. And, the drive transmission member 81 is rotatably supported by the second bearing 95. That is, the rear end side of the drive transmission member 81 is supported by the first bearing 94 by way of the second bearing 95. The first bearing 94 is a bearing support portion (support portion) for supporting the second bearing 95.

There is a play (gap) between the first bearing 94 and the second bearing 95. In this embodiment, it is about 0.2 mm. As shown in part (c) of FIG. 30, by this play, the drive transmission member 81 can be inclined.

That is, in this modified example, in place of providing the bearing 83 (FIG. 17) described above in the hole portion 93*a*, two first bearings 94 and two second bearings 95 are provided in the hole portion 93*a* to support the drive transmission member 81. In this modified example, by using the two bearings 94, 95 fitted with a gap provided between them, one of them can incline largely (inclinable) with respect to the other, so that the drive transmission member 81 can be more smoothly inclined.

As shown in FIG. 31, a V-shaped portion 94*a* is provided on the inner periphery of the first bearing 94. The V-shaped portion 94*a* is constituted by two projecting portions (projecting portions) projecting from the inner peripheral portion of the first bearing 94. The two projecting portions form a V shape, and therefore, these are collectively referred to as V-shaped portion 94*a*.

As described above, there is a gap between the first bearing 94 and the second bearing 95 to make the second bearing 95 inclinable relative to the first bearing 94. However, when the drive transmission member 81 transmits the drive to the cartridge (FIG. 17), it is necessary to align the axis of the drive transmission member 81 and the axis of the photosensitive drum 62 with each other. That is, when the drive transmission member 81 is driven, the second bearing 95 needs to be accurately supported by the first bearing 94 without being inclined with respect to the first bearing 94. When the drive transmission member 81 is driven, the second bearing 95 is held in a substantially horizontal state by bring the second bearing 95 into contact with a V-shaped portion 94*a* provided by two projecting portions (projecting portions), and by this second bearing 95, the drive transmission member 81 is accurately supported in a substantially horizontal state. The V-shaped portion 94*a* is an attitude determining portion (attitude holding portion) for keeping the attitude of the drive transmission member 81.

In order to determine the phase of the first bearing 94 (that is, to prevent the first bearing 94 from rotating within the main assembly of the apparatus), the first bearing 94 is provided with a hole 94*b* as a rotation stopper. On the other hand, the second side plate 93 is provided with a projection 93*b*. By fitting the hole 94*b* and the projection 93*b* with each other, the phase of the first bearing 94 is fixed. That is, the first bearing 94 is fixed so as not to rotate relative to the second side plate 93. In addition, the phase of the V-shaped portion 94*a* provided in the first bearing 94 is also fixed.

In addition, the second side plate 93 is provided with three holes 93*e* around the hole 93*g*. The downstream side of each hole 93*e* in the rotational direction of the drive transmission member 81 has a width in the radial direction smaller than the width on the upstream side. On the other hand, a leg portion 95*a* is provided on the outer peripheral surface of the second bearing 95. The leg portion 95*a* extends outward in the radial direction from the bearing 95, the free end side thereof is bent and extends along the axial direction toward the non-driving side, and the extreme free end portion further bends and extends radially outward. That is, the leg portion 95*a* is bent into a crank shape. Three such legs 95*a* are provided at positions corresponding to the three holes 93*e*, respectively. The three leg portions 95*a* of the second bearing 95 are inserted into the wide area the three hole portions 93*e* of the second side plate 93. Thereafter, when the second bearing 95 is rotated with respect to the second side plate 93 in the rotational direction of the drive transmission member 81, the three leg portions 95*a* enter the area where the width of the hole portion 93*e* is narrowed, the free end portions 95*a* of the leg portion 95*a* is locked to the second side plate 93. Here, as described above, the free end of the foot portion 95*a* is bent in a crank shape and extends toward the outside in the radial direction. Therefore, the free end of the leg portion 95*a* contacts the second side plate 93, whereby the movement of the second bearing 95 in the axial direction is restricted. That is, the second bearing 95 is fixed in the axial direction. Meanwhile, the play is provided between the leg portion 95*a* of the second bearing 95 and the hole portion 93*e* of the second side plate 93, and therefore, the second bearing 95 can be inclined with respect to the second side plate 93 within the range of this gap.

The second bearing 95 has a boss portion 95*b*, and a fixed end side thereof extends in the radial direction from the outer peripheral surface, and a free end side thereof bends with respect to the fixed end side and extends toward the non-driving side along the axial direction. This is the rotation stopper of the second bearing 95. The second side plate 93 is provided with a hole portion 93*f* as a rotation stopper at a position corresponding to the boss portion 95*b*. When the boss portion 95*b* enters the hole portion 93*f*, the rotation of the second bearing 95 relative to the second side plate 93 is restricted. That is, the second bearing 95 is fixed in the rotational direction.

As shown in part (a) of FIG. 32, the second side plate 93 is provided with the drive idler gear (gear member) 96 for transmitting drive from a motor (not shown) to the drive transmission member 81. As shown in FIG. 31, the V-shaped portion 94*a* is provided near the center in the axial direction of the first bearing 94 and is provided in the neighborhood of the second gear portion 81*j* of the drive transmission member 81 in the axial direction. The second bearing 95 (the drive transmission member 91) is inclined with the V-shaped portion 94*a* as a fulcrum. Therefore, the inclination fulcrum of the drive transmission member 81 and the second gear portion 81*j* of the drive transmission member 81 are positioned close to each other in the axial direction.

It is possible to reduce changes in the axial distance between the drive idler gear 96 and the second gear portion 81*j* of the drive transmission member 81 and the alignment deviation of the tooth trace when the drive transmission member 81 is inclined. By this, it is possible to stabilize the engagement of the gear at the start of the driving.

Here, when the axial length HB of the V-shaped portion 94*a* is long, it is necessary to increase the play between the first bearing 94 and the second bearing 95, for the drive transmission member 81 to incline, and therefore, the influence on gear meshing increases. Considering the balance with the gear engagement, it is preferable that the V-shaped portion 94*a* has a small length HB in the axial direction, and in this embodiment, it is about 0.5 mm in this embodiment.

As shown in part (a) of FIG. 32, the phase of the V-shaped portion 94*a* is located at a position where the drive transmission member 81 can be stably held, when the meshing force CG (part (a) in FIG. 32) is produced by the meshing engaging between the idler gear 96 and the second gear portion 81*j* of the drive transmission member 81. That is, when the drive transmission member 81 receives the meshing force CG, the second bearing 95 supporting the drive transmission member 81 tends to move in the direction of the meshing force CG. By disposing the V-shaped portion 94*a* on the downstream side in the CG direction, the second bearing 95 is abutted against the V-shaped portion 94*a* of the first bearing 94. By this, the second bearing 95 is stably held by the first bearing 94, and the drive transmission member 81 is also stably held via the second bearing 95. In addition, the position in the radial direction of the V-shaped portion 94*a* is such that when the second bearing 95 abuts against the V-shaped portion 94*a*, the inter-axis distance between the drive idler gear 96 and the second gear portion 81*j* of the drive transmission member 81 is proper. That is, the drive transmission member 81 is held at a position where the idler gear 96 and the drive transmission member 81 can mesh with each other.

By this, when the drive is not applied, the drive transmission member 81 can incline within the play by gravity with the V-shaped portion 94*a* as a fulcrum. In addition, when driving is applied, the second bearing 95 is urged to the V-shaped portion 94*a* by the meshing force of the drive transmission member 81, so that the drive transmission member 81 takes the first attitude in which the distance between the second gear portion 81*j* and the drive idler gear 96 is accurately determined. By this, it is possible to transmit rotational force with high accuracy.

Next, the front end side (free end side, non-driving side) of the drive transmission member 81 will be described.

As shown in part (b) of FIG. 30, the drive transmission member 81 is supported together with a play between the drive transmission member 81 and the hole portion 15*k* by a hole portion 15*k* provided in the first side plate (first drive side plate) 15. By this, as shown in part (c) of FIG. 30, the drive transmission member 81 can take the second attitude in which the axis thereof is inclined.

In addition, as shown in part (b) of FIG. 32, the hole portion 15*k* of the first side plate 15 is provided with a V-shaped portion 15*m* as a bearing (holding portion) of the drive transmission member 81 when the cartridge B is not mounted. The V-shaped portion 15*m* is disposed below the hole portion 15*k* of the first side plate 15. It is to support the drive transmission member 81 which is inclined by the gravity. However, the V-shaped portion 15*m* is not disposed at the lowermost portion of the hole portion 15*k* in the gravitational direction (vertical direction) CN, and the drive transmission member 81 is inclined in a direction different from the direction of gravity, by being held in the V-shaped portion 15*m*. In the part (b) of FIG. 32, the drive transmission member 81 is held by the V-shaped portion 15*m* so that the free end side thereof is inclined in the direction toward the lower right part.

That is, as is different from simply inclining the free end side of the drive transmission member 81 in the direction of the gravity, but it is inclined in a direction different from the direction of the gravity, such that the drive transmission member 81 is held in a state in which the gear portion 81*a* can make meshing engagement with the gear portion 30*a* of the developing roller.

More specifically, the phase of the V-shaped portion 15*m* is determined so as to place the center of the first gear portion 81*a* of the drive transmission member 81 in a predetermined range when the drive transmission member 81 abuts against the V-shaped portion 15*m*. That is, the V-shaped portion 15*m* is provided such that the center of the first gear portion 81*a* is placed on an arc CI having a radius CH equal to the distance between the center of the developing roller 32 and the center of the drum 62 around the developing roller 32. In this embodiment, the play of the drive transmitting member 81 and the hole portion 15*k* of the side plate 15 other than the V-shaped receiving portion 15*m* is about 1 mm at the time of image formation. By this, the drive transmission member 81 abuts against the V-shaped portion 15*m* by its own weight in a state where no driving is applied, and the distance between the developing roller gear 30 and the gear portion 81*a* of the drive transmission member 81 is appropriately set. When the drive is started to be inputted to the drive transmission member 81 in a state in which the cartridge is mounted in the apparatus main assembly, the drive transmission member 81 can stably make the meshing engagement with the developing roller gear 30.

Here, in the present modification, the drive transmission member 81 is inclined by using the own weight of the drive transmission member 81 and placed at a predetermined position. However, as shown in FIG. 33, the drive transmission member 81 may be urged toward the V-shaped portion 15*m* side by a spring 97. By this, it is possible to place the gear portion 81*a* of the drive transmission member 81 at a predetermined position more reliably. The spring 97 is an inclination imparting portion (urging member, elastic member) that inclines the drive transmission member 81 by applying a force to the drive transmission member 81 to urge it.

The drive transmission member 81 urged by the spring 97 is supported by the V-shaped portion 15*m*, whereby the drive transmission member 81 is held at the predetermined inclination angle. Not only the V-shaped portion 15*m* but also the spring 97 can be regarded as a holding portion for holding the drive transmission member 81 in an inclined state in a predetermined direction. In this case, one of the V-shaped portion 15*m* and the spring 97 may be referred to as first holding portion and second holding portion, respectively. The V-shaped portion 15*m* and the spring 97 may be collectively referred to as a holding portion in some cases.

<Removal of Cartridge in Modified Example>

Referring to part (a) of FIG. 6, part (b) of FIG. 6, part (c) of FIG. 6, FIG. 7, parts (b) of FIG. 30, part (c) of FIG. 30, parts (b) and (c) of FIG. 34, the operation from the closed state to the open state of the opening/closing door 13 of the apparatus main assembly A will be described.

Part (a) of FIG. 34 is a sectional view perpendicular to the axis concerning the structure of the periphery of the drive transmission member, and shows a cross-section as viewed from the drive side in a state where the drive transmission member is in the retracted position. Part (b) of FIG. 34 is a sectional view illustrating a state in which the driving member is in the driving position (advanced position). Part (c) of FIG. 34 is a sectional view as viewed from the drive side for explaining the movement of the drive transmission member when removing the cartridge out.

First, referring to part (a) of FIG. 6, part (b) of FIG. 6, part (c) of FIG. 6 and part (a) of FIG. 7, the description will be made the states until engagement of the coupling is removed. When the opening/closing door 13 is rotated and opened, the cylindrical cam 86 rotates by way of the rotating cam link 85, and the inclined surface portions 86*a*, 86*b* of the cylindrical cam 86 contact the inclined surface portions 15*d*, 15*e*. Further, as the opening/closing door 13 is opened, the inclined surface portions 86*a* and 86*b* slide along the inclined surface portions 15*d* and 15*e*, by which the cylindrical cam 86 moves to the driving side CO (part (b) of FIG. 7). By this movement, the coupling projections 63*b*, 81*b* are disengaged. When opening the opening/closing door 13, the coupling projection 63*b* and the recess portion 81*b* disengages.

Next, the description will be made as to the operation until the cartridge B is pulled out after the disengagement of the coupling.

As shown in FIG. 30B, the second side plate 93 is provided with a projection 93*c* extending toward the non-driving side at a position opposed to a portion having a smaller diameter than the tooth bottom portion of the second gear portion 81*j* of the drive transmission member 81. This projection 93*c* has a height HH enough to contact with the drive transmission member 81 when the opening/closing door 13 is opened and the drive transmission member 81 retracts to leave the cartridge (see part (c) of FIG. 30). In this embodiment, the height HH is about 2.1 mm. In addition, the projection 93*c* is provided on the second side plate 93 in the regulating portion 73*j* (FIG. 8) side with respect to the center of the drive transmitting member 81. Furthermore, the second side plate 93 is provided with a recessed portion 93*d* as a relief portion (withdrawal portion) so as not to obstruct the inclination of the drive transmission member 81 when the drive transmission member 81 abuts against the projection 93*c* in the opposite phase to the projection (projection, projecting portion) 93*c*. By this, by further opening the opening/closing door 13 after the engagement of the coupling is released, the rotation of the cylindrical cam 86 causes the drive transmission member 81 to move to the drive side and come into contact with the projection 93*c* (part (c) of FIGS. 7 and 30). By this, the gear portion 81*a* of the drive transmission member 81 can be inclined in a direction opposite to the projection 93*c*, that is, in a direction away from the restricting portion 73*j*. In this embodiment, it is inclined at about 3.9° and takes the second attitude. The projection 93*c* is an inclination imparting portion (contact portion) which contacts with the drive transmission member 81 and inclines the drive transmission member 81 when the drive transmission member 81 retracts away from the cartridge. The projection 93*c* is also a projecting portion projecting toward the drive transmission member 81.

In the following, the conditions required for the structure of the projection 93*c* will be described in more detail.

As shown in part (c) of FIG. 34, when taking the cartridge B out of the apparatus main assembly A, it is necessary that the gear portion 81*a* of the drive transmission member 81 and the gear portion 30*a* of the developing roller gear 30 are disengaged from each other. However, as shown in part (b) of FIG. 34, when the drive transmission member 81 is in the drive position (advanced position) (when the coupling recess 81*b* of the drive transmission member 81 is engaged with the coupling projection 63*a*), the restricting portion 73*j* is close to the drive transmission member 81. When the drive transmission member 81 moves in the direction of the arrow CK in an attempt to separate the gear 81*a* from the gear portion 30*a* in a state where the drive transmission member 81 is kept close to the restricting portion 73*j*, the drive transmission member 81 results in contacting the restricting portion 73*j*. Then, it may be difficult to smoothly release the meshing engagement between the gear portion 81*a* and the gear portion 30*a*.

There, in this modified example, when moving the drive transmission member 81 to the retracted position (when disengaging the coupling recess 81*b* from the coupling projection 63*a*), the projection 93*c* inclines the drive transmitting member 81 so as to move away from the restricting portion 73*j*. This state is shown in part (a) of FIG. 34. The solid line shows the state where the drive transmission member 81 is in the retracted position, and the broken line shows the state where the drive transmission member 81 is in the drive position (advanced position). It can be seen that the distance between the drive transmitting member 81 and the regulating portion 73*j* is widened as the drive transmitting member 81 moves from the driving position to the retracted position.

Therefore, in order to remove the cartridge, the drive transmission member 81 engaged with the gear portion 30*a* can move in the direction of the arrow CK away from the gear portion 30*a* by the force received from the gear portion 30*a* without contacting the regulating portion 73*j*. Then, as shown in part (c) of FIG. 34, the engagement between the gear portion 81*a* and the gear portion 30*a* is released, and the cartridge can be removed.

As described above, in order to release the meshing engagement between the gear portion 81*a* and the gear portion 30*a* without contact between the drive transmission member 81 and the regulating portion 73*j*, the following conditions are required.

It is necessary that the amount of engagement AH (part (b) of FIG. 34) between the gear portion 81*a* of the drive transmission member 81 and the gear 30*a* of the developing roller gear 30 is smaller than the distance (gap) CL (part (a) in FIG. 34) between the gear portion 81*a* of the drive transmission member 81 and the regulating portion 73*j* when the cartridge is removed. Here, the distance CL is measured along the direction CK extending from the center of the drum 62 toward the center of the developing roller 32. The engagement amount AH is the distance measured along the radial direction of the gear portion 81*a*.

This is expressed by $$AH<CL$$

Here, when the drive transmission member 81 is in the drive position (part (b) of FIG. 34), the distance (gap) between the restricting portion 73*j* and the gear portion 81*a* of the drive transmission member 81 measured along the CK direction is CM. In addition, the increase in the gap due to the movement of the drive transmission member 81 from the drive position to the retracted position is CN (part (a) in FIG. 34).

Then, $$CL=CM+CN$$

Therefore, the above equation can be expressed as follows:

$$AH<CM+CN$$

This is modified as $$C>AH-CM$$

In this embodiment, AH is about 1.3 mm, CM is about 0.5 mm, CN is about 2.2 mm.

That is, it will suffice if the projection 93*c* moves the drive transmission member 81 beyond the distance CN which satisfies the above equation by inclining the drive transmission member 81.

By this, as shown in part (a) of FIG. 34, when the opening/closing door 13 is opened, the drive transmission member 81 abuts to the projection 93*c* of the second side plate 93 and is inclined. A gap CL where the drive transmission member 81 can move by a distance equal to or more than the radial engagement AH between the gear portion 81*a* of the drive transmission member 81 and the gear portion 30*a* of the developing roller gear 30 is generated. By this, when the cartridge B is removed out of the apparatus main assembly A, the engagement between the gears 81*a*, 30*a* is released smoothly. That is, it is possible to easily withdraw the cartridge B from the apparatus main assembly A.

Here, as another method of expanding the gap between the drive transmission member 81 and the regulating portion 73*j*, a method of increasing the play between the coupling projection portions 91*b*, 92*b* by reducing the diameter of the coupling projection 92*b* is conceivable. However, in such a case, there is a possibility that it is difficult to maintain the strength of the coupling projection 92*b*.

On the contrary, if the gap between the gear portion 30*a* of the developing roller gear 30 and the gear portion 81*a* of the drive transmission member 81 is widened by the method of this modification, there is no need to downsize the coupling projection 92*b*. Thus, it is possible to improve the operability at the time of withdrawing the cartridge B while maintaining the coupling strength.

Here, in this embodiment, the inclination of the drive transmission member 81 due to the meshing force of the drive before the coupling engagement is regulated for the gear portion 81*a* of the drive transmission member 81. However, the position of the drive transmission member to be restricted is not limited to this structure. For example, as shown in FIG. 35, the inclination of the outer peripheral surface 91*i* at the free end of the drive transmission member 91 may be regulated. Even when the restricted places are different, it is necessary to open the opening/closing door 13 to incline the drive transmission member 91 in a direction away from the developing roller gear 30, so that both of the rotation accuracy and the operability can be improved.

Here, in this embodiment, the drive transmission member 81 is inclined by abutting against the projection 93*c* of the second side plate 93, but it may be inclined by another method. For example, as shown in FIG. 36, a slope portion (inclined portion) 98*c* may be provided on the second side plate 98. At the non-driving side, the height of slope (inclined surface portion) 98*c* selected so that the regulating portion 73*j* (FIG. 8) side is higher. By this, the drive transmission member 81 abuts against the inclined surface portion 98*c* of the second side plate 98, and is inclined following the inclined surface portion 98*c*, so that the first gear portion 81*a* of the drive transmission member 81 is inclined in a direction away from the restricting portion 73*j*.

In FIG. 36, the upper portion of the inclined surface portion 98*c* corresponds to the projection (projecting portion) 93*c* illustrated in Part (c) of FIG. 30, and the lower portion of the inclined surface portion 98*c* corresponds to the relief (recessed portion) 93*d*. The inclined surface portion 98*c* is an inclination imparting portion (contact portion)

which contacts the retracting drive transmission member 81 and inclines the drive transmission member 81.

Furthermore, as shown in FIG. 37, an inclined surface portion 99*d* may be provided on the end surface on the driving side of a cylindrical cam 99, as shown in FIG. 37. The inclined surface portion 99*d* is provided on the driving side so that the height of the inclined surface portion 99*d* is lower on the regulating portion 73*j* side. By this, when the opening/closing door 13 is opened, the inclined surface portion 99*d* of the cylindrical cam 99 abuts against the drive transmission member 81, by which the drive transmission member 81 is inclined along the inclined surface portion 99*d*. By this, it is possible to improve operability while maintaining the coupling strength as described above.

In addition, as shown in FIG. 38, the projecting portion 93*c* may be provided on the second side plate 93 and the inclined surface portion 99*d* may be further provided on the cylindrical cam 99. The projection 93*c* of the second side plate 93 is provided such that the height of the inclined surface portion 99*d* on the non-driving side is larger on the regulating portion 73*j* side. The inclined surface portion 99*d* of the cylindrical cam 99 is provided on the drive side so that the height of the inclined surface portion 99*d* is lower on the regulation portion 73*j* side, and is an inclined surface portion 99*d* having an angle CM which is substantially the same as the line CL connecting the projection 93*c* of the second side plate 93 and the recess 93*d*. By this, when the opening/closing door 13 is opened, in the above example, the neighborhood of the projection 93*c* of the drive transmission member 81 is pushed by the cylindrical cam 99 to incline it. In contrast, in this example, the drive transmission member 81 can be pushed toward the non-drive side on the entire inclined surface portion 99*d* of the cylindrical cam 99, and the drive transmission member 81 can be inclined efficiently.

As described above, the inclination of the drive transmission member 81 in this modification is summarized as follows. The first transmission 94 and the second bearing 95 hold the drive transmission member 81 so that the drive transmission member 81 can be more smoothly inclined.

When the cartridge B is dismounted from the apparatus main assembly, the free end of the drive transmission member 81 is held by the V-shaped portion 15*m* or the drive transmission member 81 is urged by the spring 97, by which the drive transmission member 81 is inclined. This inclining direction is not the same as the direction of gravity. When the cartridge is mounted to the main assembly of the device, the drive transmission member 81 is held in an inclined attitude (second attitude: part (c) of FIG. 30) in which the gear portion 81*a* of the drive transmission member 81 can be smoothly brought into engagement with the gear portion 30*a* of the developing roller gear 30.

On the other hand, if the drive transmission member 81 is inclined as shown in part (c) of FIG. 30, the positions of the centers (rotation axes) of the coupling recess portion 81*b* of the drive transmission member 81 and the coupling projection 63*b* of the drive side drum flange 63 are offset as shown in part (b) of FIG. 32. If the centers (rotation axes) are significantly offset beyond the play between the couplings, the coupling recess portion 81*b* and the coupling projection 63*b* cannot engage with each other. By this, as shown in part (a) of FIG. 28 or part (b) of FIG. 28, the drive transmission member 81 is inclined in a pressure angle direction. Furthermore, the amount of misalignment AB between the coupling recess portion 81*b* of the drive transmission member 81 and the coupling projection 63*b* becomes smaller as the drive transmission member 81 abuts against the restricting portion 73*j*, and the coupling recess 81*b* and the coupling projection 63*b* can be engaged. That is, the angle formed by the axis of rotation of the coupling recess 81*b* and the axis of rotation of the coupling projection 63*b* is small enough to allow engagement of the coupling recess 81*b* and the coupling projection 63*b*.

And, as shown in part (b) of FIG. 13, due to the meshing engagement force FC in the thrust direction of the gear portion 81*a* of the drive transmission member 81, the drive transmission member 81 moves toward the drum 62 and the coupling is actually accomplished.

That is, the driving force transmitting member 81 is swung by the meshing engagement force of the gear with the cartridge B, and the inclination angle of the drive transmitting member 81 is regulated by the restricting portion 73*j* of the cartridge B. By this, even in the case of the apparatus main assembly A in which the drive transmitting member 81 is inclined, it is possible to reduce the misalignment between the couplings so that the two couplings can be properly engaged.

On the other hand, in the case that as the opening/closing door 13 is opened, the drive transmission member 81 is withdrawn so that and the coupling recess 81*a* disengages with the coupling projection 63*a*, the inclination imparting portion (projection or inclined portion) inclines the drive transmission member 81. This is because the drive transmitting member 81 is inclined so as to move away from the restricting portion 73*j* in order to separate the gear portion 81*a* of the drive transmission member 81 from the gear portion 30*a* of the developing roller gear 30. When the drive transmission member 81 moves so that the meshing engagement between the gears is released, it is possible to avoid the contact of the drive transmission member 81 with the regulating portion 73*j*. Or, even if the drive transmission member 81 comes into contact with the restricting portion 73*j*, it can be prevented to affect the removal of the cartridge.

The functions, materials, shapes and relative arrangements, etc. Of the constituent portions described in connection with this embodiment and each modification described above are not intended to limit the scope of the present invention only to those unless otherwise specified.

Embodiment 2

Referring to part (a) of FIG. 39 and part (b) of FIG. 39, FIG. 40, Embodiment 2 of the present invention will be described. Part (a) of FIG. 39 is a sectional view in the axial direction around a drive transmission member for explaining the support structure of the drive transmission member when the drive is applied. Part (b) of FIG. 39 is a sectional view in the axial direction for explaining the support structure around the drive transmission member when no drive is applied. FIG. 40 is a perspective view illustrating the shape of a bearing. Here, in this embodiment, portions different from the above-described embodiment will be described in detail. In particular, materials, shapes and the like are the same as in the above-mentioned embodiment unless otherwise stated. For such common portions, the same numbers will be given and detailed explanation will be omitted.

As shown in part (a) of FIG. 39, part (b) of FIG. 39, FIG. 40, an annular rib 194*a* provided in a first bearing 194 has a shape for increasing the accuracy of the distance between a drive idler gear 96 and a second gear portion 81*j* of a drive transmission member 81 while allowing the drive transmission member 81 to incline. The annular rib 194*a* is a portion corresponding to the first bearing 94 in Embodiment 1. In the following, the annular rib 194*a* in this embodiment, particularly those different from the first bearing 94 in Embodiment 1 will be described in detail.

An annular rib 194*a* is provided on an outer periphery of the first bearing 194, and the annular rib 194*a* is fitted to a second side plate. And, a rear end side of the drive transmission member 81 is rotatably fitted with the first bearing 194 and is supported thereby. By this, as shown in part (b) of FIG. 39, in a state where no driving is applied, the drive transmission member 81 can be inclined by gravity with an apex 194*a*1 of a circular arc of the annular rib 194*a* as a fulcrum.

In addition, an axial position of the annular rib 194*a* is in the neighborhood of the second gear portion 81*j* of the drive transmission member 81. By this, the inclination fulcrum of the drive transmission member 81 and the second gear portion 81*j* of the drive transmission member 81 are positioned with respect to the axial direction. The change in the distance between the drive idler gear 96 and the second gear portion 81*j* of the drive transmission member 81 when the drive transmission member 81 is inclined can be reduced. In addition, it is possible to reduce the change in the misalignment of the tooth trace. By this, it is possible to stabilize the engagement of the driving gears 81*j*, 96.

On the other hand, in a state where driving force is applied, the annular rib 194*a* of the first bearing 194 and the hole 193*b* of the second side plate 193 are fitted. Therefore, the precision of the axial distance between the drive idler gear 96 and the second gear portion 81*j* of the drive transmission member 81 is high, and the rotation accuracy is high like the bearing in which the entire longitudinal region is fitted.

In this embodiment, the annular rib 194 a is connected in the circumferential direction, but as shown in FIG. 41, even if the annular rib 294 a is discrete type, the drive transmission member 81 can be inclined in the same manner, and the accuracy of rotation by the drive idler gear 96 is high.

In the embodiments of the present invention, the annular rib 194 a is provided on the first bearing 194. However, as shown in FIG. 42, even if the annular rib 293 a is provided on the second side plate 293, the drive transmission member can incline similarly.

The function, material, shape and relative arrangement of the components described in the embodiments or its modifications are intended to limit the scope of the present invention only to those unless otherwise specified Absent.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2017-238455 filed on Dec. 13, 2017, which is hereby incorporated by reference herein in its entirety.

What is claimed is:

1. An electrophotographic image forming apparatus comprising:

a cartridge mounting space configure to receive a cartridge; and a driving shaft movable between (i) an advanced position in which the driving shaft is advanced toward the mounting space and (ii) a retracted position in which the driving shaft is retracted from the mounting space, wherein the driving shaft is configured to incline in response to movement from the advanced position to the retracted position such that an inclination of an axis of the driving shaft relative to a horizontal direction is greater when the driving shaft is in the retracted position than when the driving shaft is in the advanced position.

2. An electrophotographic image forming apparatus according to claim 1, further comprising a door capable of opening and closing the mounting space, wherein the driving shaft is configured to move from the advanced position to the retracted position in conjunction with the door opening the mounting space.

3. An electrophotographic image forming apparatus according to claim 1, further comprising an elastic member configured to apply a force to the driving shaft in a direction crossing the axis of the driving shaft.

4. An electrophotographic image forming apparatus according to claim 1, further comprising a projection configured to contact the driving shaft to incline the driving shaft when the driving shaft is in the retracted portion.

5. An electrophotographic image forming apparatus according to claim 4, wherein the driving shaft includes (i) a shaft portion having a tip exposed to the mounting space when the driving shaft is in the advanced portion and (ii) a gear portion disposed coaxially with the shaft portion and having a diameter greater than a diameter of the shaft portion, wherein the projection is configured to contact the gear portion when the driving shaft is in the retracted position.

6. An electrophotographic image forming apparatus according to claim 1, wherein the driving shaft includes a gear portion at an outer peripheral surface thereof, the gear portion being configured to mesh with a gear of the cartridge, wherein the driving shaft is configured to incline by the movement from the advanced position to the retracted position such that the gear portion of the driving shaft is moved away from the gear of the cartridge.

7. An electrophotographic image forming apparatus according to claim 1, wherein the driving shaft includes a coupling portion at a tip thereof, the coupling portion being configured to couple to a coupling of the cartridge when the driving shaft is in the advanced position, wherein the coupling portion of the driving shaft is configured to decouple from the coupling of the cartridge by the movement of the driving shaft from the advanced position to the retracted position.

* * * * *